US011698234B2

(12) United States Patent
Lee et al.

(10) Patent No.: US 11,698,234 B2
(45) Date of Patent: Jul. 11, 2023

(54) DISTRIBUTOR, HEAT EXCHANGER UNIT AND AIR CONDITIONER

(71) Applicant: Samsung Electronics Co., Ltd, Suwon-si (KR)

(72) Inventors: Sangmu Lee, Kanagawa (JP); Hyun Young Kim, Kanagawa (JP); Masaki Saito, Kanagawa (JP); Masatoshi Takahashi, Kanagawa (JP); Takeshi Takahara, Kanagawa (JP); Kangtae Seo, Suwon-si (KR); Kazushige Tajima, Kanagawa (JP); Ryo Inoha, Kanagawa (JP); Tsutomu Shimizu, Kanagawa (JP)

(73) Assignee: Samsung Electronics Co.. Ltd., Suwon-si (KR)

( * ) Notice: Subject to any disclaimer, the term of this patent is extended or adjusted under 35 U.S.C. 154(b) by 227 days.

(21) Appl. No.: 16/811,949

(22) Filed: Mar. 6, 2020

(65) Prior Publication Data

US 2020/0284533 A1 Sep. 10, 2020

(30) Foreign Application Priority Data

Mar. 6, 2019 (JP) ..... 2019-040907
Sep. 19, 2019 (JP) ..... 2019-170882
(Continued)

(51) Int. Cl.
*F28F 9/02* (2006.01)
*F24F 13/30* (2006.01)

(52) U.S. Cl.
CPC ..... *F28F 9/0275* (2013.01); *F24F 13/30* (2013.01); *F28F 2009/0295* (2013.01)

(58) Field of Classification Search
CPC ..... F28F 9/027; F28F 9/0273; F28F 9/0275; F28F 9/028; F25B 39/028
See application file for complete search history.

(56) References Cited

U.S. PATENT DOCUMENTS 1,537,553 A * 5/1925 Rushmore ..... F28D 1/05333 165/110
11,543,185 B2 1/2023 Onaka et al.
(Continued)

FOREIGN PATENT DOCUMENTS

CN 102287969 A * 12/2011
DE 19515527 A1 10/1996
(Continued)

OTHER PUBLICATIONS

Supplementary European Search Report dated Dec. 17, 2021, in connection with European Application No. 20765637.2, 7 pages.
(Continued)

*Primary Examiner* — Eric S Ruppert

(57) ABSTRACT

An air conditioner including a distributor configured to distribute a fluid to a heat exchanger. The distributor comprises a main pipe; a partition defining a plurality of distribution paths in the main pipe; a first branched pipe inserted into the main pipe as much as first length, linked to a first distribution path of the plurality of distribution paths, connected to a first portion of the heat exchanger; and a second branched pipe inserted into the main pipe as much as second length different from the first length, linked to the first distribution path, connected to a second portion of the heat exchanger. A flow velocity of air exchanging heat at the first portion of the heat exchanger is faster than a flow velocity of air exchanging heat at the second portion of the heat exchanger. The first length is shorter than the second length.

15 Claims, 50 Drawing Sheets

(30) Foreign Application Priority Data

| | | |
|---|---|---|
| Sep. 19, 2019 | (JP) | 2019-170883 |
| Jan. 9, 2020 | (JP) | 2020-001877 |
| Feb. 20, 2020 | (KR) | 10-2020-0020791 |

(56) References Cited

U.S. PATENT DOCUMENTS

| | | | | |
|---|---|---|---|---|
| 2020/0041178 | A1* | 2/2020 | Onaka | F25B 39/028 |
| 2020/0182564 | A1* | 6/2020 | Onaka | F28F 9/02 |

FOREIGN PATENT DOCUMENTS

| | | | | | |
|---|---|---|---|---|---|
| DE | 19719257 | A1 | * | 11/1998 | F25B 39/028 |
| EP | 2853843 | A1 | | 4/2015 | |
| EP | 2993418 | A2 | | 3/2016 | |
| GB | 2250336 | A | | 6/1992 | |
| JP | S61-136272 | U | | 8/1986 | |
| JP | H04-302964 | A | | 10/1992 | |
| JP | 2730299 | B2 | | 3/1998 | |
| JP | 3219014 | B2 | | 10/2001 | |
| JP | 2001304775 | A | * | 10/2001 | F28D 1/0535 |
| JP | 2008008584 | A | | 1/2008 | |
| JP | 2009-180444 | A | | 8/2009 | |
| JP | 2012-032112 | A | | 2/2012 | |
| JP | 2013019581 | A | * | 1/2013 | |
| KR | 10-2016-0020716 | A | | 2/2016 | |
| WO | WO-2018047511 | A | * | 3/2018 | F24F 1/14 |
| WO | WO-2018173256 | A1 | * | 9/2018 | F24F 1/16 |

OTHER PUBLICATIONS

International Search Report and Written Opinion of the International Searching Authority in connection with International Application No. PCT/KR2020/003073 dated Jul. 2, 2020, 3 pages.

National Intellectual Property Administration of the People's Republic of China, "Text of the First Office Action," dated Dec. 2, 2022, in connection with Chinese Patent Application No. 202080018705.X, 20 pages.

European Patent Office, "Communication under Rule 71(3) RPC—Intention to grant," dated Feb. 23, 2023, in connection with European Patent Application No. 20765637.2, 128 pages.

* cited by examiner

| BRANCHED PIPE | REFRIGERANT FLOW RATE |
|---|---|
| 1 | 3.49% |
| 2 | 3.43% |
| 3 | 3.40% |
| 4 | 3.34% |
| 5 | 3.29% |
| 6 | 3.23% |
| 7 | 3.15% |
| 8 | 3.09% |
| 9 | 3.06% |
| 10 | 2.99% |
| 11 | 2.96% |
| 12 | 2.91% |
| 13 | 2.82% |
| 14 | 2.76% |
| 15 | 2.71% |
| 16 | 2.66% |
| 17 | 2.60% |
| 18 | 2.54% |
| 19 | 2.42% |
| 20 | 2.37% |
| 21 | 2.32% |
| 22 | 2.27% |
| 23 | 2.22% |
| 24 | 2.17% |
| 25 | 2.07% |
| 26 | 2.03% |
| 27 | 2.00% |
| 28 | 1.95% |
| 29 | 1.93% |
| 30 | 1.90% |
| 31 | 1.81% |
| 32 | 1.78% |
| 33 | 1.76% |
| 34 | 1.75% |
| 35 | 1.73% |
| 36 | 1.72% |
| 37 | 1.69% |
| 38 | 1.69% |
| 39 | 1.69% |
| 40 | 1.69% |
| 41 | 1.55% |
| 42 | 1.06% |

DISTRIBUTOR, HEAT EXCHANGER UNIT AND AIR CONDITIONER

CROSS-REFERENCE TO RELATED APPLICATION

This application is based on and claims priority under 35 U. S. C. § 119 to Japanese Patent Application No. 2019-040907 filed on Mar. 6, 2019, Japanese Patent Application No. 2019-1708882 filed on Sep. 19, 2019, Japanese Patent Application No. 2019-170883 filed on Sep. 19, 2019, Japanese Patent Application No. 2020-001877 filed on Jan. 9, 2020, and Korean Patent Application No. 10-2020-0020791 filed on Feb. 20, 2020, the disclosures of which are incorporated herein by reference in their entirety.

BACKGROUND

1. Field

The disclosure relates to a distributor, a heat exchanger, and an air conditioner.

2. Discussion of Related Art

A distributor having a main pipe installed in the upstream of the main body of the distributor through which a fluid flows and a plurality of outflow pipes installed in the downstream is known, where the main pipe includes a distributor installed at an inlet through which a fluid flows in, an inner pipe linked to the distributor, partition members to form as many distribution paths as the number of the outflow pipes, and an outer pipe enclosing the inner pipe and forming a reservoir linked to each distribution path in the inner pipe, and each outflow pipe is linked to a reservoir corresponding to the main pipe (for example, see Patent Literature 1).

A refrigerant distributor for distributing a refrigerant to a plurality of refrigerant paths is known, where a distributor main body is defined by a vertically long barrel-shaped member having a refrigerant inlet coupled to a refrigerant pipe and an opposite refrigerant outlet and a plurality of distributor paths from the refrigerant inlet to the refrigerant outlet are partitioned and formed in the distributor main body (for example, see Patent Literature 2).

(Patent Literature 1) JP2730299 B2

(Patent Literature 2) JP1992-302964 A

SUMMARY

When a distributor is formed to have a plurality of branched pipes each linked to one of the plurality of distribution paths connected to a portion between neighboring partitions of the main pipe, the distributor may not be compact with an increase in the number of branched pipes.

When a distributor is formed to have a single branched pipe connected to each of the plurality of distribution paths defined in the main pipe, an increase in the number of branched pipes may lead to an increase in the number of distribution paths, which may fail to make the distributor compact.

As for a distributor having a plurality of reservoirs enclosing a plurality of distribution paths and linked to the plurality of distribution paths, when a structure in which each of the plurality of branched pipes is connected to a reservoir is employed, fluids flowing into the plurality of distribution paths may be unequally distributed, which may worsen flow distribution characteristics.

As for a distributor manufactured by inserting a plurality of partitions in the distributor main body, when a structure in which the distributor main body and the plurality of partition members are joined intact is employed, a fluid leak may occur between the outer pipe and the plurality of partitions or between an inner shaft and the plurality of partitions, which may worsen flow distribution characteristics.

An objective of the disclosure is to keep a distributor compact even when the number of branched pipes to be connected to a main pipe is increased.

Another objective of the disclosure is to reduce the possibility of worsening fluid distribution characteristics when fluids flowing into a plurality of distribution paths are not equally distributed.

Yet another objective of the disclosure is to reduce the possibility of worsening fluid distribution characteristics due to occurrence of a fluid leak between the outer pipe and the plurality of partitions or between the inner shaft and the plurality of partitions.

According to an aspect of the disclosure, a distributor includes a barrel-like main pipe; a plurality of partitions installed along the shaft of the main pipe to define a plurality of distribution paths in the main pipe; and a plurality of branched pipes each connected to one of the plurality of distribution paths, wherein first and second branched pipes of the plurality of branched pipes are connected to first and second distribution paths of the plurality of distribution paths with at least one of the plurality of partitions in between them.

The first and second branched pipes may be neighboring branched pipes, and the first and second distribution paths may have at least one of the plurality of partitions in between them.

The plurality of branched pipes may include at least two branched pipes connected to one of the plurality of distribution paths. In this case, the at least two branched pipes may be formed such that at least one of inner diameter of an axial part and insertion length to one distribution path differs among the at least two branched pipes. The plurality of partitions may be installed to form a certain twisted angle to the shaft of the main pipe.

The distributor may further include an orifice plate with a plurality of orifice holes corresponding to the plurality of distribution paths, and the plurality of orifice holes may have different inner diameter. In this case, the distributor may further include a position fitting tool for fitting the plurality of distribution paths into the plurality of orifice holes.

The plurality of partitions may form the plurality of distribution paths such that cross-sectional areas at a particular cutting plane of the plurality of distribution paths may differ.

The distributor may include two distributor elements, each of which may include a main pipe; a plurality of partitions; and a plurality of branched pipes, wherein first and second branched pipes of the plurality of branched pipes may be connected to first and second distribution paths of the plurality of distribution paths with at least one of the plurality of partitions in between them.

According to another aspect of the disclosure, a distributor includes a barrel-like main pipe; a plurality of partitions installed integrally with the main pipe along the shaft of the main pipe to define a plurality of distribution paths in the main pipe; and a plurality of branched pipes each connected to one of the plurality of distribution paths, wherein the plurality of branched pipes may include at least two branched pipes connected to one of the plurality of distribution paths.

The first and second branched pipes of the plurality of branched pipes may be connected to first and second distribution paths of the plurality of distribution paths, the first and second distribution paths having at least one of the plurality of partitions in between them. In this case, the first and second branched pipes may be neighboring branched pipes, and the first and second distribution paths may have at least one of the plurality of partitions in between them.

The at least two branched pipes may be formed such that at least one of inner diameter of an axial part and insertion length to one distribution path differs among the at least two branched pipes.

The plurality of partitions may be installed to form a certain twisted angle to the shaft of the main pipe.

The distributor may include an orifice plate with a plurality of orifice holes corresponding to the plurality of distribution paths, and the orifice plate may include a plurality of projections to be inserted to the plurality of distribution paths, respectively. In this case, a brazing sheet may be provided between the main pipe and the orifice plate.

The distributor may include a cap at an end of the main pipe to seal off all the plurality of distribution paths, and the cap may include a plurality of projections to be inserted to the plurality of distribution paths, respectively. In this case, a brazing sheet may be provided between the main pipe and the cap.

The distributor may include at least one cover on the outer circumference of the main pipe, and the at least one cover may include a plurality of burring holes to which the plurality of branched pipes are inserted.

The main pipe may include a plurality of burring holes to which the plurality of branched pipes are inserted.

According to another aspect of the disclosure, a distributor includes a barrel-like main pipe; a plurality of partitions installed along the shaft of the main pipe to define a plurality of distribution paths in the main pipe; and a plurality of branched pipes each connected to one of the plurality of distribution paths, wherein the plurality of partitions may be two neighboring partitions, each of which may include at least one step to support one of the plurality of branched pipes connected to a distribution path defined by the two partitions.

The first and second branched pipes of the plurality of branched pipes may be connected to first and second distribution paths of the plurality of distribution paths, the first and second distribution paths having at least one of the plurality of partitions in between them. In this case, the first and second branched pipes may be neighboring branched pipes, and the first and second distribution paths may have at least one of the plurality of partitions in between them.

The plurality of branched pipes may include at least two branched pipes connected to one distribution path. In this case, each of the two partitions may have a plurality of steps, and at least two branched pipes are supported by different ones of the plurality of steps, making at least one of the inner diameter of an axial part or insertion length into the distribution path differs among the branched pipes. The plurality of partitions may be installed to form a certain twisted angle to the shaft of the main pipe.

Each of the two partitions may have a particular step at a shallow position not deeper than half of the depth of the distribution path among the at least one step, and a branched pipe connected to a distribution path may be supported by the particular step, making insertion length to the distribution path shorter than half of the depth.

The main pipe and a member including the plurality of partitions may be bonded by shrinking the main pipe and expanding the member.

Each of the plurality of partitions may include a crushed lib at the front, which is crumpled and modified by contact with the main pipe.

According to another aspect of the disclosure, a distributor includes a barrel-shaped outer pipe; an inner shaft installed in the outer pipe; a plurality of partitions defining a plurality of distribution paths between the outer pipe and the inner shaft; and a plurality of branched pipes each connected to one of the plurality of distribution paths, wherein the plurality of partitions are installed integrally with the inner shaft, or installed integrally with a member bonded to the outer pipe with a substance different from the partition and the outer pipe or the outer pipe, or installed integrally with a member bonded to the inner shaft with a substance different from the partition and the inner shaft.

The distributor may be formed such that at a first location of an open end of the outer pipe, convex portion may be formed in the plurality of distribution paths and concave portions may be formed on the outer surface. In this case, the distributor may include an orifice plate at a second location other than the end of the outer part.

The distributor may include an orifice plate at a first location at an open end of the outer pipe, and may be formed such that at a second location other than the end of the outer pipe, convex portion may be formed in the plurality of distribution paths and concave portions may be formed on the outer surface.

The plurality of partitions may be installed to form a certain twisted angle to the shaft of the outer pipe. In this case, the plurality of partitions may be installed to form a first twisted angle to the shaft of the outer pipe in a first range in the axial direction of the outer pipe and form a second twisted angle to the shaft of the outer pipe in a second range in the axial direction of the outer pipe.

The plurality of partitions may not be rib-processed on their surfaces in a first range in the axial direction of the outer pipe and may be rib-processed on their surfaces in a second range in the axial direction of the pipe.

The plurality of partitions have first thickness at a first location in the axial direction of the outer pipe, and second thickness at a second location in the axial direction of the outer pipe.

The plurality of branched pipes may include at least two branched pipes connected to one of the plurality of distribution paths. In this case, the at least two branched pipes may have different diameter of holes formed on a side of a portion inserted to a distribution path.

According to an aspect of the disclosure, a heat exchanger unit includes a distributor distributing a fluid passing inside; and a heat exchanger performing heat exchange between the fluid distributed by the distributor and air, wherein the distributor includes a barrel-like main pipe; a plurality of partitions installed along the shaft of the main pipe to define a plurality of distribution paths in the main pipe; and a plurality of branched pipes each connected to one of the plurality of distribution paths, wherein first and second branched pipes of the plurality of branched pipes are connected to first and second distribution paths of the plurality of distribution paths with at least one of the plurality of partitions in between them.

The distributor may be shorter than length across which a plurality of fluid pipes in which the fluid distributed by the distributor flows are arranged in parallel.

The plurality of branched pipes may include at least two branched pipes connected to one of the plurality of distribution paths. In this case, the at least two branched pipes may be formed such that at least one of inner diameter of an axial part and insertion length to one distribution path differs among the at least two branched pipes. At least two branched pipes may be arranged such that inner diameter of an axial part of a branched pipe, through which a fluid distributed for a fast air flow portion of the heat exchanger passes is greater than the inner diameter of the axial part of a branched pipe, through which a fluid distributed for a slow air flow portion of the heat exchanger passes, and insertion length of a branched pipe to the distribution path, through which the fluid distributed for a fast air flow portion of the heat exchanger passes, is shorter than the insertion length of a branched pipe to the distribution path, through which the fluid distributed for a slow air flow portion of the heat exchanger passes.

According to another aspect of the disclosure, a heat exchanger unit includes a distributor distributing a fluid passing inside; and a heat exchanger performing heat exchange between the fluid flowing in a plurality of fluid pipes and air, wherein the distributor includes a barrel-like main pipe; a plurality of partitions installed integrally with the main pipe along the shaft of the main pipe to define a plurality of distribution paths in the main pipe; and a plurality of branched pipes each connected to one of the plurality of distribution paths, wherein the plurality of branched pipes includes at least two branched pipes connected to one of the plurality of distribution paths.

According to another aspect of the disclosure, a heat exchanger unit includes a distributor distributing a fluid passing inside; and a heat exchanger performing heat exchange between the fluid flowing in a plurality of fluid pipes and air, wherein the distributor includes a barrel-like main pipe; a plurality of partitions installed along the shaft of the main pipe to define a plurality of distribution paths in the main pipe; and a plurality of branched pipes each connected to one of the plurality of distribution paths and one of the plurality of fluid pipes, wherein the plurality of partitions are two neighboring partitions, each of which includes at least one step supporting one of the plurality of branched pipes connected to a distribution path defined by the two partitions.

The plurality of branched pipes may include at least two branched pipes connected to one distribution path. In this case, each of the two partitions may have a plurality of steps, and at least two branched pipes are supported by different ones of the plurality of steps, making at least one of the inner diameter of an axial part or insertion length into the distribution path differs among the branched pipes.

Each of the two partitions may have a particular step at a shallow position not deeper than half of the depth of the distribution path among the at least one step, and a branched pipe connected to a distribution path may be supported by the particular step, making insertion length to the distribution path shorter than half of the depth.

At least one of the plurality of branched pipes may be branched into a plurality of branched pipes, each of which may be connected to one of the plurality of fluid pipes.

According to another aspect of the disclosure, a heat exchanger unit includes a distributor distributing a fluid passing inside; and a heat exchanger performing heat exchange between the fluid flowing in a plurality of fluid pipes and air, wherein the distributor includes a barrel-like outer pipe; an inner shaft installed in the outer pipe; a plurality of partitions installed between the outer pipe and the inner shaft to define a plurality of distribution paths; and a plurality of branched pipes each connected to one of the plurality of distribution paths, and wherein the plurality of partitions may be installed integrally with the inner shaft, or installed integrally with a member bonded to the outer pipe with a substance different from the partition and the outer pipe or with the outer pipe, or installed integrally with a member bonded to the inner shaft with a substance different from the partition and the inner shaft.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 42, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Figure 1:
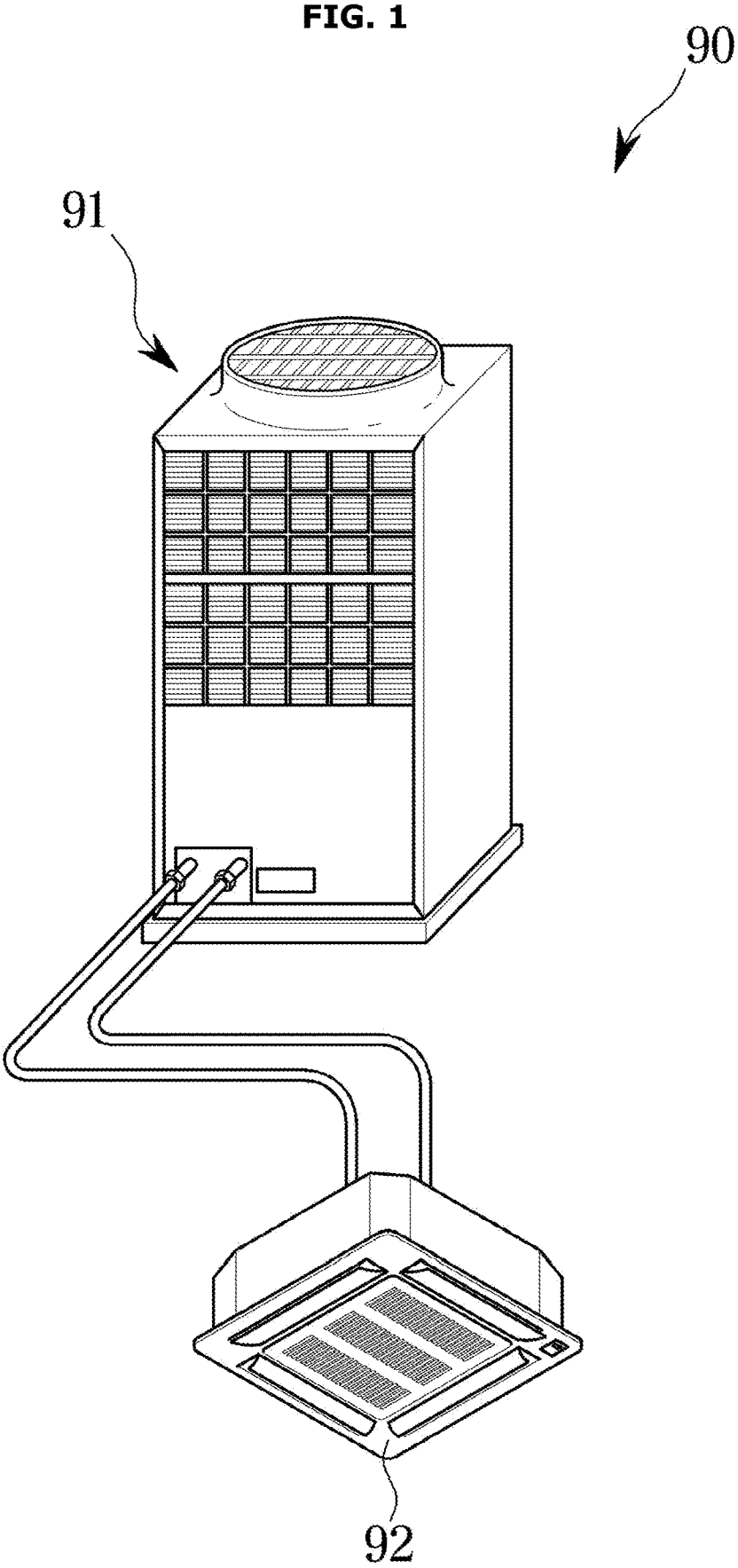
FIG. 1 illustrates an air conditioner, according to an embodiment of the disclosure.

Referring to FIG. 1, an air conditioner 90 according to an embodiment of the disclosure may include an outdoor unit 91 and an indoor unit 92. In the air conditioner 90, the outdoor unit 91 and the indoor unit 92 may be connected to each other through a pipe provided to allow a refrigerant to flow in the pipe.

Although FIG. 1 illustrates the single outdoor unit 91, the outdoor unit 91 may be provided in the plural. The outdoor unit 91 may perform both the heat pump cycle and the heat recovery cycle.

Although FIG. 1 illustrates the single indoor unit 92, the indoor unit 92 may be provided in the plural. The indoor unit 92 may be driven in cooling mode or heating mode.

A heat exchange unit as will be described later may be provided in the outdoor unit 91 and/or the indoor unit 92.

Figure 2:
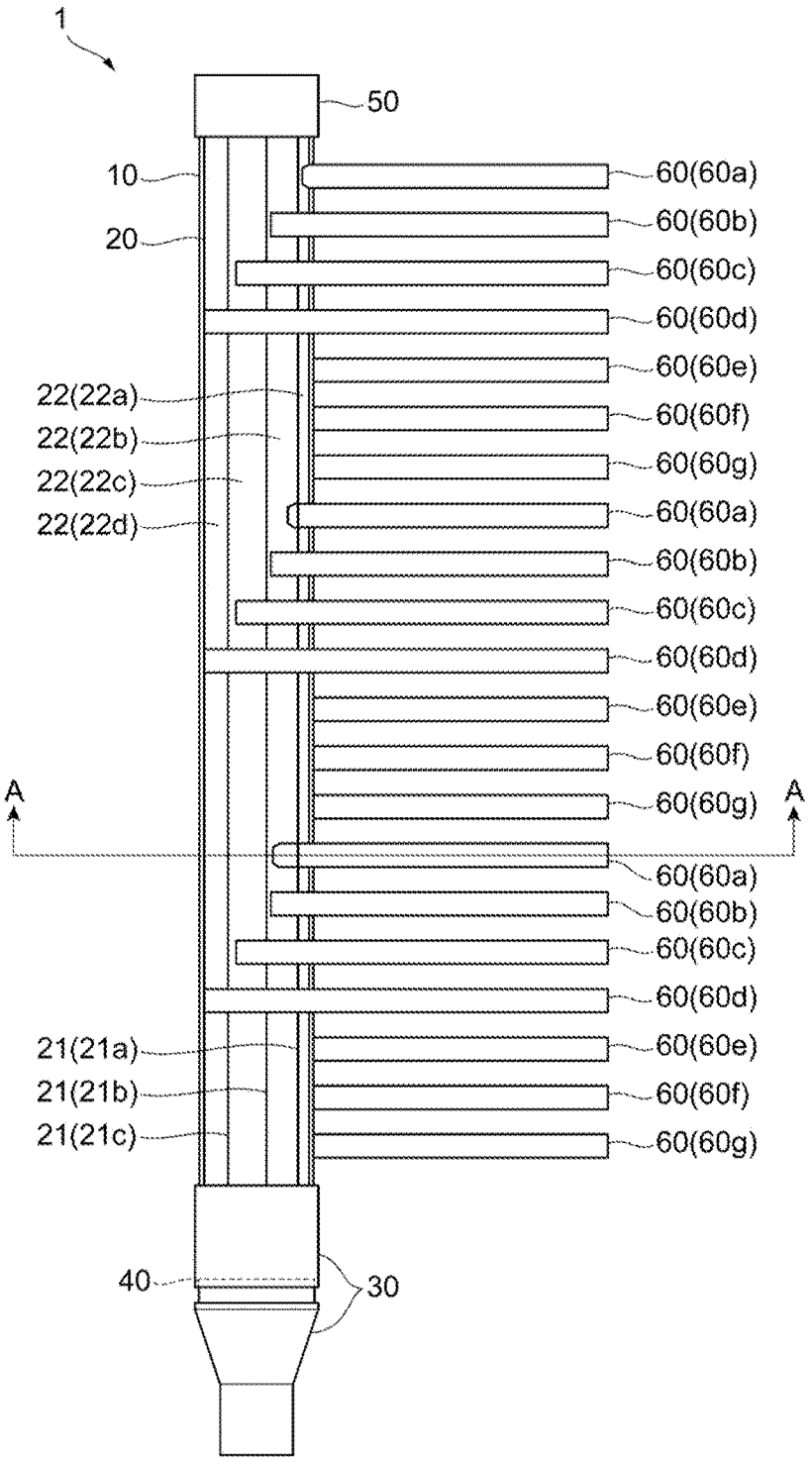
FIG. 2 illustrates an overall structure of a distributor, according to a first embodiment of the disclosure.

FIG. 2 illustrates an overall structure of a distributor 1, according to a first embodiment of the disclosure. The distributor 1 is to distribute a refrigerant as an example of a fluid that passes in the distributor 1. Furthermore, as shown in FIG. 1, the distributor 1 may include an outer pipe 10 in the form of a cylinder, an inner pipe 20 installed in the outer pipe 10, and an orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Furthermore, the distributor 1 may include an inlet 30 e.g., welded to the refrigerant upstream end of the outer pipe 10 to guide the refrigerant, and a cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 2. Moreover, the distributor 1 may include a plurality of branched pipes 60 fixed in the refrigerant downstream and connected to refrigerant pipes of a heat exchanger.

In FIG. 2, an internal structure of the inner pipe 20 is shown by removing the front of the outer pipe 10. As shown in FIG. 2, a plurality of partition plates 21 are installed in the inner pipe 20, defining a plurality of distribution paths 22 accordingly. In the first embodiment of the disclosure, the plurality of partition plates 21 are installed in parallel with a center shaft of the inner pipe 20. In FIG. 2, as viewed from the front, of the plurality of partition plates 21, partition plates 21*a* to 21*c* (ends of the partition plates 21*a* to 21*c* on the side of the outer pipe 10, in particular) are shown, and of the plurality of distribution paths 22, distribution paths 22*a* to 22*d* are shown. Although it is assumed herein that the plurality of partition plates 21 are installed in parallel with the center shaft of the inner pipe 20, they may be installed along the shaft of the inner pipe 20, in which case, the plurality of partition plates 21 are an example of a plurality of partitions installed along the shaft of the main pipe.

Furthermore, the orifice plate 40 may have a plurality of orifice holes 401 (see e.g., FIG. 9) through which to allow the refrigerant to flow into the plurality of distribution paths 22.

The plurality of branched pipes 60 may be linked to the plurality of distribution paths 22. FIG. 2 shows the branched pipes 60*e* to 60*g* linked to distribution paths 22*e* to 22*g*, respectively, in addition to the branched pipes 60*a* to 60*d* linked to the distribution paths 22*a* to 22*d*, respectively.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 2, in the first embodiment of the disclosure, the branched pipe 60*a* may extend to the right directly from the distribution path 22*a*. The branched pipes 60*b* to 60*d* may extend forward from the distribution paths 22*b* to 22*d* first and then bend and extend to the right. The branched pipes 60*e* to 60*g* may extend to the opposite side from the distribution paths 22*e* to 22*g* first and then bend and extend to the right.

There may be one set of branched pipes 60*a* to 60*g*, although in the first embodiment of the disclosure, there may be a multiple sets of branched pipes 60*a* to 60*g* installed in parallel. The structure as in the first embodiment of the disclosure may be understood as an example of a structure that includes at least two branched pipes connected to one of the plurality of distribution paths.

Figure 3:
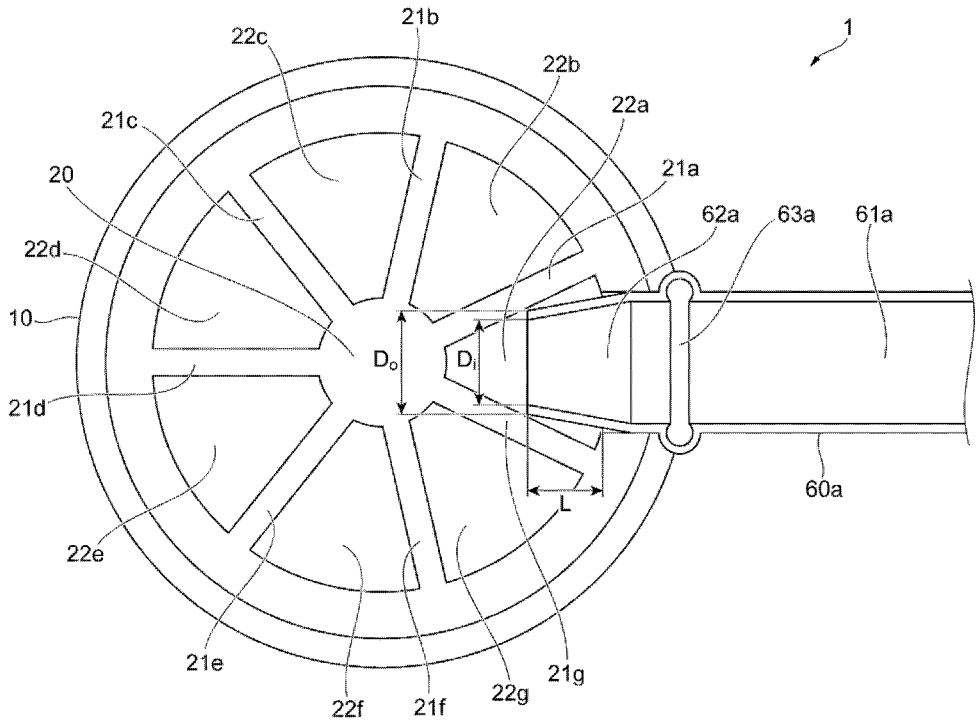
FIG. 3 illustrates an A-A cross-sectional view of the distributor of FIG. 2.

FIG. 3 illustrates an A-A cross-sectional view of the distributor 1 of FIG. 2. Referring to FIG. 3, the partition plates 21*a* to 21*g* may be installed in the inner pipe 20, defining the plurality of distribution paths 22*a* to 22*g* accordingly. The partition plates 21 connect the outer side of the inner pipe 20 to the center portion of the inner pipe 20, so that the width of the distribution path 22 between the partition plates 21 decreases as it goes from the outer side to the center portion of the inner pipe 20. In FIG. 3, the branched pipe 60*a* linked and fixed to the distribution path 22*a* is inserted between the partition plates 21*a* and 21*g* that define the distribution path 22*a*. Furthermore, in the first embodiment of the disclosure, inner diameter Di of an axial part 62*a* differs among the multiple branched pipes 60*a* (three branched pipes 60*a* in FIG. 2). The axial part 62*a* may be a vena contract portion 62*a*. Moreover, in the first embodiment of the disclosure, insertion length L differs among the multiple branched pipes 60*a* (three branched pipes 60*a* in FIG. 2). Although the branched pipe 60*a* linked to the distribution path 22*a* is shown because FIG. 3 is an A-A cross-sectional view of the distributor 1 of FIG. 2, what are described above in connection with the branched pipe 60*a* may be equally applied to the other branched pipes 60*b* to 60*g* linked to the distribution paths 22*a* to 22*g*. Accordingly, refrigerant flow resistance may be changed in the single distribution path 22 so that refrigerant flow distribution may be adjusted, thereby increasing heat exchange capability.

Next, a modification to the first embodiment of the disclosure will be described.

Figure 4:
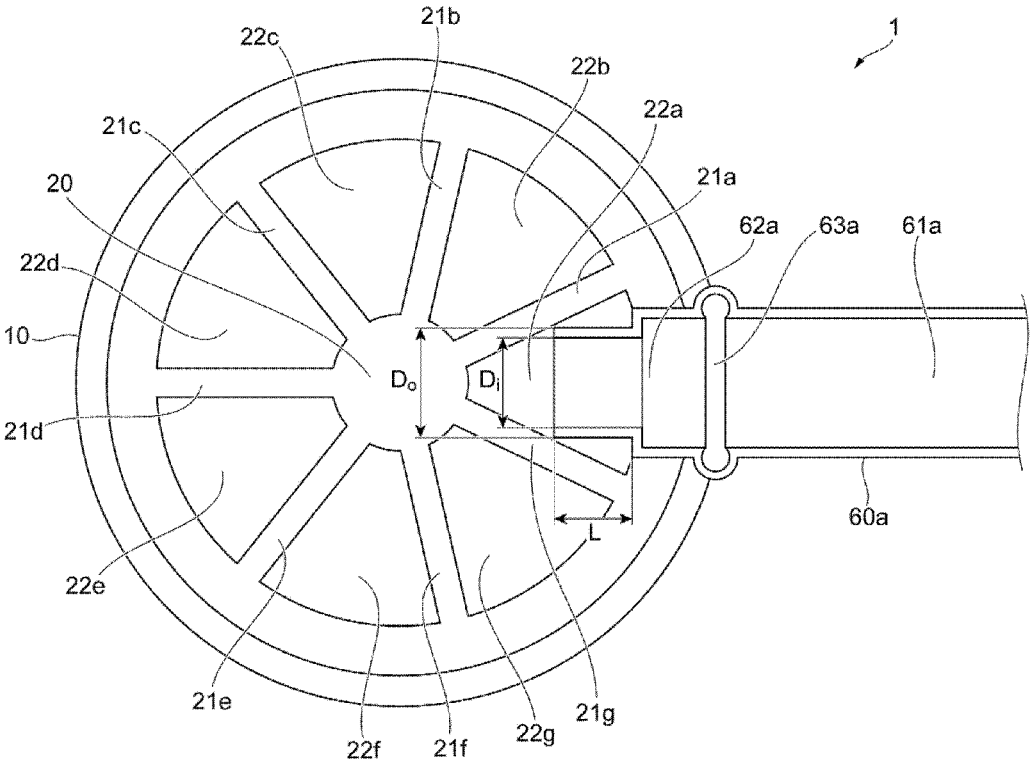
FIG. 4 illustrates a first modification to the A-A cross-sectional view of the distributor of FIG. 2.

FIG. 4 illustrates a first modification to the A-A cross-sectional view of the distributor 1 of FIG. 2. While the axial part 62*a* of the branched pipe 60*a* has the shape that has an inclination from a main body 61*a* of the branched pipe 60*a* in FIG. 3, it may have the straight form with a step from the main body 61*a* as shown in FIG. 4 to adjust flow of the refrigerant passage.

Furthermore, the insertion length L of the branched pipe 60*a* is adjusted by installing a beading part 63*a* in FIGS. 3 and 4, but is not be limited thereto. In a second modification, the insertion length L may be adjusted by outer diameter Do of the axial part 62*a*. Specifically, the insertion length L of the branched pipe 60*a* may be determined by inserting the branched pipe 60*a* until the outer diameter Do of the axial part 62*a* fits the width between the partition plates 21*a* and 21*g*.

Figure 5A:
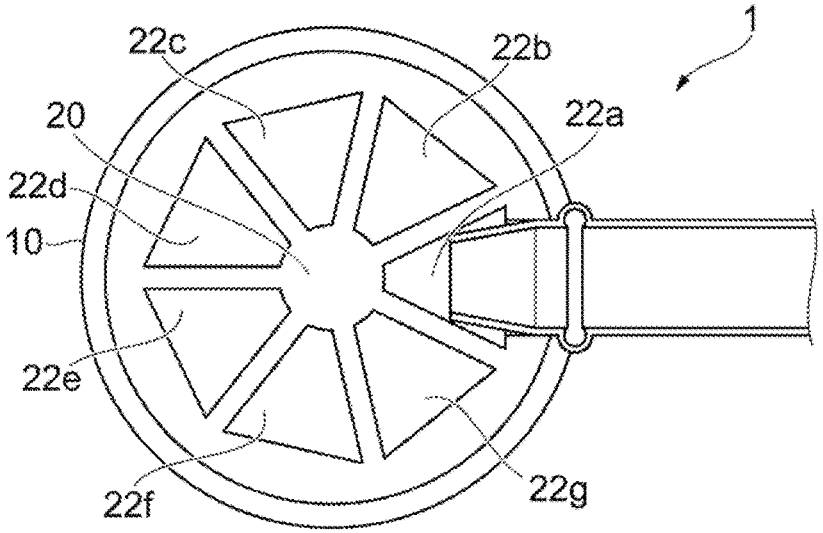
FIG. 5A illustrates a second modification to the A-A cross-sectional view of the distributor of FIG. 2.
Figure 5B:
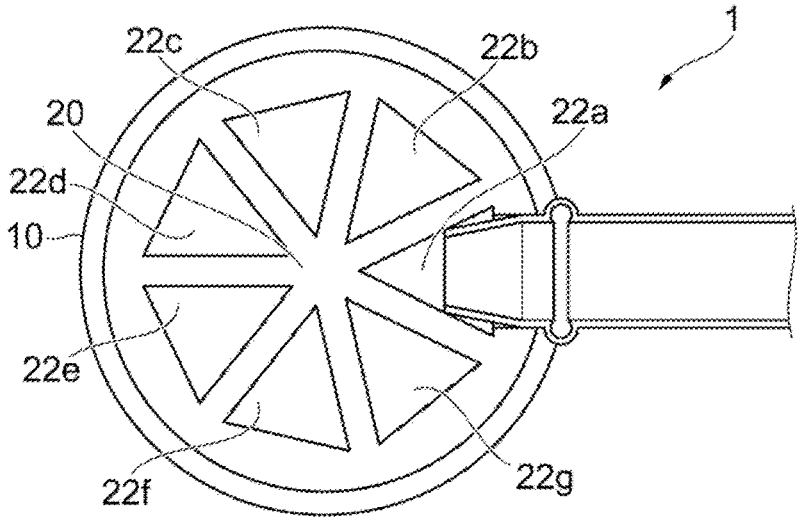
FIG. 5B illustrates a second modification to the A-A cross-sectional view of the distributor of FIG. 2.
Figure 5C:
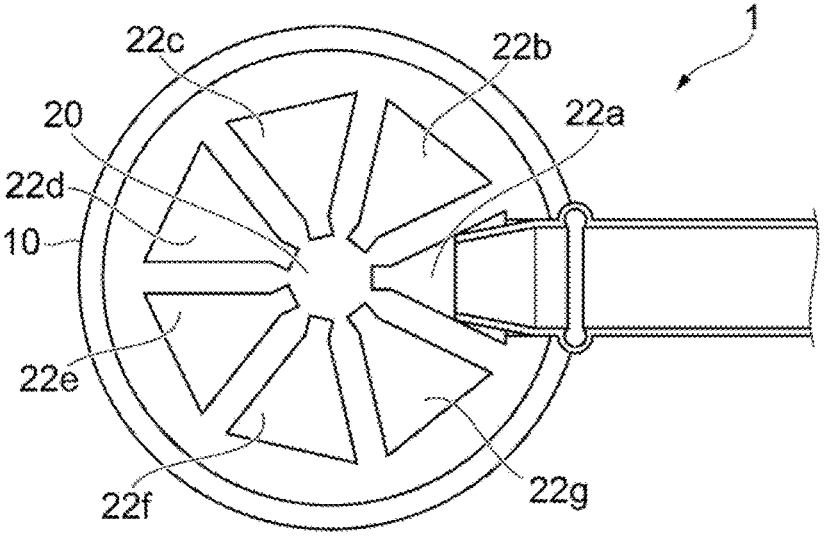
FIG. 5C illustrates a second modification to the A-A cross-sectional view of the distributor of FIG. 2.

FIGS. 5A to 5C illustrate second modifications to the A-A cross-sectional view of the distributor 1 of FIG. 2. The cross-section of the distribution paths 22*a* to 22*g* may have the form of a trapezoid as shown in FIG. 5A, a triangle as shown in FIG. 5B, and a combination of trapezoid and rectangle as shown in FIG. 5C.

Figure 6:
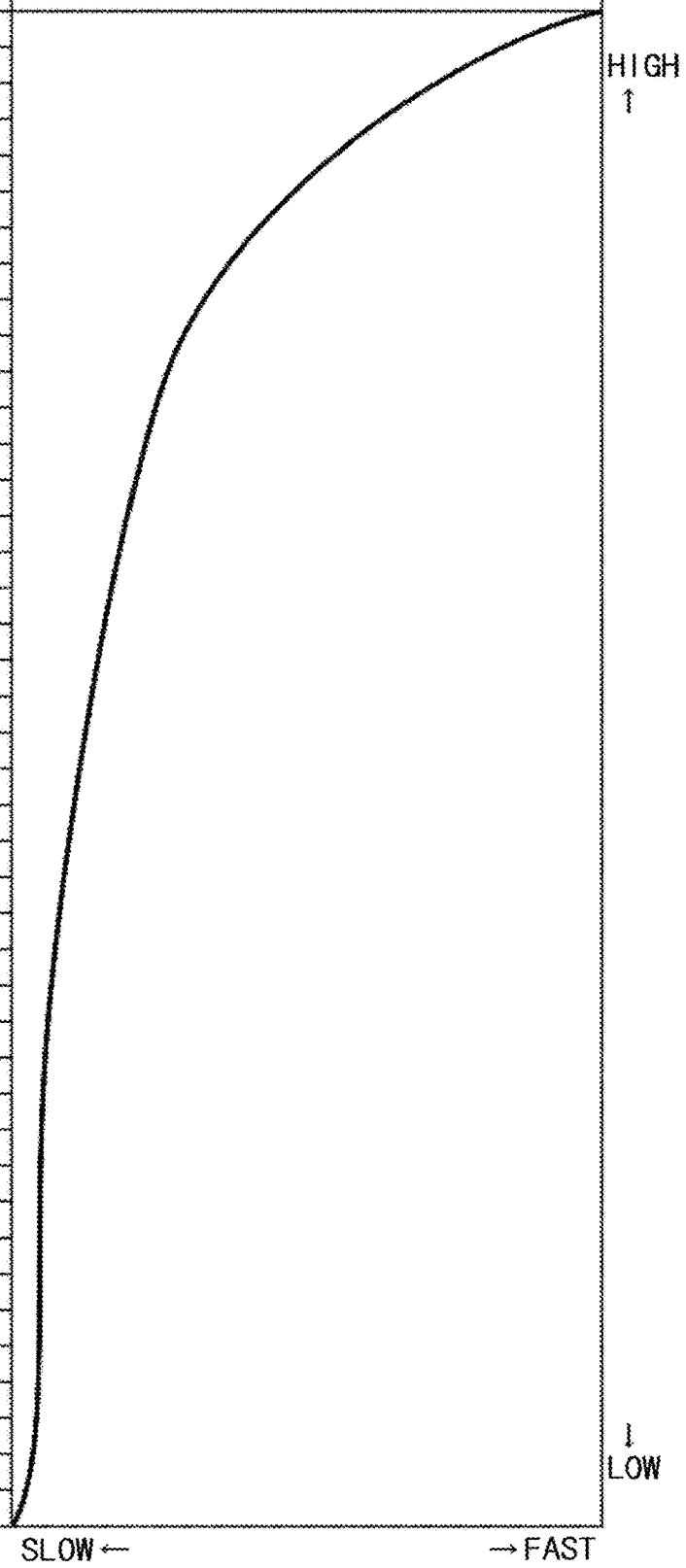
FIG. 6 illustrates relations for each branched pipe in a heat exchanger between wind velocity at the height of a refrigerant pipe connected to the branched pipe and a refrigerant flow rate suitable to flow into the branched pipe.

Next, specific examples of the plurality of branched pipes 60 having different inner diameter Di of the axial part 62 and different insertion length L will be described. FIG. 6 illustrates relations for each branched pipe 60 in a heat exchanger between wind velocity at the height of a refrigerant pipe connected to the branched pipe 60 and a refrigerant flow suitable to flow into the branched pipe 60. Referring to FIG. 6, it may be seen that at a higher height, wind velocity increases, so more refrigerant flow may be desirable. For more refrigerant flow, the inner diameter Di of the axial part 62 may be increased and the insertion length L of the branched pipe 60 may be reduced.

In FIG. 6, for example, it is assumed that 6 branched pipes 60 are each linked to 7 distribution paths 22, so that the refrigerant flows into a total of 42 branched pipes 60.

In this case, when the refrigerant flows equally into the 7 distribution paths, among the 42 branched pipes 60, one connected to a refrigerant pipe at a high height of the heat exchanger may have the axial part 62 with large inner diameter Di and have short insertion length L.

On the other hand, when the refrigerant flows unequally into the 7 distribution paths, among the 6 branched pipes 60 linked to each distribution path 22, one connected to a refrigerant pipe at a higher height of the heat exchanger may have the axial part 62 with large inner diameter Di and have short insertion length L.

In this example, refrigerant pipes connected to the branched pipes 60 are arranged in parallel in the vertical direction of the heat exchanger, so the inner diameter of the axial part 62 and the insertion length L may differ depending on the location in the vertical direction of the heat exchanger, but it is not be limited thereto.

As for the inner diameter Di of the axial part 62, the aforementioned structure may be understood as an example of a structure in which the inner diameter of the axial part of one of at least two branched pipes, through which a fluid distributed for a fast air flow portion of the heat exchanger passes is greater than the inner diameter of the axial part of the other branched pipe, through which a fluid distributed for a slow air flow portion of the heat exchanger passes.

Furthermore, as for the insertion length L of the branched pipe 60, the aforementioned structure may be understood as an example of a structure in which the insertion length of one of at least two branched pipes to the distribution path, through which the fluid distributed for a fast air flow portion of the heat exchanger passes, is shorter than the insertion length of the other branched pipe to the distribution path, through which the fluid distributed for a slow air flow portion of the heat exchanger passes.

In the meantime, although both the inner diameter Di of the axial part 62 and the insertion length L differ among the plurality of branched pipes 60 in the first embodiment of the disclosure, it will not be limited thereto. At last one of the inner diameter of the axial part 62 or the insertion length L may differ among the plurality of branched pipes 60.

Figure 7:
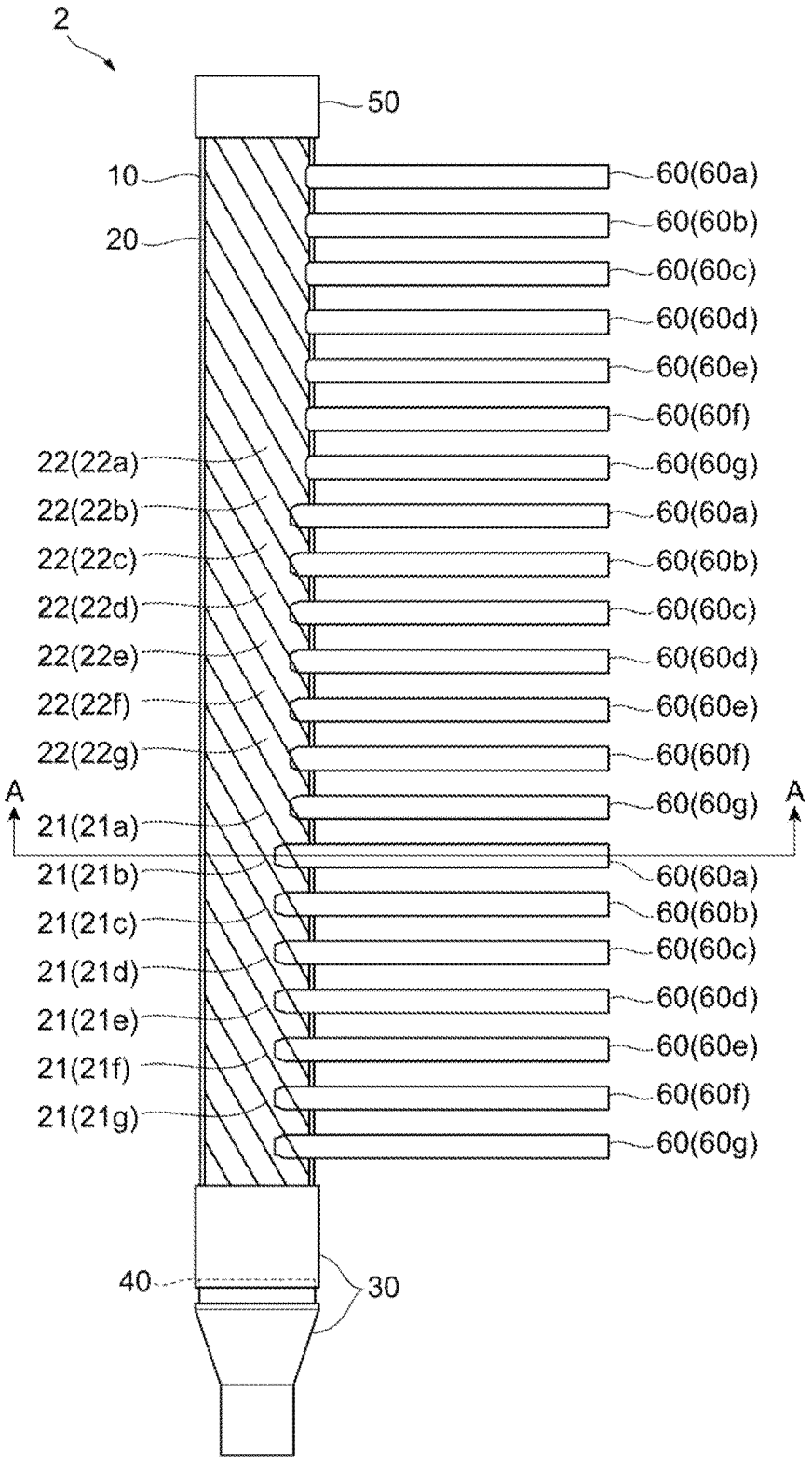
FIG. 7 illustrates an overall structure of a distributor, according to a second embodiment of the disclosure.

FIG. 7 illustrates an overall structure of a distributor 2, according to a second embodiment of the disclosure. The distributor 2 is also to distribute a refrigerant as an example of a fluid that passes in the distributor 2. Furthermore, as shown in FIG. 7, the distributor 2 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Furthermore, the distributor 2 may include the inlet 30 e.g., welded to the refrigerant upstream end of the outer pipe 10 to guide the refrigerant, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 7. Moreover, the distributor 2 may include a plurality of branched pipes 60 fixed in the refrigerant downstream and connected to refrigerant pipes of a heat exchanger.

In FIG. 7, an internal structure of the inner pipe 20 is shown by removing the front of the outer pipe 10. As shown in FIG. 7, a plurality of partition plates 21 are installed in the inner pipe 20, defining a plurality of distribution paths 22 accordingly. In the second embodiment of the disclosure, the plurality of partition plates 21 are installed at a certain twisted angle to the center shaft of the inner pipe 20. In FIG. 7, of the plurality of partition plates 21, partition plates 21*a* to 21*g* (ends of the partition plates 21*a* to 21*g* on the side of the outer pipe 10, in particular) are shown, and of the plurality of distribution paths 22, distribution paths 22*a* to 22*g* are shown. Although it is assumed herein that the plurality of partition plates 21 are installed at a twisted angle to the center shaft of the inner pipe 20, they may also be said as being installed along the shaft of the inner pipe 20, in which case, the plurality of partition plates 21 are an example of a plurality of partitions installed along the shaft of the main pipe.

Furthermore, in FIG. 7, the orifice plate 40 may have the plurality of orifice holes 401 (see e.g., FIG. 9) through which to allow the refrigerant to flow into the plurality of distribution paths 22.

The plurality of branched pipes 60 may be linked to the plurality of distribution paths 22. FIG. 7 shows the branched pipes 60*a* to 60*g* linked to the distribution paths 22*a* to 22*g*, as the plurality of branched pipes 60.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 7, in the second embodiment of the disclosure, the distribution paths 22*a* to 22*g* are defined to have a certain twisted angle to the center shaft of the inner pipe 20, so all the distribution paths 22*a* to 22*g* may turn around the inner pipe 20 once and pass through the right side of the inner pipe 20. Accordingly, the branched pipes 60*a* to 60*g* may all extend to the right by being linked to the portions at which the distribution paths 22*a* to 22*g* pass through the right side of the inner pipe 20. This structure may be understood as an example of a structure in which a plurality of partitions are installed to make a certain twisted angle to the shaft of the main pipe.

There may be one set of branched pipes 60*a* to 60*g*, although in the second embodiment of the disclosure, there may be a multiple sets of branched pipes 60*a* to 60*g* installed in parallel. The structure as in the second embodiment of the disclosure may be understood as an example of a structure that includes at least two branched pipes connected to one of the plurality of distribution paths.

The A-A cross-sectional view of the distributor 2 of FIG. 7 is similar to what is shown in FIG. 3. Even in the second embodiment of the disclosure, the inner diameter Di of the axial part 62*a* differs among the multiple branched pipes 60*a* (three branched pipes 60*a* in FIG. 7). Moreover, in the second embodiment of the disclosure, insertion length L differs among the multiple branched pipes 60*a* (three branched pipes 60*a* in FIG. 7). The same is true of the branched pipes 60*b* to 60*g* linked to the distribution paths 22*b* to 22*g*.

Figure 8:
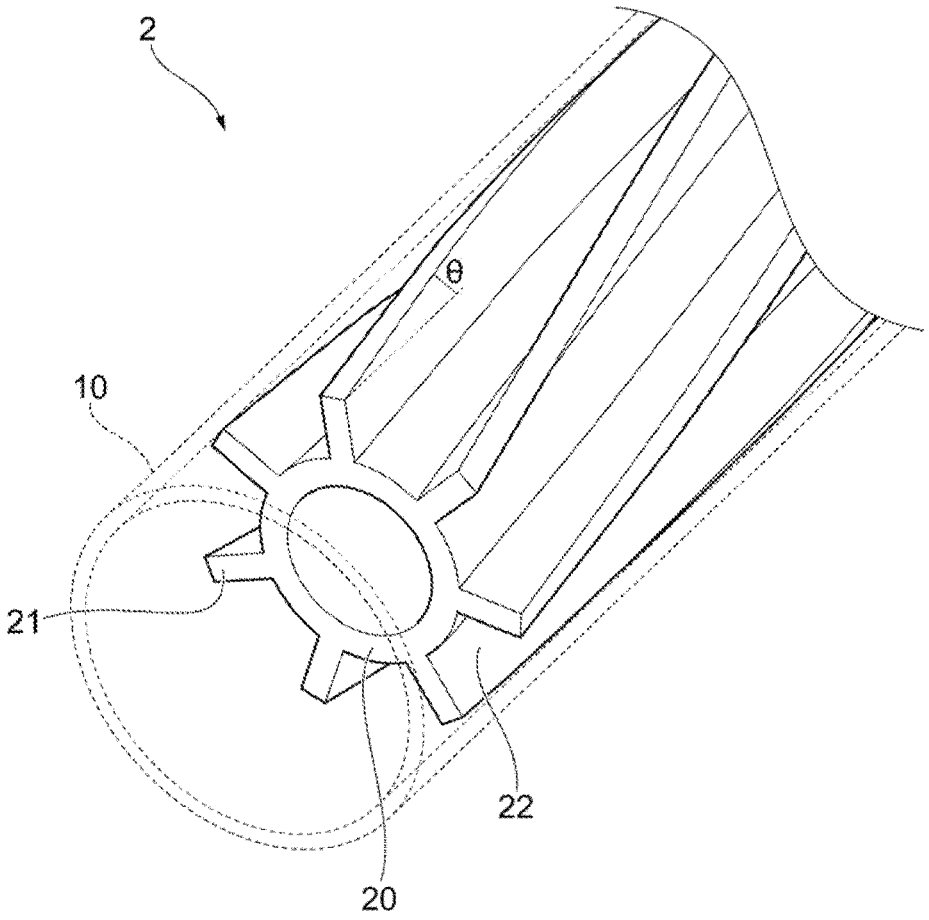
FIG. 8 illustrates a partially enlarged view of the distributor, according to the second embodiment of the disclosure.

FIG. 8 illustrates a partially enlarged view of the distributor 2, according to the second embodiment of the disclosure. Referring to FIG. 8, the partition plates 21 are formed to have a twisted angle θ to the center shaft of the inner pipe 20 between the outer pipe 10 and the inner pipe 20. Accordingly, centrifugal force of the refrigerant in the distribution path 22 may be changed, so that refrigerant flow distribution may be adjusted, thereby increasing heat exchange capability.

A specific implementation in which the inner diameter Di of the axial part 62 and the insertion length L may differ among the plurality of branched pipes 60 may be considered to be the same as in the first embodiment.

In the meantime, although both the inner diameter Di of the axial part 62 and the insertion length L differ among the plurality of branched pipes 60 in the second embodiment of the disclosure, it will not be limited thereto. The inner diameter Di of the axial part 62 and the insertion length L of the branched pipe 60 may remain the same among the plurality of branched pipes 60.

An overall structure of a distributor 3 according to the third embodiment of the disclosure is similar to that in FIG. 2 or 7. The distributor 3 is also to distribute a refrigerant as an example of a fluid that passes in the distributor 3. Furthermore, the distributor 3 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 3 may include a plurality of branched pipes 60 fixed in the refrigerant downstream and connected to refrigerant pipes of a heat exchanger.

A plurality of partition plates 21 are installed in the inner pipe 20, defining a plurality of distribution paths 22 accordingly.

Figure 9:
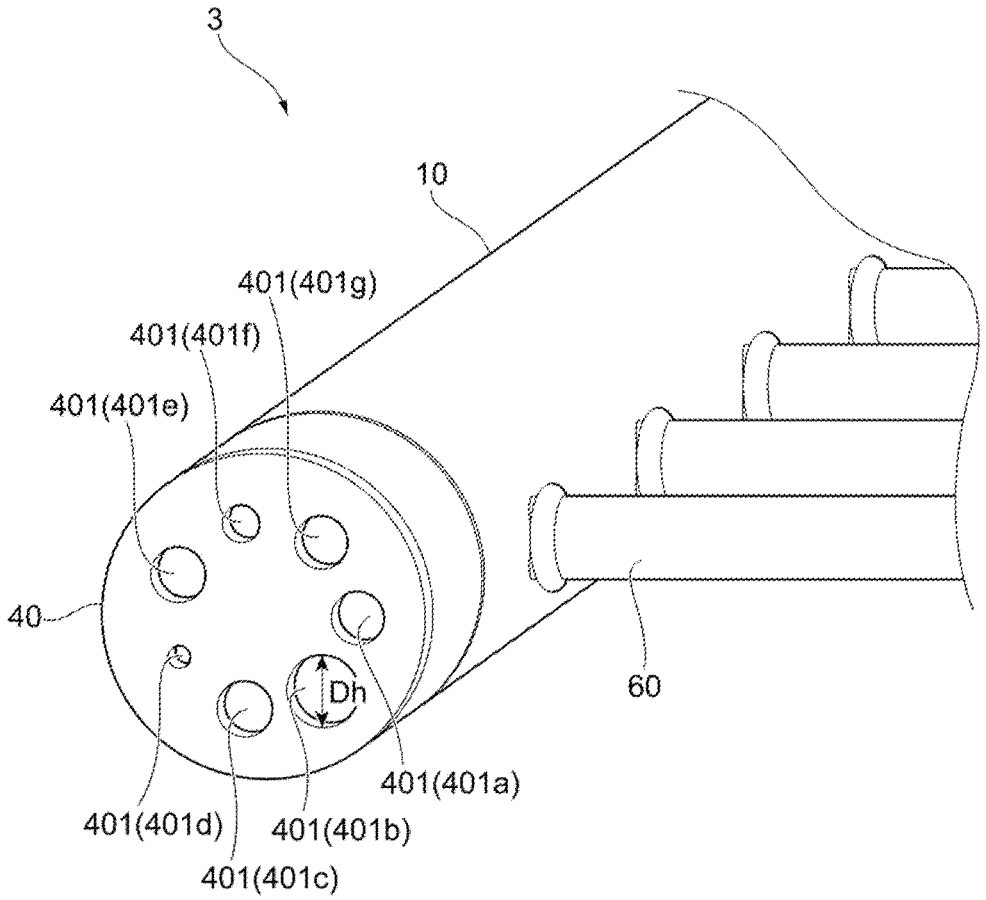
FIG. 9 illustrates a partially enlarged view of a distributor, according to a third embodiment of the disclosure.

FIG. 9 illustrates a partially enlarged view of the distributor 3, according to the second embodiment of the disclosure. Referring to FIG. 9, the orifice plate 40 may have the plurality of orifice holes 401 through which to allow the refrigerant to flow into the plurality of distribution paths 22. In FIG. 9, as the plurality of orifice holes 401, orifice holes 401*a* to 401*g* through which to allow the refrigerant to flow into the plurality of distribution paths 22*a* to 22*g*, respectively, are shown. The orifice holes 401*a* to 401*g* are an example of the plurality of orifice holes corresponding to the plurality of distribution paths. In the third embodiment of the disclosure, hole diameter Dh differs among the plurality of orifice holes 401. Accordingly, refrigerant flow distribution to the plurality of distribution paths 22 may be adjusted, thereby increasing heat exchange capability.

Plate thickness of the orifice plate 40 may be equal to or greater than e.g., about 1 mm.

An overall structure of a distributor 4 according to the third embodiment of the disclosure is similar to that in FIG. 2 or 7. The distributor 4 is also to distribute a refrigerant as an example of a fluid that passes in the distributor 4. Furthermore, the distributor 4 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 4 may include a plurality of branched pipes 60 fixed in the refrigerant downstream and connected to refrigerant pipes of a heat exchanger.

A plurality of partition plates 21 are installed in the inner pipe 20, defining a plurality of distribution paths 22 accordingly.

Figure 10:
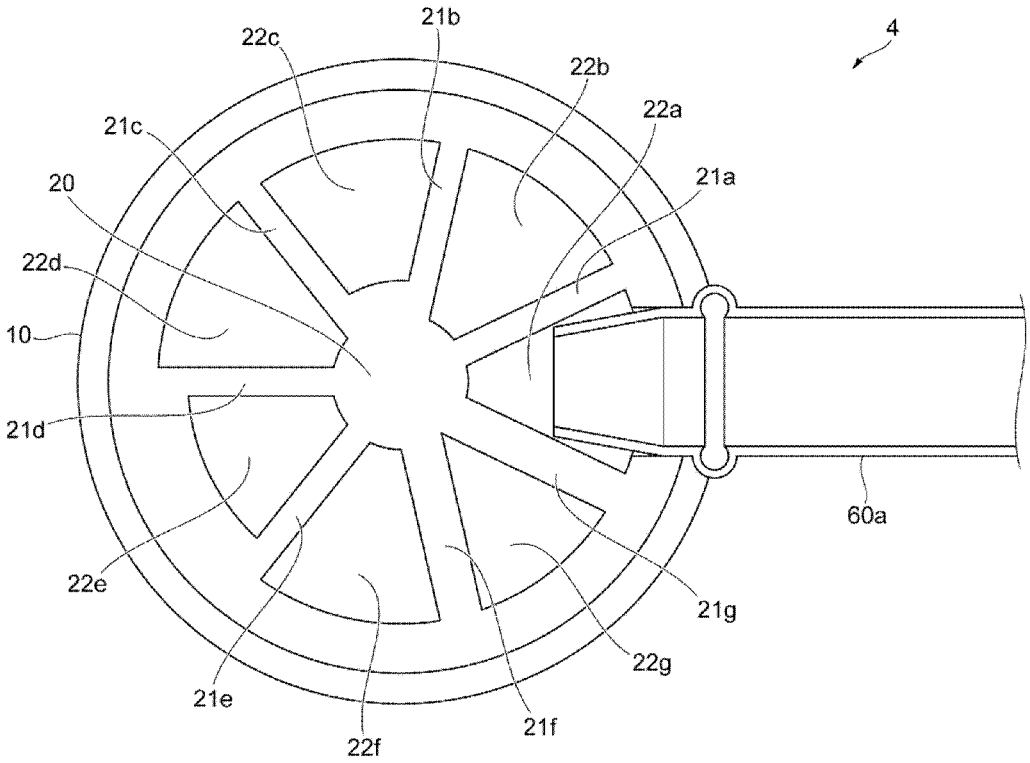
FIG. 10 illustrates an A-A cross-sectional view of a distributor, according to a fourth embodiment of the disclosure.

FIG. 10 illustrates an A-A cross-sectional view of the distributor 4 according to the fourth embodiment of the disclosure. Referring to FIG. 10, the partition plates 21*a* to 21*g* may be installed in the inner pipe 20, defining the plurality of distribution paths 22*a* to 22*g* accordingly. The branched pipe 60*a* linked and fixed to the distribution path 22*a* is inserted between the partition plates 21*a* and 21*g* that define the distribution path 22*a*. In the fourth embodiment of the disclosure, the cross-sectional area differs among the plurality of distribution paths 22. This structure may be understood as an example of a structure in which a plurality of partitions define a plurality of distribution paths so that cross-sectional areas of the plurality of distribution paths cut across a particular plane may be different. Accordingly, refrigerant flow distribution to the plurality of distribution paths 22 may be adjusted, thereby increasing heat exchange capability.

Figure 11:
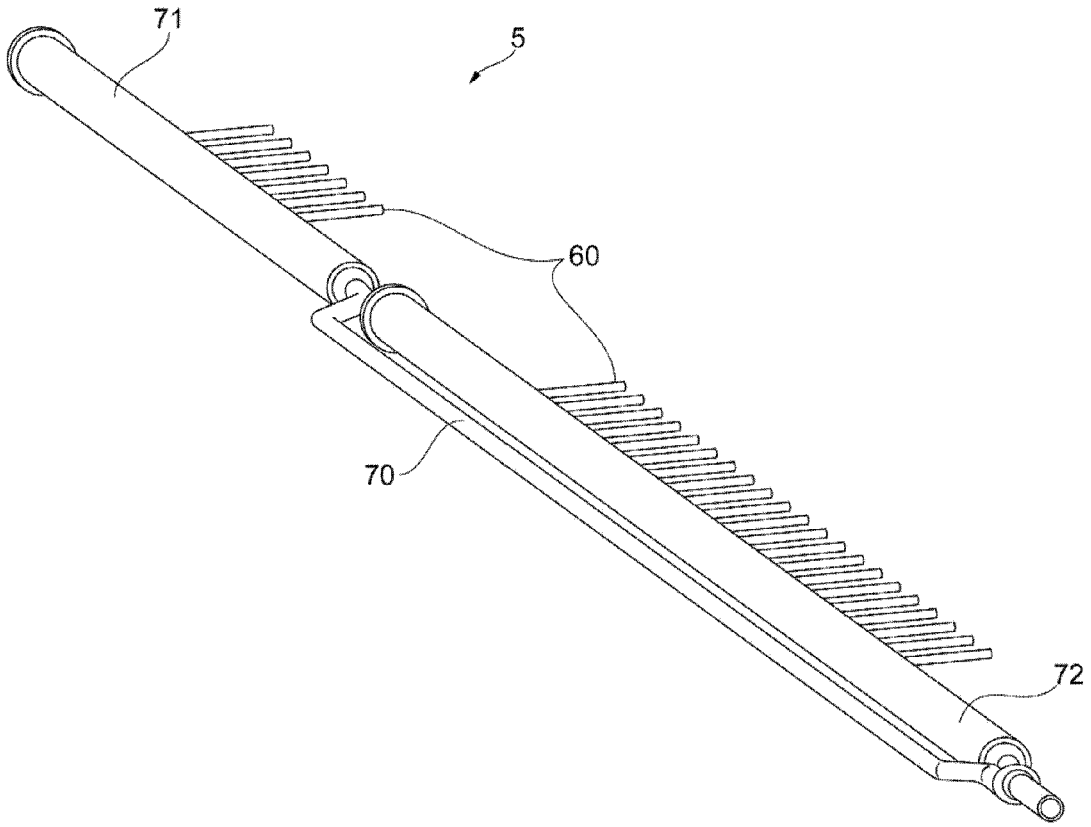
FIG. 11 illustrates a perspective view of a distributor, according to a fifth embodiment of the disclosure.

FIG. 11 illustrates a perspective view of a distributor 5, according to the fifth embodiment of the disclosure. Referring to FIG. 11, the distributor 5 is split into a first distributor 71 and a second distributor 72. The first and second distributors 71 and 72 are an example of two distributor elements. The distributor 5 may include a pipe 70 to distribute the refrigerant to the second distributor 72 right before the refrigerant flows into the first distributor 71.

An overall structure of the first and second distributors 71 and 72 is similar to that in FIG. 2 or 7. The first and second distributors 71 and 72 are also to distribute a refrigerant as an example of a fluid that passes in the first and second distributors 71 and 72. Furthermore, the first and second distributors 71 and 72 may each include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the first and second distributors 71 and 72 may each include the plurality of branched pipes 60 fixed in the refrigerant downstream and connected to refrigerant pipes of a heat exchanger.

For each of the first and second distributors 71 and 72, a plurality of partition plates 21 are installed in the inner pipe 20, defining a plurality of distribution paths 22 accordingly.

Again, in the fifth embodiment of the disclosure, the distributor 5 is split into the first and second distributors 71 and 72. Accordingly, refrigerant flow distribution into the plurality of distribution paths 22 may be adjusted, thereby increasing heat exchange capability.

Figure 12:
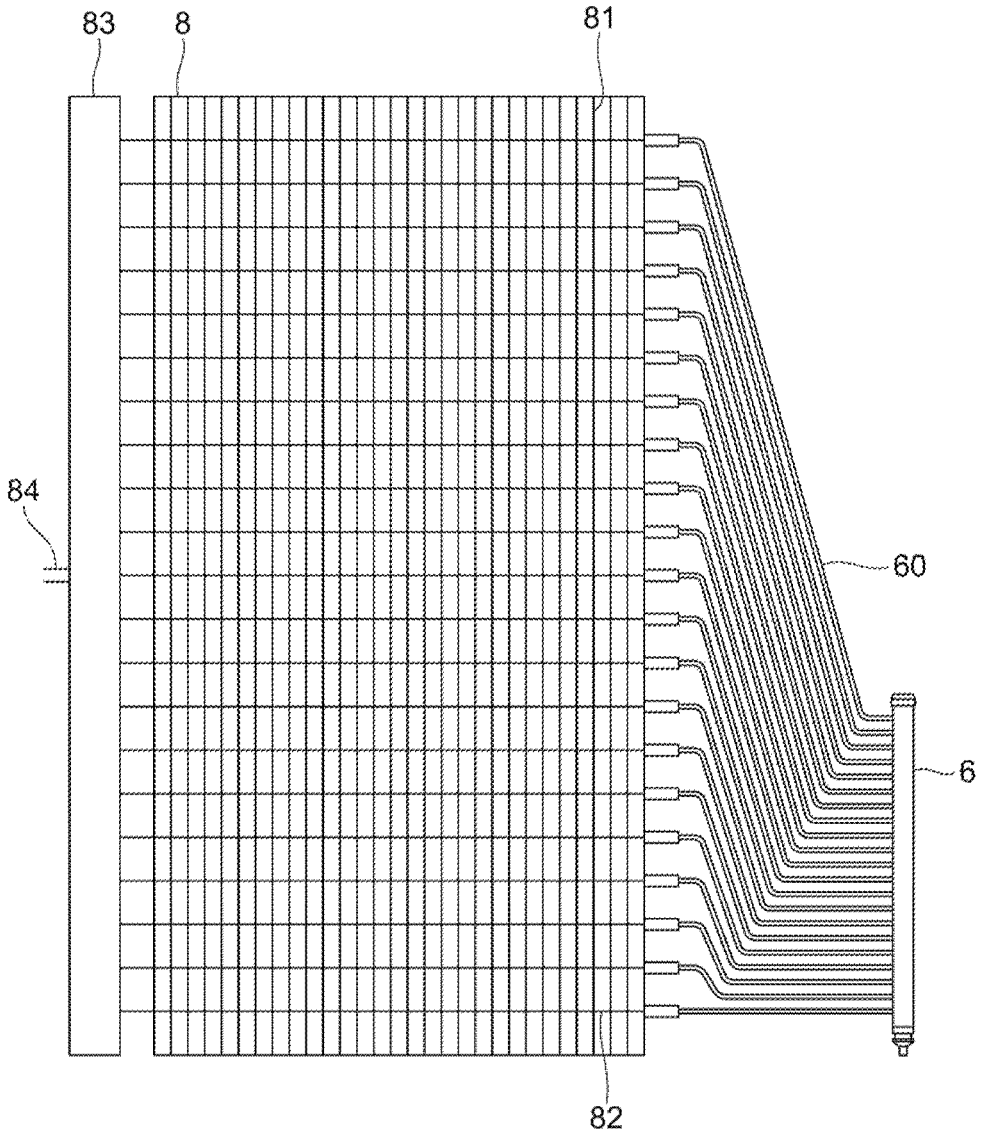
FIG. 12 illustrates an overall structure of a heat exchange unit including a distributor and a heat exchanger, according to a sixth embodiment of the disclosure.

FIG. 12 illustrates an overall structure of a heat exchange unit including a distributor 6 and a heat exchanger 8, according to a sixth embodiment of the disclosure.

An overall structure of the distributor 6 included in the heat exchange unit according to the sixth embodiment of the disclosure is similar to that in FIG. 2 or 7. The distributor 6 is also to distribute a refrigerant as an example of a fluid that passes in the distributor 6. Furthermore, the distributor 6 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 6 may include the plurality of branched pipes 60 fixed in the refrigerant downstream and connected to refrigerant pipes of the heat exchanger.

A plurality of partition plates 21 are installed in the inner pipe 20, defining a plurality of distribution paths 22 accordingly.

The heat exchanger 8 included in the heat exchange unit in the sixth embodiment of the disclosure performs heat exchange between the refrigerant as an example of a fluid distributed by the distributor 6 and air. The heat exchanger 8 may include a plurality of fins 81 vertically arranged in parallel at preset intervals, a plurality of refrigerant pipes 82 installed in parallel to pass through holes of the fins 81, a header 83 at which the refrigerant flowing from each of the plurality of refrigerant pipes 82 joins, and an external connection pipe 84 through which to exhaust the refrigerant from the header 83.

The plurality of branched pipes 60 of the distributor 6 may connect to the plurality of refrigerant pipes 82 of the heat exchanger 8 one to one.

In the sixth embodiment of the disclosure, the height of the distributor 6 is lower than that of the heat exchanger 8. With the distributor 6 having the structure as shown in FIG. 2, this is possible by densely arranging the branched pipes 60 extending in parallel from the distributor 6. Furthermore, with the distributor 6 having the structure as shown in FIG. 7, this is possible by forming a large twisted angle between the plurality of partition plates 21 and the center shaft of the inner pipe 20, which enables the branched pipes 60 extending in parallel from the distributor 6 to be densely arranged. Accordingly, refrigerant flow distribution into the plurality of distribution paths 22 may be adjusted, thereby increasing heat exchange capability.

In the meantime, in the sixth embodiment of the disclosure, the distributor 6 and the heat exchanger 8 may be compared in height because the distributor 6 and the heat exchanger 8 are installed to be long in the vertical direction, but the embodiments of the disclosure are not limited thereto. For example, any comparison may be made as long as the length across which the branched pipes 60 of the distributor 6 are arranged in parallel and the length across which the refrigerant pipes 82 of the heat exchanger 8 are arranged in parallel may be compared with each other. That is, a structure in which the height of the distributor 6 is lower than the height of the heat exchanger 8 is an example of a structure in which the length of the distributor is shorter than the length across which a plurality of fluid pipes in which a fluid distributed by a distributor of the heat exchanger flows are arranged in parallel.

An overall structure of a distributor 7 according to the seventh embodiment of the disclosure is similar to that in FIG. 2 or 7. The distributor 7 is also to distribute a refrigerant as an example of a fluid that passes in the distributor 7. Furthermore, the distributor 7 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 7 may include the plurality of branched pipes 60 fixed in the refrigerant downstream and connected to refrigerant pipes of a heat exchanger.

A plurality of partition plates 21 are installed in the inner pipe 20, defining a plurality of distribution paths 22 accordingly.

Figure 13:
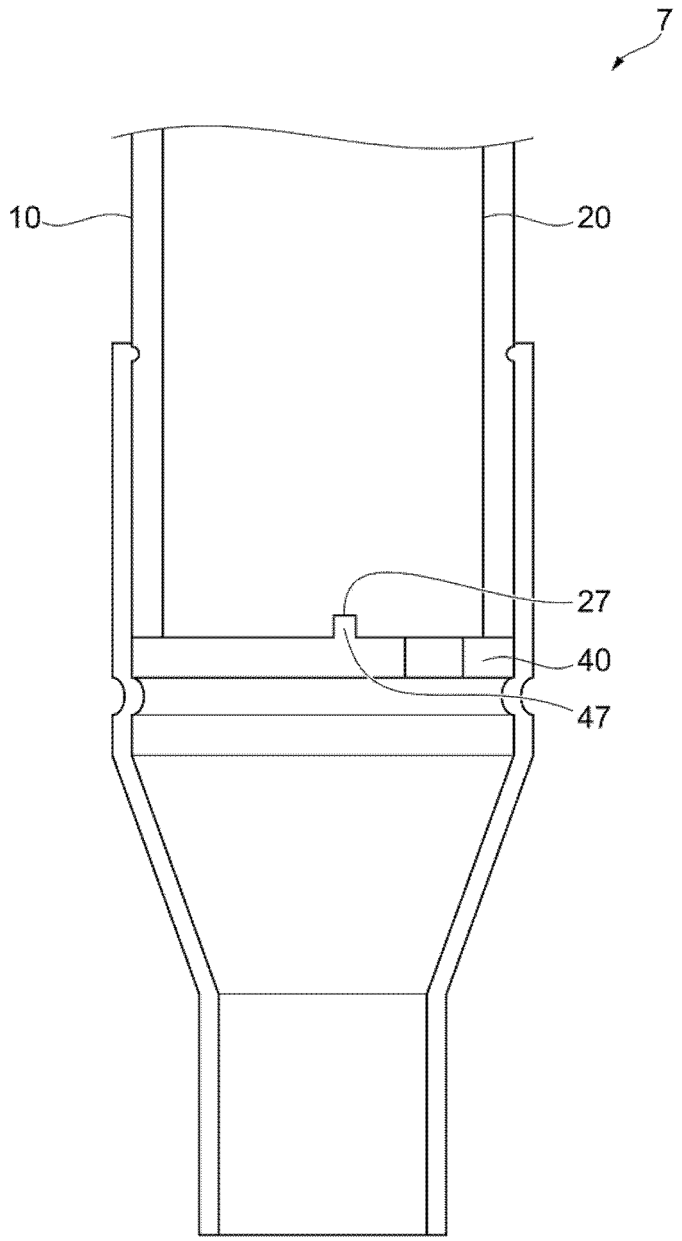
FIG. 13 illustrates a partially enlarged view of a distributor, according to a seventh embodiment of the disclosure.

FIG. 13 illustrates a partially enlarged view of the distributor 7, according to the seventh embodiment of the disclosure. The distributor 7 may also include the outer pipe 10, the inner pipe 20, and the orifice plate 40. In the seventh embodiment of the disclosure, a position fitting tool for fitting the plurality of distribution paths 22 into the plurality of orifice holes 401 may be installed. Specifically, a convex portion 47 may be formed on the orifice plate 40 and a concave portion 27 may be formed on corresponding one of the plurality of partition plates 21. By fitting the convex portion 47 into the concave portion 27, each of the plurality of orifice holes 401 fits to each of the plurality of distribution paths 22.

Accordingly, refrigerant flow distribution to the plurality of distribution paths 22 may be adjusted, thereby increasing heat exchange capability.

Figure 14:
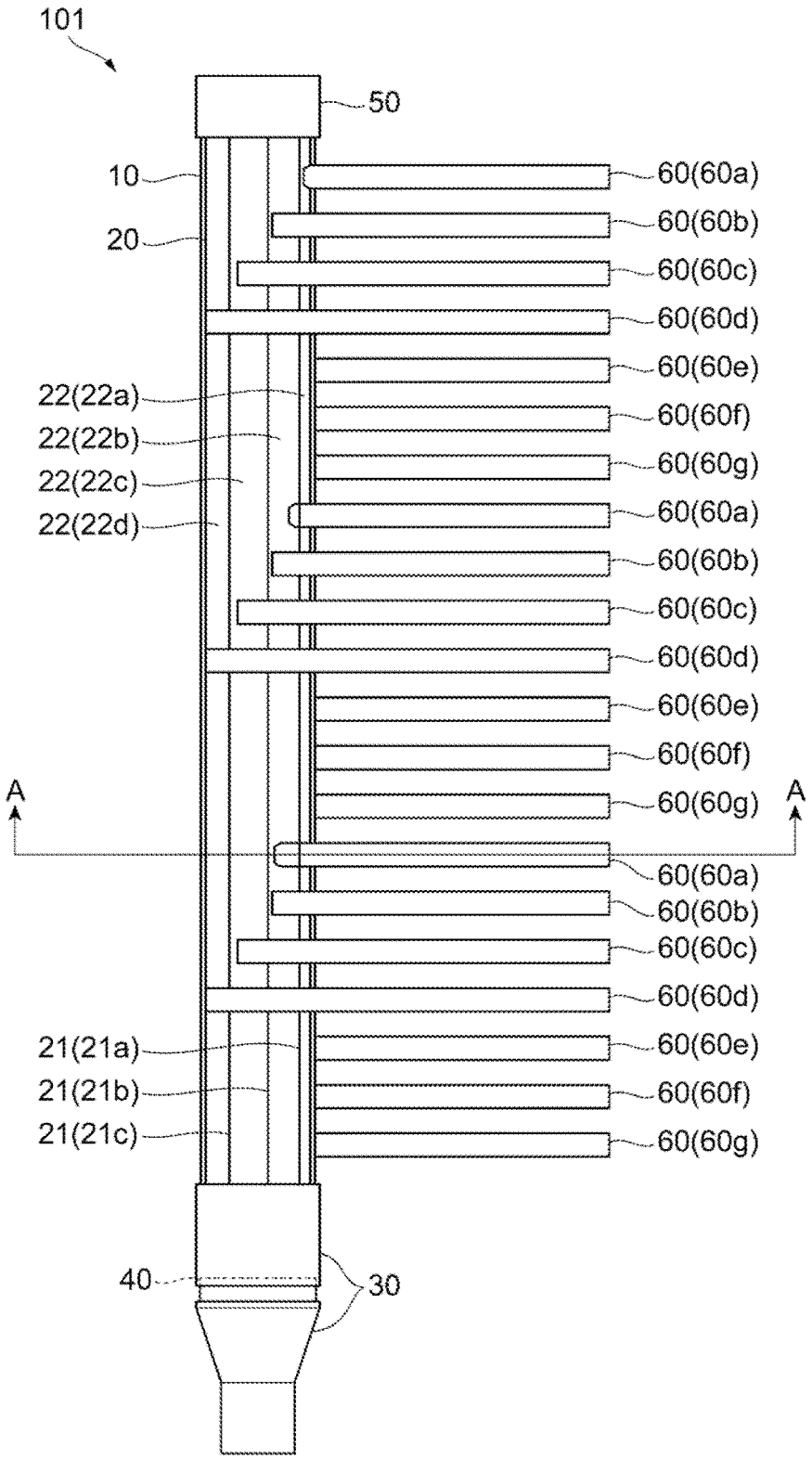
FIG. 14 illustrates an overall structure of a distributor, according to an eighth embodiment of the disclosure.

FIG. 14 illustrates an overall structure of a distributor 101, according to an eighth embodiment of the disclosure. The distributor 101 is to distribute a refrigerant as an example of a fluid that passes in the distributor 101. Furthermore, as shown in FIG. 14, the distributor 101 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped main pipe.

In FIG. 14, an internal structure of the inner pipe 20 is shown by removing the front of the outer pipe 10. As shown in FIG. 14, a plurality of partition plates 21 are installed in the inner pipe 20, defining a plurality of distribution paths 22 accordingly. In the eighth embodiment of the disclosure, the plurality of partition plates 21 are installed in parallel with the center shaft of the inner pipe 20. In FIG. 14, as viewed from the front, of the plurality of partition plates 21, partition plates 21*a* to 21*c* (ends of the partition plates 21*a* to 21*c* on the side of the outer pipe 10, in particular) are shown, and of the plurality of distribution paths 22, distribution paths 22*a* to 22*d* are shown. Although it is assumed herein that the plurality of partition plates 21 are installed in parallel with the center shaft of the inner pipe 20, they may be installed along the shaft of the inner pipe 20, in which case, the plurality of partition plates 21 are an example of a plurality of partitions installed along the shaft of the main pipe.

In the distributor 101, the outer pipe 10 and the inner pipe 20 are integrated in one unit. That is, the plurality of partition plates 21 are an example of a plurality of partitions installed integrally with the main pipe.

Furthermore, the distributor 101 may include the inlet 30 e.g., welded to the refrigerant upstream end of the outer pipe 10 to guide the refrigerant, the orifice plate 40 installed at the refrigerant upstream end of the inner pipe 20, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 14. Furthermore, in FIG. 14, the orifice plate 40 may have a plurality of orifice holes 411 (see FIG. 17) through which to allow the refrigerant to flow into the plurality of distribution paths 22. The cap 50 is to seal off all the plurality of distribution paths 22.

Moreover, the distributor 101 may include the plurality of branched pipes 60 fixed in the refrigerant downstream and connected to refrigerant pipes of a heat exchanger.

The plurality of branched pipes 60 may be linked to the plurality of distribution paths 22. FIG. 14 shows the branched pipes 60*e* to 60*g* linked to distribution paths 22*e* to 22*g*, respectively, in addition to the branched pipes 60*a* to 60*d* linked to the distribution paths 22*a* to 22*d*, respectively.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 14, in the eighth embodiment of the disclosure, the branched pipe 60*a* may extend to the right directly from the distribution path 22*a*. The branched pipes 60*b* to 60*d* may extend forward from the distribution paths 22*b* to 22*d* first and then bend and extend to the right. The branched pipes 60*e* to 60*g* may extend to the opposite side from the distribution paths 22*e* to 22*g* first and then bend and extend to the right.

There may be one set of branched pipes 60*a* to 60*g*, although in the eight embodiment of the disclosure, there may be a multiple sets of branched pipes 60*a* to 60*g* installed in parallel. The structure as in the eighth embodiment of the disclosure may be understood as an example of a structure that includes at least two branched pipes connected to one of the plurality of distribution paths.

Figure 15:
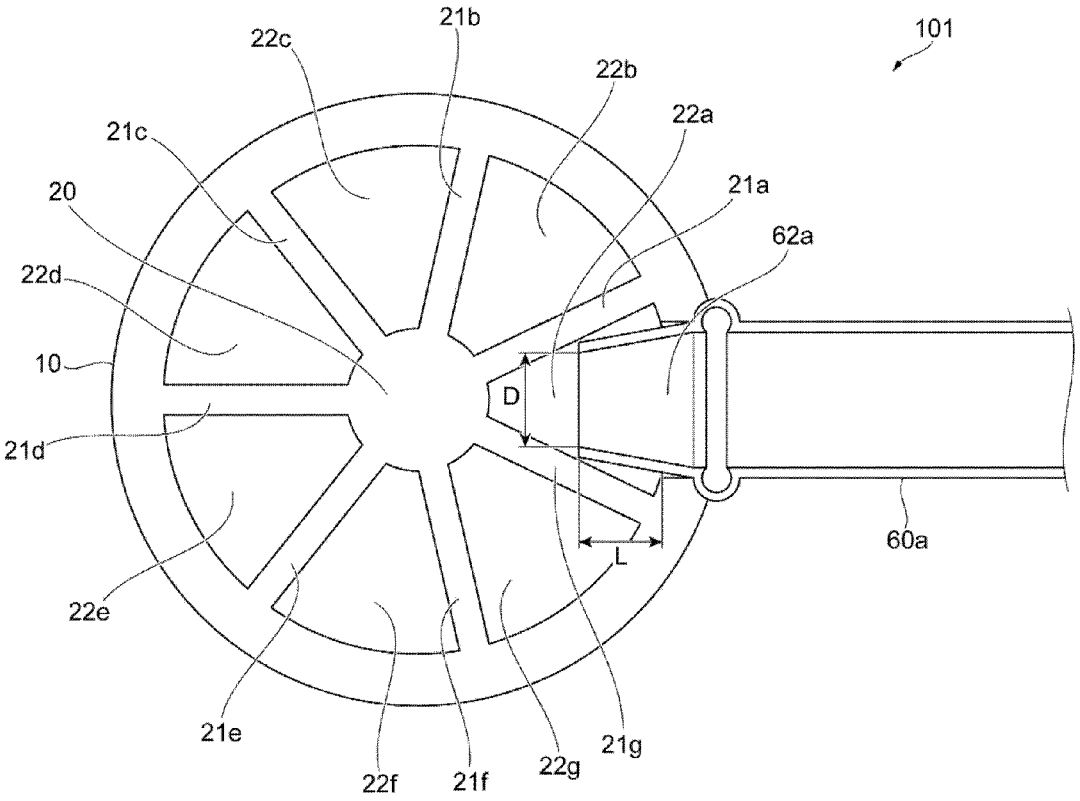
FIG. 15 illustrates an A-A cross-sectional view of the distributor of FIG. 14.

FIG. 15 illustrates an A-A cross-sectional view of the distributor 101 of FIG. 14.

Referring to FIG. 15, in the distributor 101, the outer pipe 10 and the inner pipe 20 are integrated in one unit. The partition plates 21*a* to 21*g* may be installed in the inner pipe 20, defining the plurality of distribution paths 22*a* to 22*g* accordingly. The partition plates 21 connect the outer pipe 10 and the center portion of the inner pipe 20, so that the width of the distribution path 22 between the partition plates 21 decreases as it goes from the outer side of the inner pipe 20 to the center portion. In FIG. 15, the branched pipe 60*a* linked and fixed to the distribution path 22*a* is inserted between the partition plates 21*a* and 21*g* that define the distribution path 22*a*. Even in the eighth embodiment of the disclosure, the inner diameter Di of the axial part 62*a* differs among the multiple branched pipes 60*a* (three branched pipes 60*a* in FIG. 14). Moreover, in the eighth embodiment of the disclosure, insertion length L differs among the multiple branched pipes 60*a* (three branched pipes 60*a* in FIG. 14). Although the branched pipe 60*a* linked to the distribution path 22*a* is shown because FIG. 15 is an A-A cross-sectional view of the distributor 101 of FIG. 14, what are described above in connection with the branched pipe 60*a* may be equally applied to the other branched pipes 60*b* to 60*g* linked to the distribution paths 22*a* to 22*g*.

In the meantime, although both the inner diameter Di of the axial part 62 and the insertion length L differ among the plurality of branched pipes 60 in the eighth embodiment of the disclosure, it will not be limited thereto. At last one of the inner diameter of the axial part 62 or the insertion length L may differ among the plurality of branched pipes 60.

As described above, in the eighth embodiment of the disclosure, the refrigerant flow resistance is changed in the single distribution path 22 while the outer pipe 10 and the inner pipe 20 are integrated in one unit. Accordingly, refrigerant flow distribution may be adjusted while preventing a refrigerant leak, thereby increasing heat exchange capability.

Figure 16:
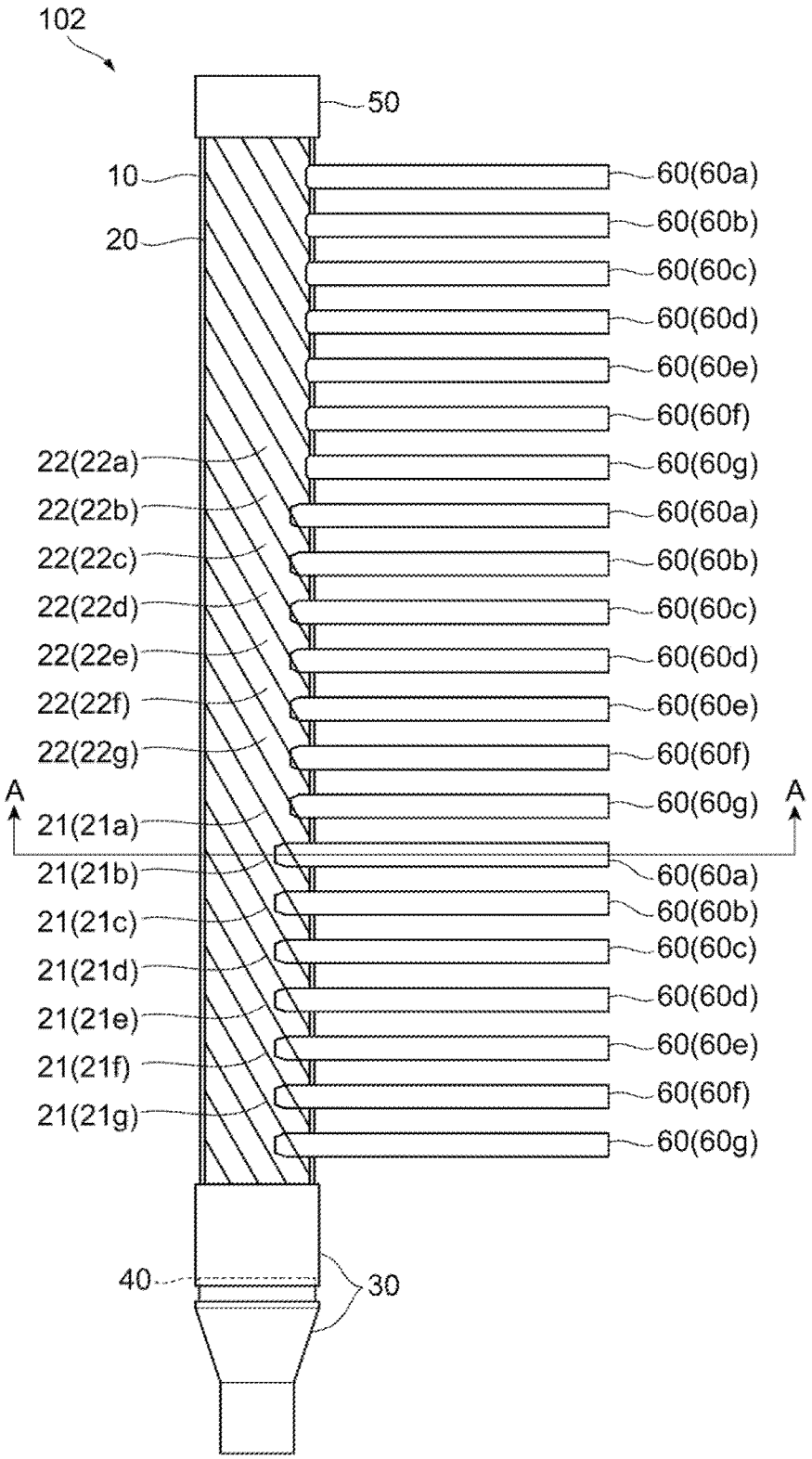
FIG. 16 illustrates an overall structure of a distributor, according to a ninth embodiment of the disclosure.

FIG. 16 illustrates an overall structure of a distributor 102, according to a ninth embodiment of the disclosure. The distributor 102 is also to distribute a refrigerant as an example of a fluid that passes in the distributor 102. Furthermore, as shown in FIG. 14, the distributor 102 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped main pipe.

In FIG. 16, an internal structure of the inner pipe 20 is shown by removing the front of the outer pipe 10. As shown in FIG. 16, a plurality of partition plates 21 are installed in the inner pipe 20, defining a plurality of distribution paths 22 accordingly. In the ninth embodiment of the disclosure, the plurality of partition plates 21 are installed at a twisted angle to the center shaft of the inner pipe 20. In FIG. 16, of the plurality of partition plates 21, partition plates 21*a* to 21*g* (ends of the partition plates 21*a* to 21*g* on the side of the outer pipe 10, in particular) are shown, and of the plurality of distribution paths 22, distribution paths 22*a* to 22*g* are shown. Although it is assumed herein that the plurality of partition plates 21 are installed at a twisted angle to the center shaft of the inner pipe 20, they may also be said as being installed along the shaft of the inner pipe 20, in which case, the plurality of partition plates 21 are an example of a plurality of partitions installed along the shaft of the main pipe.

In the distributor 102, the outer pipe 10 and the inner pipe 20 are integrated in one unit. That is, the plurality of partition plates 21 are an example of a plurality of partitions installed integrally with the main pipe.

Furthermore, the distributor 102 may include the inlet 30 e.g., welded to the refrigerant upstream end of the outer pipe 10 to guide the refrigerant, the orifice plate 40 installed at the refrigerant upstream end of the inner pipe 20, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 14. Furthermore, in FIG. 16, the orifice plate 40 may have a plurality of orifice holes 411 (see FIG. 17) through which to allow the refrigerant to flow into the plurality of distribution paths 22. The cap 50 is to seal off all the plurality of distribution paths 22.

Moreover, the distributor 102 may include the plurality of branched pipes 60 fixed in the refrigerant downstream and connected to refrigerant pipes of a heat exchanger.

The plurality of branched pipes 60 may be linked to the plurality of distribution paths 22. FIG. 16 shows the branched pipes 60*a* to 60*g* linked to the distribution paths 22*a* to 22*g*, as the plurality of branched pipes 60.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 16, in the ninth embodiment of the disclosure, the distribution paths 22*a* to 22*g* are defined to have a certain twisted angle to the center shaft of the inner pipe 20, so all the distribution paths 22*a* to 22*g* may turn around the inner pipe 20 once and pass through the right side of the inner pipe 20. Accordingly, the branched pipes 60*a* to 60*g* may all extend to the right by being linked to the portions at which the distribution paths 22*a* to 22*g* pass through the right side of the inner pipe 20. This structure may be understood as an example of a structure in which a plurality of partitions are installed to make a certain twisted angle to the shaft of the main pipe.

There may be one set of branched pipes 60*a* to 60*g*, although in the ninth embodiment of the disclosure, there may be a multiple sets of branched pipes 60*a* to 60*g* installed in parallel. The structure as in the ninth embodiment of the disclosure may be understood as an example of a structure that includes at least two branched pipes connected to one of the plurality of distribution paths.

The A-A cross-sectional view of the distributor 102 of FIG. 16 is similar to what is shown in FIG. 15. Even in the ninth embodiment of the disclosure, the inner diameter Di of the axial part 62*a* differs among the multiple branched pipes 60*a* (three branched pipes 60*a* in FIG. 16). Moreover, in the ninth embodiment of the disclosure, insertion length L differs among the multiple branched pipes 60*a* (three branched pipes 60*a* in FIG. 16). The same is true of the branched pipes 60*b* to 60*g* linked to the distribution paths 22*b* to 22*g*.

In the meantime, although both the inner diameter Di of the axial part 62 and the insertion length L differ among the plurality of branched pipes 60 in the ninth embodiment of the disclosure, it will not be limited thereto. At last one of the inner diameter of the axial part 62 or the insertion length L may differ among the plurality of branched pipes 60.

As described above, in the ninth embodiment of the disclosure, the refrigerant flow resistance is changed in the single distribution path 22 while the outer pipe 10 and the inner pipe 20 are integrated in one unit. Accordingly, refrigerant flow distribution may be adjusted while preventing a refrigerant leak, thereby increasing heat exchange capability.

An overall structure of a distributor 103 according to the tenth embodiment of the disclosure is similar to that in FIG. 14 or 16. The distributor 103 is also to distribute a refrigerant as an example of a fluid that passes in the distributor 103. Furthermore, the distributor 103 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped main pipe.

A plurality of partition plates 21 are installed in the inner pipe 20, defining a plurality of distribution paths 22 accordingly.

In the distributor 103, the outer pipe 10 and the inner pipe 20 are integrated in one unit. That is, the plurality of partition plates 21 are an example of a plurality of partitions installed integrally with the main pipe.

Furthermore, the distributor 103 may include the inlet 30 e.g., welded to the refrigerant upstream end of the outer pipe 10 to guide the refrigerant, the orifice plate 40 installed at the refrigerant upstream end of the inner pipe 20, and the cap 50 e.g., welded to an end opposite to the refrigerant upstream end of the outer pipe 10.

Moreover, the distributor 103 may include the plurality of branched pipes 60 fixed in the refrigerant downstream and connected to refrigerant pipes of a heat exchanger.

Figure 17:
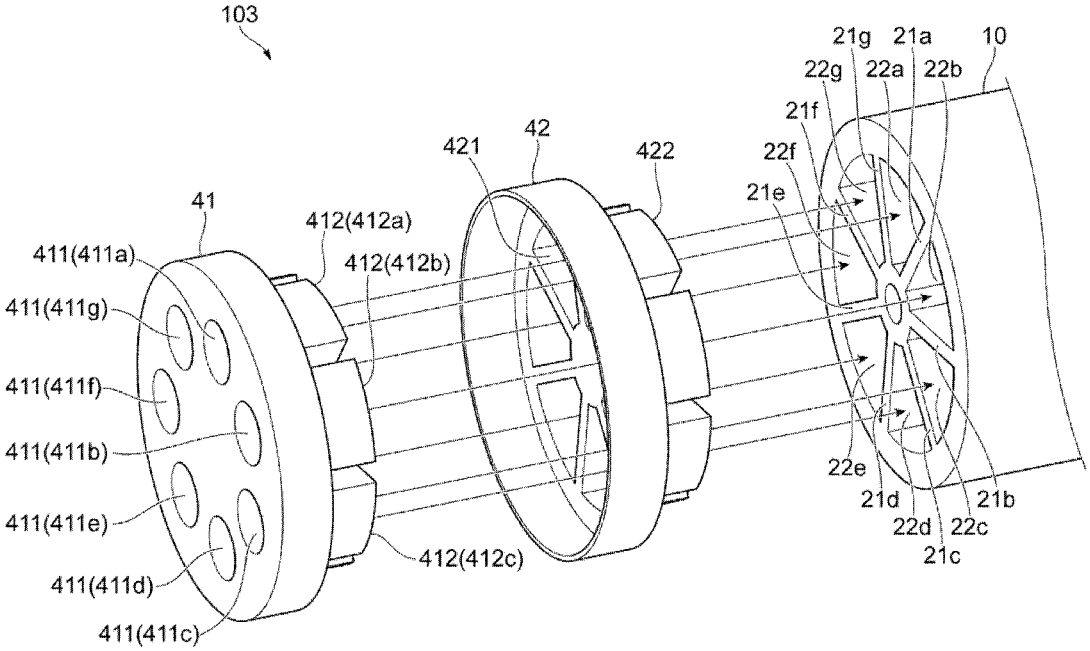
FIG. 17 illustrates a partially enlarged view of a distributor, according to a tenth embodiment of the disclosure.

FIG. 17 illustrates a partially enlarged view of the distributor 103, according to the tenth embodiment of the disclosure. Referring to FIG. 17, in the distributor 103, the orifice plate 40 corresponds to a projected orifice plate 41, and a brazing sheet 42 is installed between the projected orifice plate 41 and the outer pipe 10.

The projected orifice plate 41 may have a plurality of orifice holes 411 through which to allow the refrigerant to flow into the plurality of distribution paths 22. Specifically, in FIG. 17, the plurality of orifice holes 411 may include orifice holes 411*a* to 411*g* through which to allow the refrigerant to flow into the plurality of distribution paths 22*a* to 22*g*, respectively. The projected orifice plate 41 may also include a plurality of projections 412 to be inserted to the plurality of distribution paths 22. Specifically, in FIG. 17, the plurality of projections 412 may include projections 412*a* to 412*g* to be inserted to the distribution paths 22*a* to 22*g*, respectively. Each of the plurality of projections 412 may have a through hole in the center, through which to allow the refrigerant flowing from the corresponding orifice hole 411 to flow into the corresponding distribution path 22.

The brazing sheet 42 serves to bond the plurality of projections 412 of the projected orifice plate 41 tightly to the plurality of distribution paths 22 of the outer pipe 10 when the plurality of projections 412 of the projected orifice plate 41 are inserted to the plurality of distribution paths 22 of the outer pipe 10. The brazing sheet 42 may include a plurality of sheet holes 421 to which the plurality of projections 412 are inserted. The brazing sheet 42 may also include a plurality of projections 422 to be inserted to the plurality of distribution paths 22. Each of the plurality of projections 422 may have a through hole in the center, through which to allow the refrigerant flowing from the corresponding sheet hole 421 to flow into the corresponding distribution path 22.

However, it is not imperative to install the brazing sheet 42. Instead of installing the brazing sheet 42, brazing sheet may be applied to a bonding portion between the projected orifice plate 41 and the outer pipe 10 when the plurality of projections 412 of the projected orifice plate 41 are inserted to the plurality of distribution paths 22 of the outer pipe 10.

As described above, in the tenth embodiment of the disclosure, the orifice plate 40 is provided as the projected orifice plate 41 with projections 412 to be inserted to the plurality of distribution paths 22. Accordingly, refrigerant flow distribution may be adjusted while preventing a refrigerant leak from the bonding portion between the orifice plate 40 and the outer pipe 10, thereby increasing heat exchange capability.

An overall structure of a distributor 104 according to the eleventh embodiment of the disclosure is similar to that in FIG. 14 or 16. The distributor 104 is also to distribute a refrigerant as an example of a fluid that passes in the distributor 104. Furthermore, the distributor 104 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped main pipe.

A plurality of partition plates 21 are installed in the inner pipe 20, defining a plurality of distribution paths 22 accordingly.

In the distributor 104, the outer pipe 10 and the inner pipe 20 are integrated in one unit. That is, the plurality of partition plates 21 are an example of a plurality of partitions installed integrally with the main pipe.

Furthermore, the distributor 104 may include the inlet 30 e.g., welded to the refrigerant upstream end of the outer pipe 10 to guide the refrigerant, the orifice plate 40 installed at the refrigerant upstream end of the inner pipe 20, and the cap 50 e.g., welded to an end opposite to the refrigerant upstream end of the outer pipe 10.

Moreover, the distributor 104 may include the plurality of branched pipes 60 fixed in the refrigerant downstream and connected to refrigerant pipes of a heat exchanger.

Figure 18:
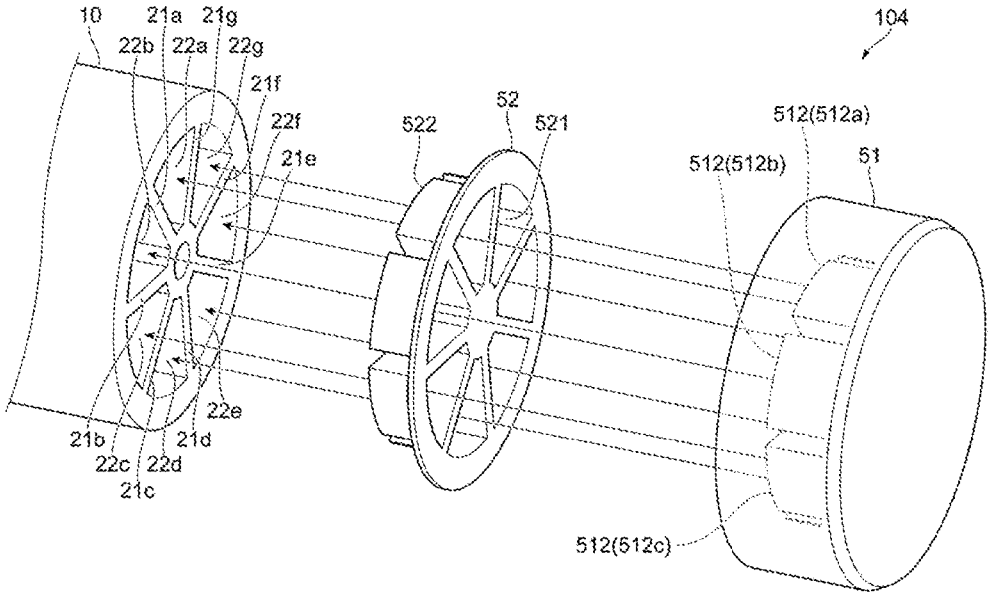
FIG. 18 illustrates a partially enlarged view of a distributor, according to an eleventh embodiment of the disclosure.

FIG. 18 illustrates a partially enlarged view of the distributor 104, according to the eleventh embodiment of the disclosure. Referring to FIG. 18, in the distributor 104, the cap 50 corresponds to a projected cap 51, and a brazing sheet 52 is installed between the projected cap 51 and the outer pipe 10.

The projected cap 51 may also include a plurality of projections 512 to be inserted to the plurality of distribution paths 22. Specifically, in FIG. 18, the plurality of projections 512 may include projections 512*a* to 512*g* to be inserted to the distribution paths 22*a* to 22*g*, respectively. The plurality of projections 512 are hidden in the cap 50 and not visible at an angle as in FIG. 18, but they are represented in dashed lines as if seen through the cap 50.

The brazing sheet 52 serves to bond the plurality of projections 512 of the projected cap 51 tightly to the plurality of distribution paths 22 of the outer pipe 10 when the plurality of projections 512 of the projected cap 51 are inserted to the plurality of distribution paths 22 of the outer pipe 10. The brazing sheet 52 may include a plurality of sheet holes 521 to which the plurality of projections 512 are inserted. The brazing sheet 52 may also include a plurality of projections 522 to be inserted to the plurality of distribution paths 22.

However, it is not imperative to install the brazing sheet 52. Instead of installing the brazing sheet 52, brazing sheet may be applied to a bonding portion between the projected cap 51 and the outer pipe 10 when the plurality of projections 512 of the projected cap 51 are inserted to the plurality of distribution paths 22 of the outer pipe 10.

As described above, in the eleventh embodiment of the disclosure, the cap 50 may be provided as the projected cap 51 with the projections 512 to be inserted to the plurality of distribution paths 22. Accordingly, refrigerant flow distribution may be adjusted while preventing a refrigerant leak from the bonding portion between the cap 50 and the outer pipe 10, thereby increasing heat exchange capability.

An overall structure of a distributor 105 according to the twelfth embodiment of the disclosure is similar to that in FIG. 14 or 16. The distributor 105 is also to distribute a refrigerant as an example of a fluid that passes in the distributor 105. Furthermore, the distributor 105 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped main pipe.

A plurality of partition plates 21 are installed in the inner pipe 20, defining a plurality of distribution paths 22 accordingly.

In the distributor 105, the outer pipe 10 and the inner pipe 20 are integrated in one unit. That is, the plurality of partition plates 21 are an example of a plurality of partitions installed integrally with the main pipe.

Furthermore, the distributor 105 may include the inlet 30 e.g., welded to the refrigerant upstream end of the outer pipe 10 to guide the refrigerant, the orifice plate 40 installed at the refrigerant upstream end of the inner pipe 20, and the cap 50 e.g., welded to an end opposite to the refrigerant upstream end of the outer pipe 10.

Moreover, the distributor 105 may include the plurality of branched pipes 60 fixed in the refrigerant downstream and connected to refrigerant pipes of a heat exchanger.

Figure 19:
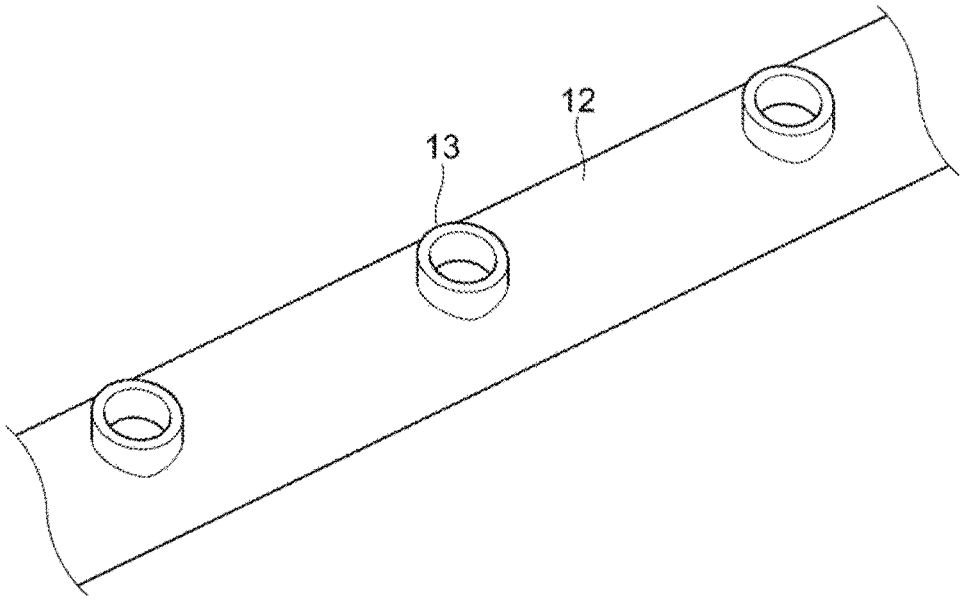
FIG. 19 illustrates a perspective view of an exterior cover, according to a twelfth embodiment of the present disclosure.

FIG. 19 illustrates a perspective view of an exterior cover 12, according to the twelfth embodiment of the present disclosure. Referring to FIG. 19, the exterior cover 12 may include a plurality of burring holes 13. The plurality of branched pipes 60 may be connected to the exterior cover 12 by being inserted to the plurality of burring holes 13, respectively, The exterior cover 12 as used herein is an example of a cover mounted on the outer circumference of the main pipe.

Figure 20:
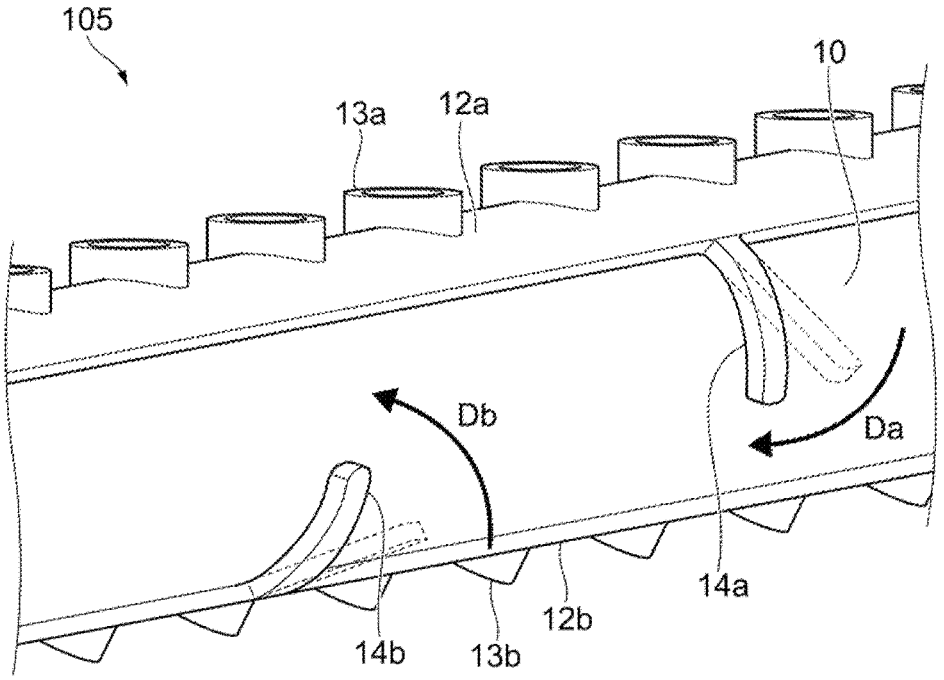
FIG. 20 illustrates a partially enlarged view of a distributor, according to the twelfth embodiment of the disclosure.

FIG. 20 illustrates a partially enlarged view of the distributor 105, according to the twelfth embodiment of the disclosure. For the distributor 105 having the same structure as in FIG. 16, the branched pipes 60 is connected from one direction, so that the single exterior cover 12 may be attached to the outer pipe 10. However, it is assumed herein that in the distributor 105 having the same structure as in FIG. 14, the branched pipes 60 are connected from multiple directions. Hence, the outer pipe 10 as shown in FIG. 20 has an exterior cover 12*a* with burring holes 13*a* and an exterior cover 12*b* with burring holes 13*b* attached to the outer pipe 10 to face different directions. In this case, the exterior cover 12*a* may be fixed to the outer pipe 10 by bending a catch 14*a* at its end in a direction as indicated by an arrow Da, as shown in FIG. 20. The exterior cover 12*b* may be fixed to the outer pipe 10 by bending a catch 14*b* at its end in a direction as indicated by an arrow Db. Alternatively, instead of the way the exterior covers 12*a* and 12*b* are fixed to the outer pipe 10 by bending the catches 14*a* and 14*b* at their ends, the exterior covers 12*a* and 12*b* may be fixed to the outer pipe 10 by wrapping a steel line around the outer pipe 10 and exterior covers 12*a* and 12*b* altogether while attaching the exterior covers 12*a* and 12*b* to the outer pipe 10.

Although there are two exterior covers 12 attached to the outer pipe 10 in FIG. 20, three or more exterior covers 12 may be attached to the outer pipe 10.

Furthermore, although the burring holes 13 are formed at the exterior cover 12 to attach the exterior cover 12 to the outer pipe 10, the disclosure is not limited thereto. For example, the burring holes 13 may be formed right at the outer pipe 10.

As described above, in the twelfth embodiment of the disclosure, the plurality of branched pipes 60 are inserted to the plurality of burring holes 13. Accordingly, refrigerant flow distribution may be adjusted while preventing a refrigerant leak from the bonding portion between the branched pipes 60 and the outer pipe 10, thereby increasing heat exchange capability.

Figure 21:
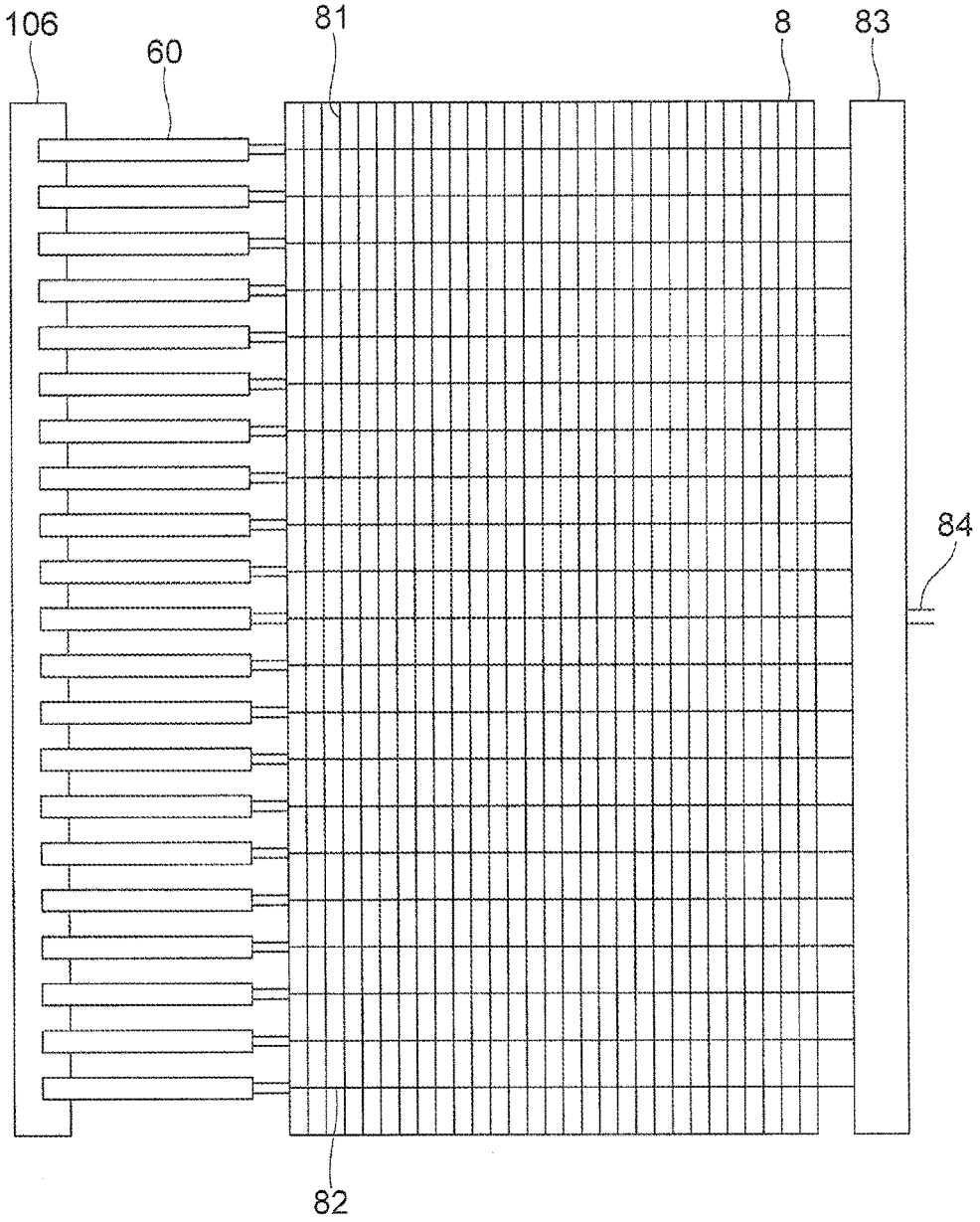
FIG. 21 illustrates an overall structure of a heat exchange unit including a distributor and a heat exchanger, according to a thirteenth embodiment of the disclosure.

FIG. 21 illustrates an overall structure of a heat exchange unit including a distributor 106 and the heat exchanger 8, according to a thirteenth embodiment of the disclosure.

An overall structure of the distributor 106 included in the heat exchange unit according to the thirteenth embodiment of the disclosure is similar to that in FIG. 14 or 16. The distributor 106 is also to distribute a refrigerant as an example of a fluid that passes in the distributor 106. Furthermore, the distributor 106 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped main pipe.

A plurality of partition plates 21 are installed in the inner pipe 20, defining a plurality of distribution paths 22 accordingly.

In the distributor 106, the outer pipe 10 and the inner pipe 20 are integrated in one unit. That is, the plurality of partition plates 21 are an example of a plurality of partitions installed integrally with the main pipe.

Furthermore, the distributor 106 may include the inlet 30 e.g., welded to the refrigerant upstream end of the outer pipe 10 to guide the refrigerant, the orifice plate 40 installed at the refrigerant upstream end of the inner pipe 20, and the cap 50 e.g., welded to an end opposite to the refrigerant upstream end of the outer pipe 10.

Moreover, the distributor 106 may include the plurality of branched pipes 60 fixed in the refrigerant downstream and connected to refrigerant pipes 82 of the heat exchanger 8 as will be described later.

The heat exchanger 8 included in the heat exchange unit in the thirteenth embodiment of the disclosure performs heat exchange between the refrigerant as an example of a fluid distributed by the distributor 106 and air. The heat exchanger 8 may include a plurality of fins 81 vertically arranged in parallel at preset intervals, a plurality of refrigerant pipes 82 as an example of a plurality of fluid pipes installed in parallel to pass through holes of the fins 81, a header 83 at which the refrigerant flowing from each of the plurality of refrigerant pipes 82 joins, and an external connection pipe 84 through which to exhaust the refrigerant from the header 83.

The plurality of branched pipes 60 of the distributor 106 may connect to the plurality of refrigerant pipes 82 of the heat exchanger 8 one to one.

As described above, in the thirteenth embodiment of the disclosure, the refrigerant flow resistance is changed in the single distribution path 22 while the outer pipe 10 and the inner pipe 20 are integrated in one unit. Accordingly, refrigerant flow distribution may be adjusted while preventing a refrigerant leak, thereby increasing heat exchange capability.

Figure 22:
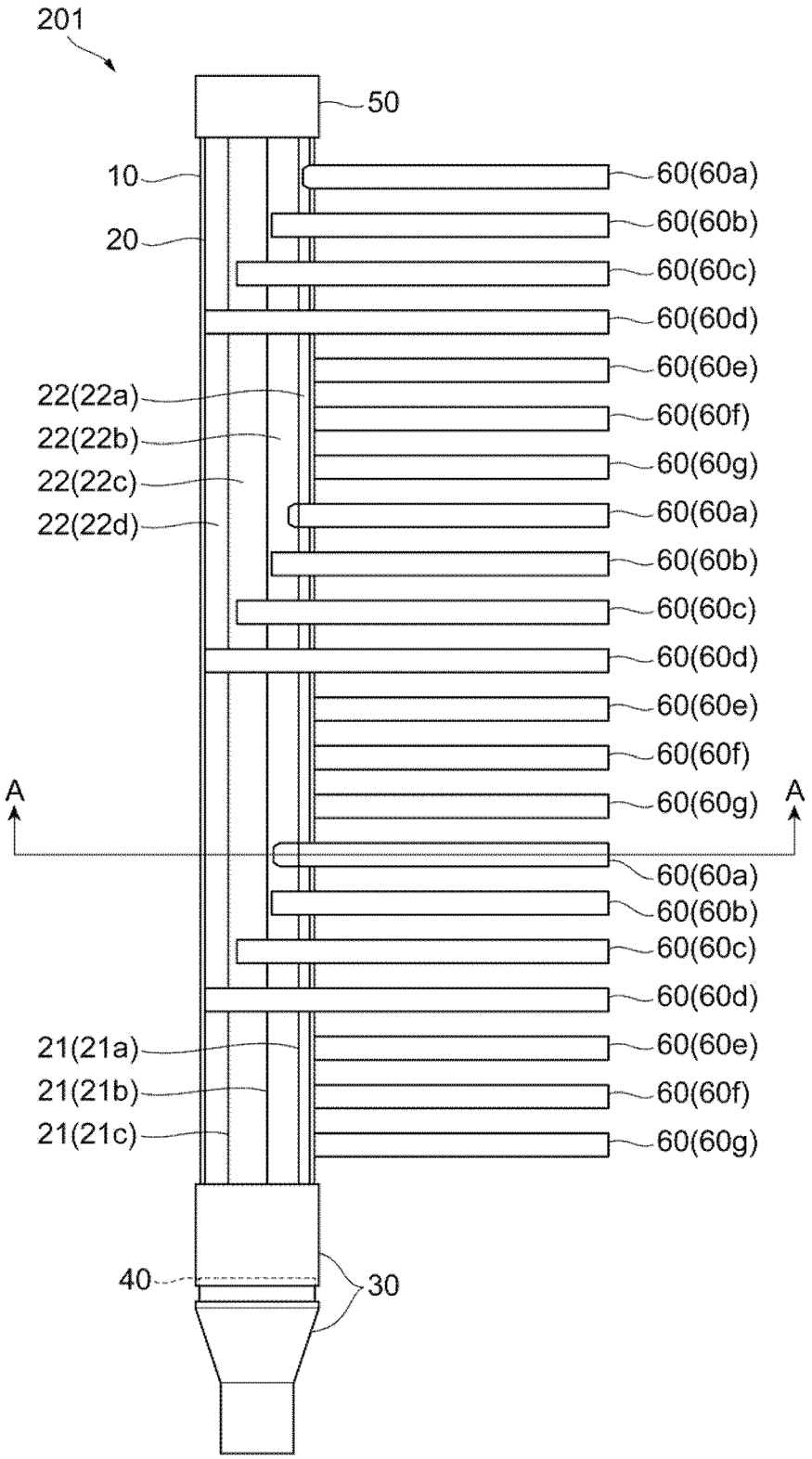
FIG. 22 illustrates an overall structure of a distributor, according to a fourteenth embodiment of the disclosure.

FIG. 22 illustrates an overall structure of a distributor 201, according to a fourteenth embodiment of the disclosure. The distributor 201 is to distribute a refrigerant as an example of a fluid that passes in the distributor 201. Furthermore, as shown in FIG. 22, the distributor 201 may include an outer pipe 10 in the form of a cylinder, an inner pipe 20 installed in the outer pipe 10, and an orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Furthermore, the distributor 201 may include the inlet 30 e.g., welded to the refrigerant upstream end of the outer pipe 10 to guide the refrigerant, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 22. Moreover, the distributor 201 may include a plurality of branched pipes 60 fixed in the refrigerant downstream and connected to refrigerant pipes of a heat exchanger.

In FIG. 22, an internal structure of the inner pipe 20 is shown by removing the front of the outer pipe 10. As shown in FIG. 22, a plurality of partition plates 21 are installed in the inner pipe 20, defining a plurality of distribution paths 22 accordingly. In the fourteenth embodiment of the disclosure, the plurality of partition plates 21 are installed in parallel with the center shaft of the inner pipe 20. In FIG. 22, as viewed from the front, of the plurality of partition plates 21, partition plates 21*a* to 21*c* (ends of the partition plates 21*a* to 21*c* on the side of the outer pipe 10, in particular) are shown, and of the plurality of distribution paths 22, distribution paths 22*a* to 22*d* are shown. Although it is assumed herein that the plurality of partition plates 21 are installed in parallel with the center shaft of the inner pipe 20, they may be installed along the shaft of the inner pipe 20, in which case, the plurality of partition plates 21 are an example of a plurality of partitions installed along the shaft of the main pipe.

Furthermore, in FIG. 22, the orifice plate 40 may have a plurality of orifice holes through which to allow the refrigerant to flow into the plurality of distribution paths 22.

The plurality of branched pipes 60 may be linked to the plurality of distribution paths 22. FIG. 22 shows the branched pipes 60*e* to 60*g* linked to distribution paths 22*e* to 22*g*, respectively, in addition to the branched pipes 60*a* to 60*d* linked to the distribution paths 22*a* to 22*d*, respectively.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 22, in the fourteenth embodiment of the disclosure, the branched pipe 60*a* may extend to the right directly from the distribution path 22*a*. The branched pipes 60*b* to 60*d* may extend forward from the distribution paths 22*b* to 22*d* first and then bend and extend to the right. The branched pipes 60*e* to 60*g* may extend to the opposite side from the distribution paths 22*e* to 22*g* first and then bend and extend to the right.

There may be one set of branched pipes 60*a* to 60*g*, although in the fourteenth embodiment of the disclosure, there may be a multiple sets of branched pipes 60*a* to 60*g* installed in parallel. The structure as in the fourteenth embodiment of the disclosure may be understood as an example of a structure that includes at least two branched pipes connected to one of the plurality of distribution paths.

Figure 23:
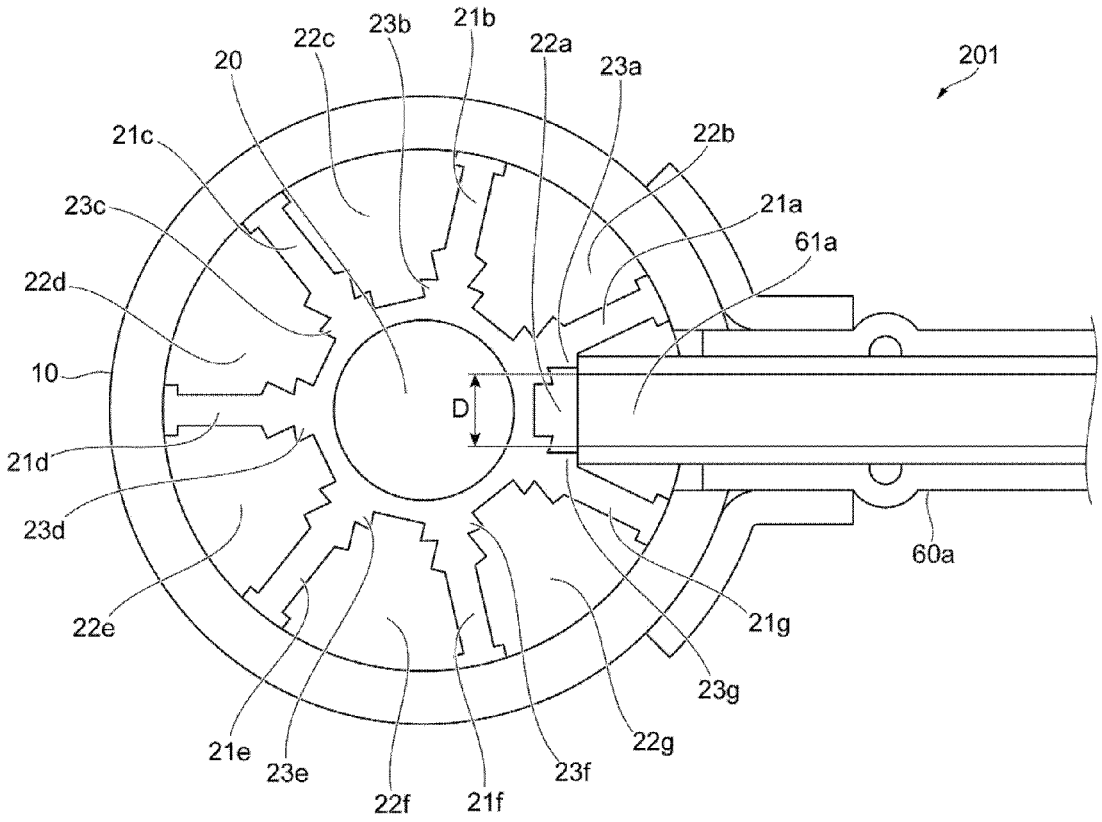
FIG. 23 illustrates an A-A cross-sectional view of the distributor of FIG. 22.
Figure 24:
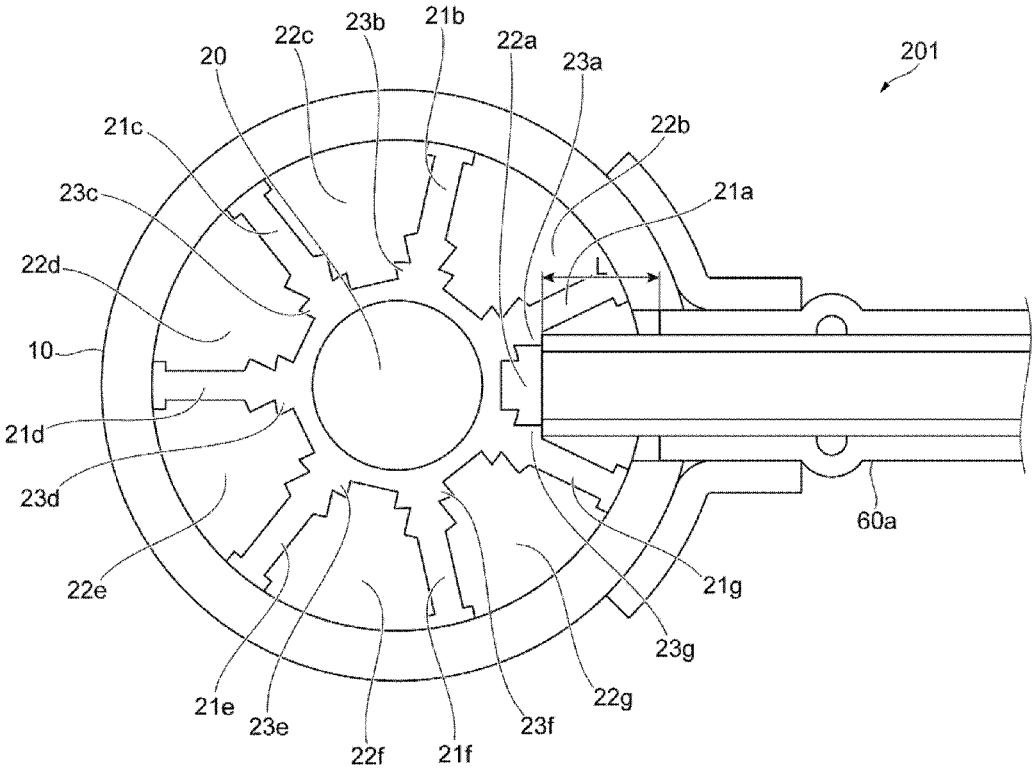
FIG. 24 illustrates an A-A cross-sectional view of the distributor of FIG. 22.
Figure 25:
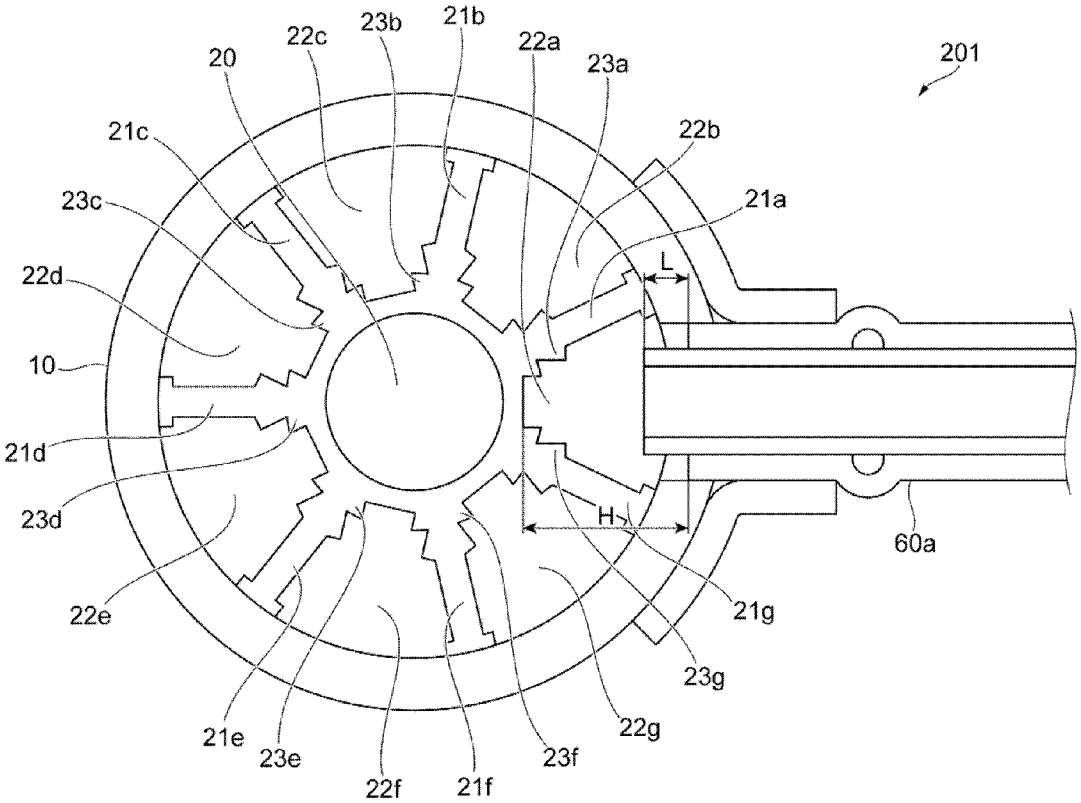
FIG. 25 illustrates an A-A cross-sectional view of the distributor of FIG. 22.

FIGS. 23 to 25 are cross-sectional views along line A-A of the distributor 201 of FIG. 22. Referring to FIGS. 23 to 25, the partition plates 21*a* to 21*g* may be installed in the inner pipe 20, defining the plurality of distribution paths 22*a* to 22*g* accordingly. The partition plates 21 connect the outer pipe 10 and the center portion of the inner pipe 20, so that the width of the distribution path 22 between the partition plates 21 decreases as it goes from the outer side of the inner pipe 20 to the center portion. Step parts 23*a* to 23*g* may be formed on each of the partition plates 21*a* to 21*g*. Furthermore, the branched pipe 60*a* linked and fixed to the distribution path 22*a* is inserted between the partition plates 21*a* and 21*g* that define the distribution path 22*a* and supported by the step parts 23*a* and 23*g*. In this case, assuming that the partition plates 21*a* and 21*g* are an example of two neighboring partitions, the distribution path 22*a* corresponds to a distribution path defined by the two partitions, the branched pipe 60*a* corresponds to a branched pipe connected to a distribution path among the plurality of branched pipes, and the step parts 23*a* and 23*g* corresponds to at least one step part that supports the branched pipe.

In FIGS. 23 to 25, the step parts 23*a* to 23*g* each include two steps without being limited thereto. For example, the step parts 23*a* to 23*g* may each include one step or three or more steps. For example, when the step parts 23*a* and 23*g* each includes two or more steps, the branched pipe 60*a* may be put in until reaching the second or outer steps of the step parts 23*a* and 23*g* from the center portion of the inner pipe 20. This makes a step on the side of the refrigerant inlet of the branched pipe 60, which enables changing of fluid resistance of the refrigerant and adjustment of refrigerant flow distribution.

Furthermore, in the fourteenth embodiment of the disclosure, among the plurality of branched pipes 60*a* (three branched pipes 60*a* in FIG. 22), differing the position of steps of the step parts 23*a* and 23*g* supporting the branched pipe 60*a* may differ the inner diameter D of the axial part 62*a*. This structure is an example of a structure in which the inner diameter of the axial part differs as the branched pipe is supported by different ones of the plurality of steps.

Furthermore, in the fourteenth embodiment of the disclosure, among the plurality of branched pipes 60*a* (three branched pipes 60*a* in FIG. 22), differing the position of steps of the step parts 23*a* and 23*g* to support the branched pipe 60*a* may differ the insertion length L of the branched pipe 60*a* as illustrated in FIG. 24. This structure is an example of a structure in which the insertion length to the distribution path differs as the branched pipe is supported by different ones of the plurality of steps.

Furthermore, in the fourteenth embodiment of the disclosure, as illustrated in FIG. 25, the insertion length L of the branched pipe 60*a* may be set to be less than half of depth H of the distribution path 22*a*. In this case, the step parts 23*a* to 23*g* may include steps at positions further outside the half of the depth H of the distribution paths 22*a* to 22*g* to support the branched pipe 60*a*.

Figure 26:
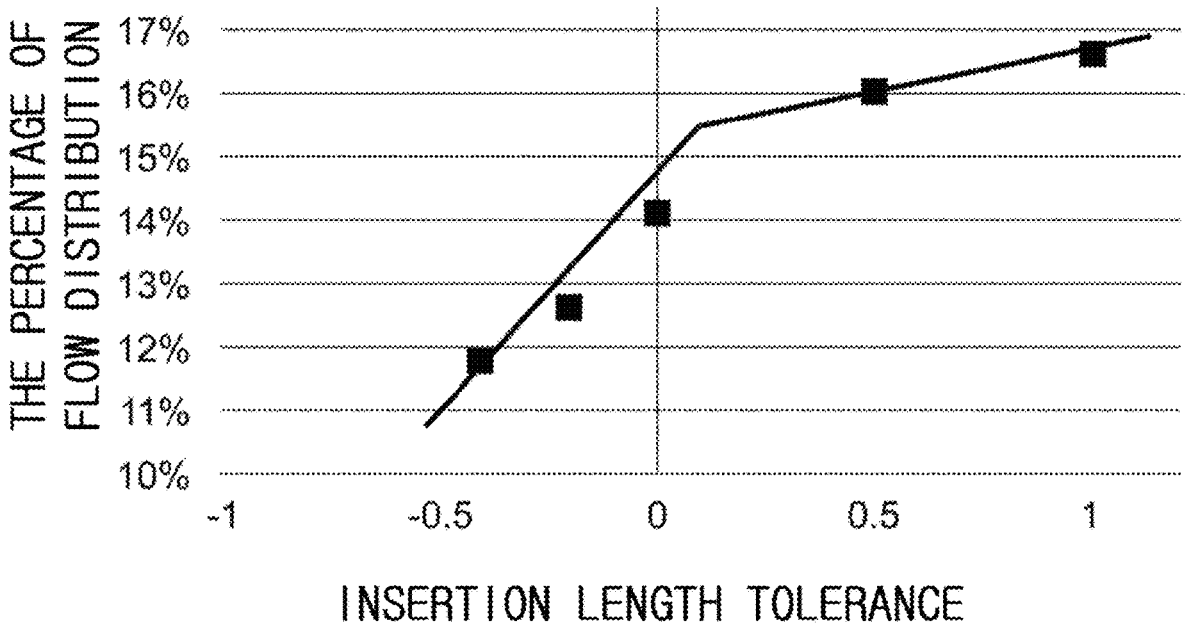
FIG. 26 illustrates a graph representing a reason why it is desirable to have insertion length of a branched pipe be less than half the depth of a distribution path.

FIG. 26 illustrates a graph representing a reason why it is desirable to have the insertion length L of a branched pipe 60 be less than half the depth H of the distribution path 22. In this graph, the horizontal axis represents insertion length tolerance. The insertion length tolerance represents positive errors toward shorter insertion length L and negative errors toward longer insertion length L based on the half of the depth H. It may be seen from the graph that when the insertion length L is long, the percentage of flow distribution rapidly changes for the deviation of the insertion length tolerance, and that when the insertion length L is short, the percentage of flow distribution is slowly changed and stable for the deviation of the insertion length tolerance. Hence, it is desirable to have the insertion length L of the branched pipe 60 be less than half the depth H of the distribution path 22.

The structure herein is an example of a structure of having the insertion length to the distribution path be less than half the depth of the distribution path by supporting the branched pipe by particular steps at shallow positions not deeper than half the depth of the distribution path. In this case, the particular steps may correspond to the steps further outside the half of the depth H of the distribution paths 22*a* to 22*b*.

Although the branched pipe 60*a* linked to the distribution path 22*a* is shown because FIGS. 23 to 25 are A-A cross-sectional views of the distributor 201 of FIG. 22, what are described above in connection with the branched pipe 60*a* may be equally applied to the other branched pipes 60*b* to 60*g* linked to the distribution paths 22*a* to 22*g*.

As described above, in the fourteenth embodiment of the disclosure, the inner diameter D of the axial part of the branched pipes 60 or the insertion length L of the branched pipes 60 differs among the plurality of branched pipes 60, or the insertion length L of the branched pipes 60 may be set to be less than half the depth H of the distribution path 22. Accordingly, refrigerant flow distribution may be adjusted, thereby increasing heat exchange capability.

Figure 27:
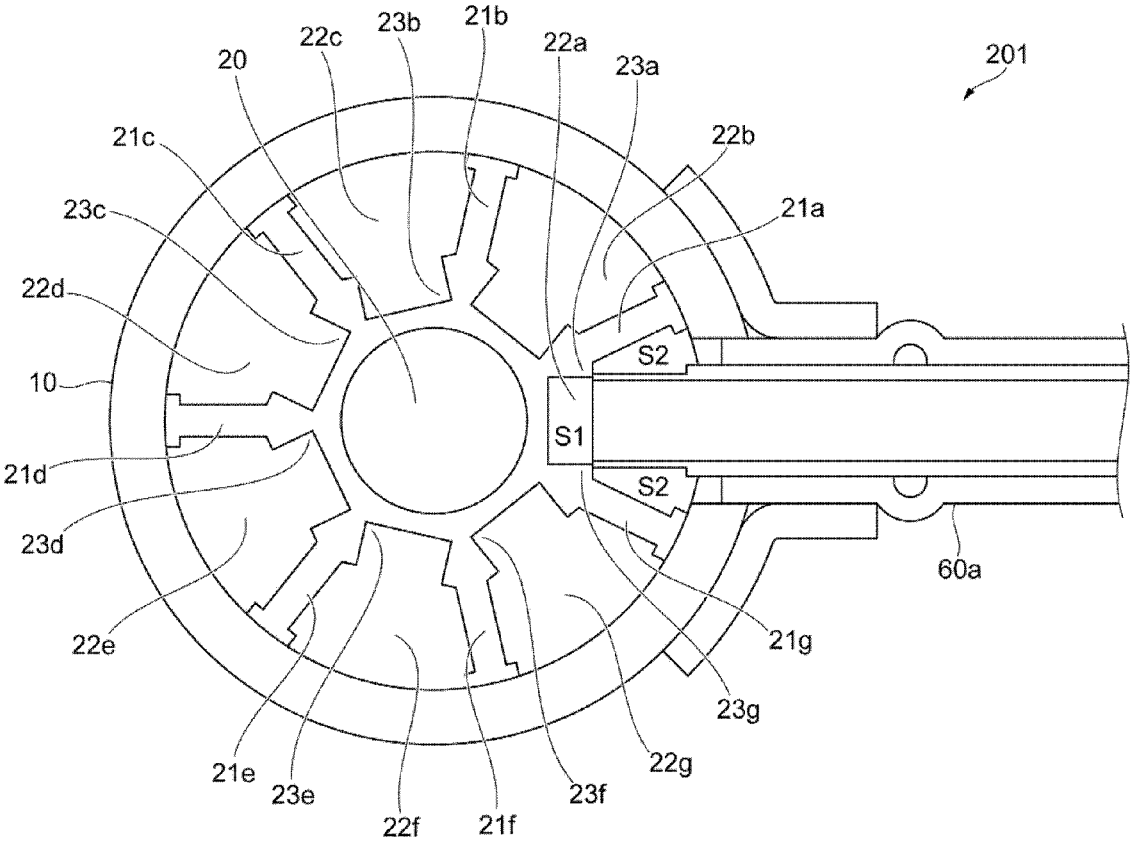
FIG. 27 illustrates an A-A cross-sectional view the distributor of FIG. 22.

FIG. 27 illustrates an A-A cross-sectional view of the distributor 201 of FIG. 22. Referring to FIG. 27, the partition plates 21*a* to 21*g* may be installed in the inner pipe 20, defining the plurality of distribution paths 22*a* to 22*g* accordingly. The partition plates 21 connect the outer pipe 10 and the center portion of the inner pipe 20, so that the width of the distribution path 22 between the partition plates 21 decreases as it goes from the outer side of the inner pipe 20 to the center portion. Step parts 23*a* to 23*g* may be formed on each of the partition plates 21*a* to 21*g*. Furthermore, the branched pipe 60*a* linked and fixed to the distribution path 22*a* is inserted between the partition plates 21*a* and 21*g* that define the distribution path 22*a* and supported by the step parts 23*a* and 23*g*. In this case, assuming that the partition plates 21*a* and 21*g* are an example of two neighboring partitions, the distribution path 22*a* corresponds to a distribution path defined by the two partitions, the branched pipe 60*a* corresponds to a branched pipe connected to a distribution path among the plurality of branched pipes, and the step parts 23*a* and 23*g* corresponds to at least one step part that supports the branched pipe.

In FIG. 27, the step parts 23*a* to 23*g* each include a step without being limited thereto. For example, the step parts 23*a* to 23*g* may each include two or more steps.

In the fourteenth embodiment of the disclosure, a refrigerant inflow area 51 at the front end of the branched pipe 60*a* that occupies a portion further inside than the steps of the step parts 23*a* and 23*g* supporting the branched pipe 60*a* may be different from a refrigerant passing area S2 around the branched pipe 60*a* that occupies a portion further outside than the steps supporting the branched pipe 60*a*. As described above, changes in ratio between the refrigerant inflow area 51 at the front end of the branched pipe 60*a* and the refrigerant passing area S2 around the branched pipe 60*a* may enable adjustment of the refrigerant flow distribution, thereby increasing the heat exchange capability.

Although the branched pipe 60*a* linked to the distribution path 22*a* is shown because FIG. 27 is an A-A cross-sectional view of the distributor 201 of FIG. 22, what are described above in connection with the branched pipe 60*a* may be equally applied to the other branched pipes 60*b* to 60*g* linked to the distribution paths 22*a* to 22*g*.

Figure 28:
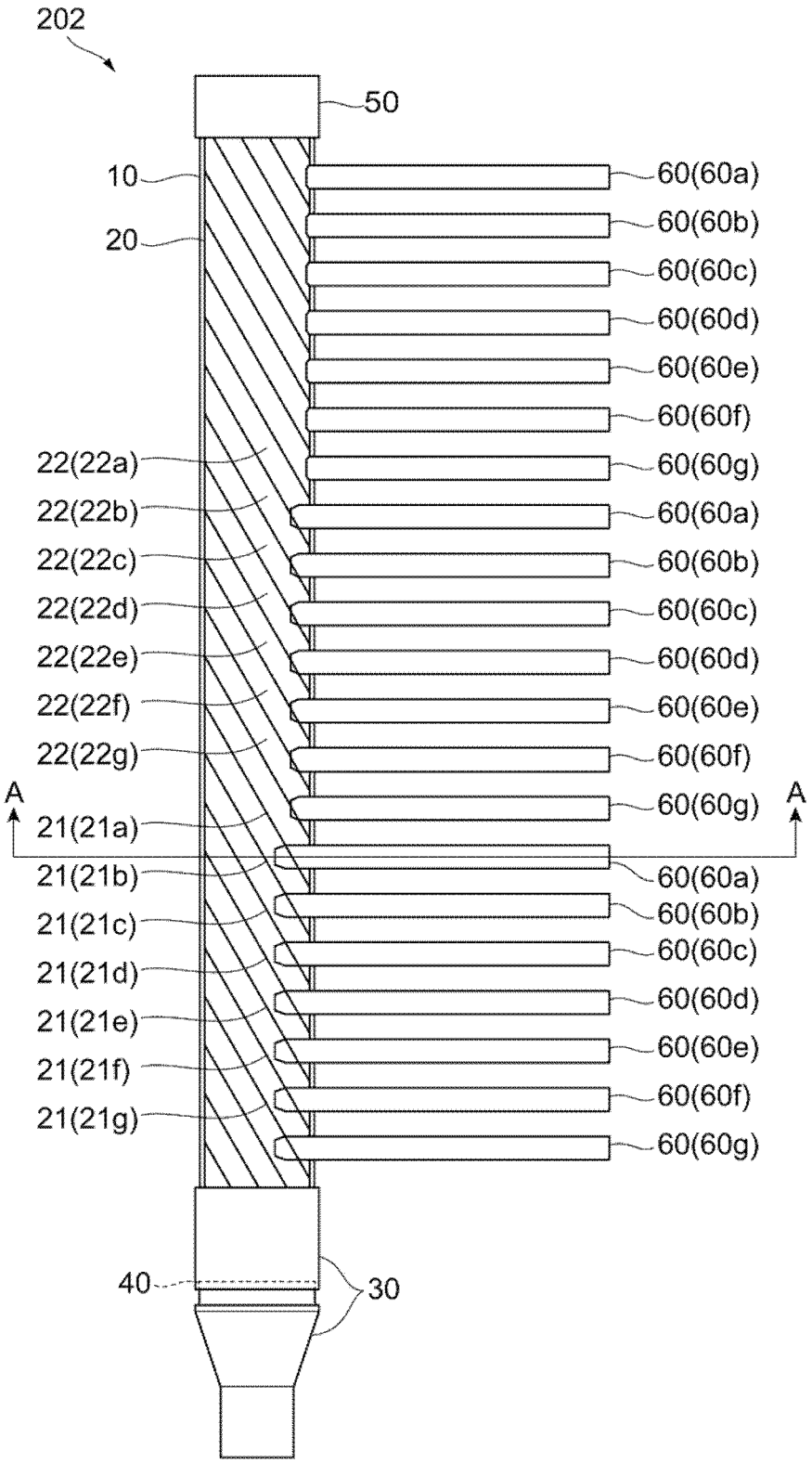
FIG. 28 illustrates an overall structure of a distributor, according to a fifteenth embodiment of the disclosure.

FIG. 28 illustrates an overall structure of a distributor 202, according to a fifteenth embodiment of the disclosure. The distributor 202 is also to distribute a refrigerant as an example of a fluid that passes in the distributor 202. Furthermore, as shown in FIG. 28, the distributor 202 may include an outer pipe 10 in the form of a cylinder, an inner pipe 20 installed in the outer pipe 10, and an orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Furthermore, the distributor 202 may include the inlet 30 e.g., welded to the refrigerant upstream end of the outer pipe 10 to guide the refrigerant, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 22. Moreover, the distributor 202 may include a plurality of branched pipes 60 fixed in the refrigerant downstream and connected to refrigerant pipes of a heat exchanger.

In FIG. 28, an internal structure of the inner pipe 20 is shown by removing the front of the outer pipe 10. As shown in FIG. 22, a plurality of partition plates 21 are installed in the inner pipe 20, defining a plurality of distribution paths 22 accordingly. In the fifteenth embodiment of the disclosure, the plurality of partition plates 21 are installed at a twisted angle to the center shaft of the inner pipe 20. In FIG. 28, of the plurality of partition plates 21, partition plates 21*a* to 21*g* (ends of the partition plates 21*a* to 21*g* on the side of the outer pipe 10, in particular) are shown, and of the plurality of distribution paths 22, distribution paths 22*a* to 22*g* are shown. Although it is assumed herein that the plurality of partition plates 21 are installed at a twisted angle to the center shaft of the inner pipe 20, they may also be said as being installed along the shaft of the inner pipe 20, in which case, the plurality of partition plates 21 are an example of a plurality of partitions installed along the shaft of the main pipe.

Furthermore, in FIG. 28, the orifice plate 40 may have a plurality of orifice holes through which to allow the refrigerant to flow into the plurality of distribution paths 22.

The plurality of branched pipes 60 may be linked to the plurality of distribution paths 22. In FIG. 28, the branched pipes 60*a* to 60*g* linked to the distribution paths 22*a* to 22*g* are shown as the plurality of branched pipes 60.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 28, in the fifteenth embodiment of the disclosure, the distribution paths 22*a* to 22*g* are defined to have a certain twisted angle to the center shaft of the inner pipe 20, so all the distribution paths 22*a* to 22*g* may turn around the inner pipe 20 once and pass through the right side of the inner pipe 20. Accordingly, the branched pipes 60*a* to 60*g* may all extend to the right by being linked to the portions at which the distribution paths 22*a* to 22*g* pass through the right side of the inner pipe 20. This structure may be understood as an example of a structure in which a plurality of partitions are installed to make a certain twisted angle to the shaft of the main pipe.

There may be one set of branched pipes 60*a* to 60*g*, although in the fifteenth embodiment of the disclosure, there may be a multiple sets of branched pipes 60*a* to 60*g* installed in parallel. The structure as in the fifteenth embodiment of the disclosure may be understood as an example of a structure that includes at least two branched pipes connected to one of the plurality of distribution paths.

The A-A cross-sectional view of the distributor 202 of FIG. 28 is similar to what is shown in FIGS. 23 to 25. Furthermore, in the fifteenth embodiment of the disclosure, among the plurality of branched pipes 60*a* (three branched pipes 60*a* in FIG. 28), differing the position of steps of the step parts 23*a* and 23*g* supporting the branched pipe 60*a* may differ the inner diameter D of the vena contract 62*a*. This structure is an example of a structure in which the inner diameter of the axial part differs as the branched pipe is supported by different ones of the plurality of steps. Furthermore, in the fifteenth embodiment of the disclosure, among the plurality of branched pipes 60*a* (three branched pipes 60*a* in FIG. 28), differing the position of steps of the step parts 23*a* and 23*g* supporting the branched pipe 60*a* may differ the insertion length L of the branched pipe 60*a*. This structure is an example of a structure in which the insertion length to the distribution path differs as the branched pipe is supported by different ones of the plurality of steps. Furthermore, in the fifteenth embodiment of the disclosure, the insertion length L of the branched pipe 60*a* may be set to be less than half of the depth H of the distribution path 22*a*. The structure herein is an example of a structure of having the insertion length to the distribution path be less than half of the depth of the distribution path by supporting the branched pipe by particular steps at shallow positions not deeper than half the depth of the distribution path. The same is true of the branched pipes 60*b* to 60*g* linked to the distribution paths 22*b* to 22*g*.

As described above, in the fifteenth embodiment of the disclosure, the inner diameter D of the axial part of the branched pipes 60 or the insertion length L of the branched pipes 60 differs among the plurality of branched pipes 60, or the insertion length L of the branched pipes 60 may be set to be less than half the depth H of the distribution path 22. Accordingly, refrigerant flow distribution may be adjusted, thereby increasing heat exchange capability.

The A-A cross-sectional view of the distributor 202 of FIG. 28 is similar to what is shown in FIG. 27. In the fifteenth embodiment of the disclosure, a refrigerant inflow area S1 at the front end of the branched pipe 60*a* that occupies a portion further inside than the steps of the step parts 23*a* and 23*g* supporting the branched pipe 60*a* may be different from a refrigerant passing area S2 around the branched pipe 60*a* that occupies a portion further outside than the steps supporting the branched pipe 60*a*. As described above, changes in ratio between the refrigerant inflow area S1 at the front end of the branched pipe 60*a* and the refrigerant passing area S2 around the branched pipe 60*a* may enable adjustment of the refrigerant flow distribution, thereby increasing the heat exchange capability. The same is true of the branched pipes 60*b* to 60*g* linked to the distribution paths 22*b* to 22*g*.

An overall structure of a distributor 203 according to the sixteenth embodiment of the disclosure is similar to that in FIG. 22 or 28. The distributor 203 is also to distribute a refrigerant as an example of a fluid that passes in the distributor 203. Furthermore, the distributor 203 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 203 may include a plurality of branched pipes 60 fixed in the refrigerant downstream and connected to refrigerant pipes of a heat exchanger.

A plurality of partition plates 21 are installed in the inner pipe 20, defining a plurality of distribution paths 22 accordingly. The inner pipe 20 is an example of a member that includes a plurality of partitions.

Figure 29:
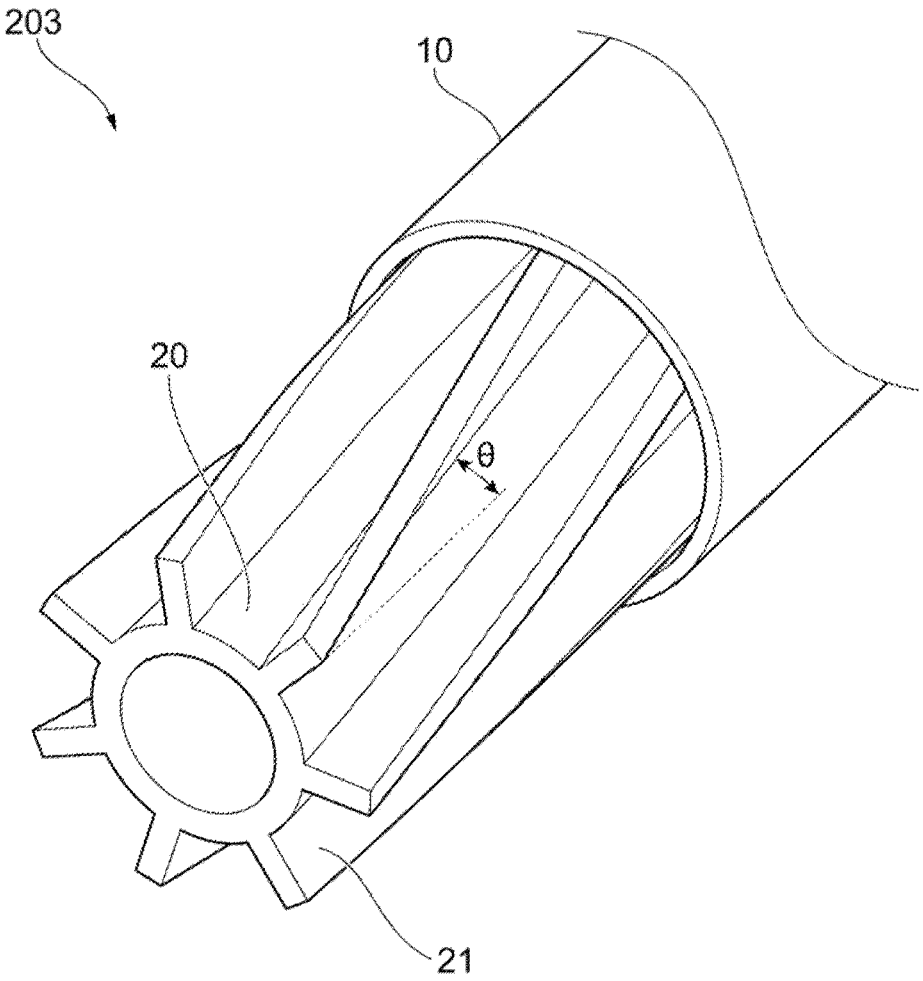
FIG. 29 illustrates a partially enlarged view of a distributor, according to a sixteenth embodiment of the disclosure.

FIG. 29 illustrates a partially enlarged view of the distributor 203, according to the sixteenth embodiment of the disclosure. The distributor 203 having the structure as in FIG. 28 is taken as an example herein. In the sixteenth embodiment of the disclosure, the distributor 203 may be manufactured by joining the outer pipe 10 and the inner pipe 20 by shrinking of the outer pipe 10 or expanding of the inner pipe 20.

In other words, in the sixteenth embodiment of the disclosure, the outer pipe 10 and the inner pipe 20 which are separately prepared may be bonded together by shrinking of the outer pipe 10 or expanding of the inner pipe 20. Accordingly, in the distributor 203 having the structure as in FIG. 22, the number of partition plates 21 may be arbitrarily changed based on a capability of the heat exchanger. In addition to this, the distributor 203 having the structure as in FIG. 28 may allow the twisted angle θ as represented in FIG. 29 to be arbitrarily changed according to a capability of the heat exchanger.

An overall structure of a distributor 204 according to the seventeenth embodiment of the disclosure is similar to that in FIG. 22 or 28. The distributor 204 is also to distribute a refrigerant as an example of a fluid that passes in the distributor 204. Furthermore, the distributor 204 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 204 may include a plurality of branched pipes 60 fixed in the refrigerant downstream and connected to refrigerant pipes of a heat exchanger.

A plurality of partition plates 21 are installed in the inner pipe 20, defining a plurality of distribution paths 22 accordingly.

Figure 30:
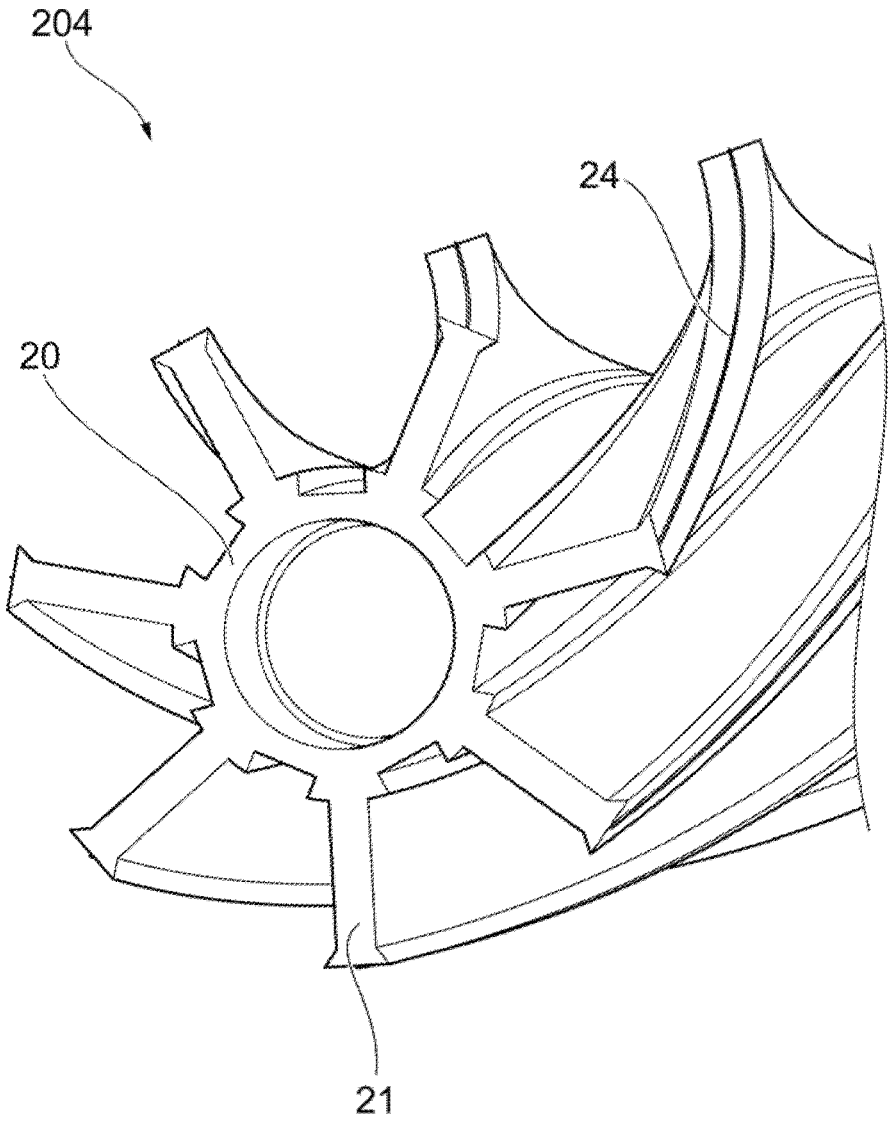
FIG. 30 illustrates a partially enlarged view of a distributor, according to a seventeenth embodiment of the disclosure.

FIG. 30 illustrates a partially enlarged view of the distributor 204, according to the seventeenth embodiment of the disclosure. The distributor 204 having the structure as in FIG. 28 is taken as an example herein. Referring to FIG. 20, the distributor 204 may have a modified rib 24 crumpled and modified by contact with the outer pipe 10 installed at the front end of the partition plate 21 of the inner pipe 20. The modified rib 24 may be a crushed rib 24.

That is, in the seventeenth embodiment of the disclosure, the modified rib 24 may be formed at the front end of the partition plate 21 of the inner pipe 20. Accordingly, refrigerant flow distribution may be adjusted while preventing a refrigerant leak, thereby increasing heat exchange capability.

Figure 31:
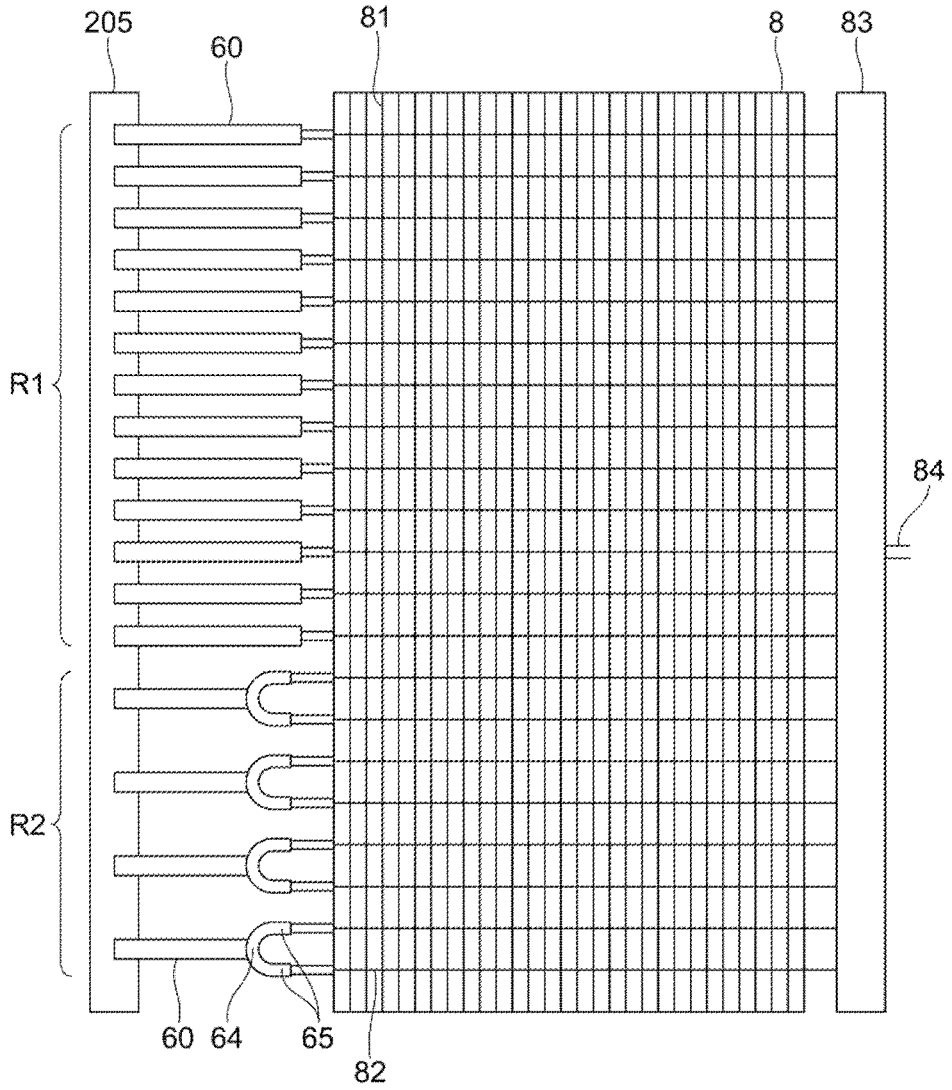
FIG. 31 illustrates an overall structure of a heat exchange unit including a distributor and a heat exchanger, according to an eighteenth embodiment of the disclosure.

FIG. 31 illustrates an overall structure of a heat exchange unit including a distributor 205 and the heat exchanger 8, according to an eighteenth embodiment of the disclosure.

An overall structure of the distributor 205 included in the heat exchange unit according to the eighteenth embodiment of the disclosure is similar to that in FIG. 22 or 28. The distributor 205 is also to distribute a refrigerant as an example of a fluid that passes in the distributor 205. Furthermore, the distributor 205 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. Moreover, the distributor 205 may include the plurality of branched pipes 60 fixed in the refrigerant downstream and connected to refrigerant pipes 82 of the heat exchanger 8 as will be described later.

A plurality of partition plates 21 are installed in the inner pipe 20, defining a plurality of distribution paths 22 accordingly.

The heat exchanger 8 included in the heat exchange unit in the eighteenth embodiment of the disclosure performs heat exchange between the refrigerant as an example of a fluid distributed by the distributor 205 and air. The heat exchanger 8 may include a plurality of fins 81 vertically arranged in parallel at preset intervals, a plurality of refrigerant pipes 82 as an example of a plurality of fluid pipes installed in parallel to pass through holes of the fins 81, a header 83 at which the refrigerant flowing from each of the plurality of refrigerant pipes 82 joins, and an external connection pipe 84 through which to exhaust the refrigerant from the header 83.

The plurality of branched pipes 60 of the distributor 205 may connect to the plurality of refrigerant pipes 82 of the heat exchanger 8.

In the eighteenth embodiment of the disclosure, as shown in FIG. 31, the plurality of branched pipes 60 of the distributor 205 may not necessarily be connected to the plurality of refrigerant pipes 82 one to one. At least one of the plurality of branched pipes 60 may have a Y branch 64 on the downstream side, and two branched pipes 65 before one Y branch 64 may be connected to two refrigerant pipes 82 one to one.

This will be described by way of a specific example.

What is illustrated in FIG. 31 is an example of the heat exchanger 8 requiring more refrigerant flow to the refrigerant pipes 82 in an upper region R1 of the heat exchanger 8 and less refrigerant flow to the refrigerant pipes 82 in a lower region R2 of the heat exchanger 8.

When the branched pipes 60 are connected to the refrigerant pipes 82 in the upper region R1 one to one, the insertion length L can be short for more refrigerant flow to the refrigerant pipes 82 in the upper region R1. Having the short insertion length L is desirable even in terms of making small changes in percentage of flow distribution for the deviation of the insertion length L, as described above with reference to the graph of FIG. 26.

When the branched pipes 60 are connected to the refrigerant pipes 82 in the upper region R1 one to one, the insertion length L cab be long for less refrigerant flow to the refrigerant pipes 82 in the lower region R1. However, the long insertion length L leads to a big change in percentage of flow distribution for the deviation of the insertion length L, in terms of which it is desirable that the branched pipe 60 is connected to the distributor 205 with short insertion length L. Hence, in the eighteenth embodiment of the disclosure, instead of connecting the refrigerant pipes 82 to the branched pipes 60 one to one, one branched pipe 60 may be connected to two refrigerant pipes 82 and in this case, the insertion length L can be short. Accordingly, more refrigerant flows into the branched pipe 60 at first, but afterward, less refrigerant flows into each branched pipe 65 due to the Y branch 64.

In the meantime, although the Y branches 64 are installed at the branched pipes 60 connected to the refrigerant pipes 82 in the lower region of the heat exchanger 8, the installation of the Y branches 64 is not limited thereto. For example, the Y branch 64 may be installed at the branched pipes 60 connected to the refrigerant pipes 82 in both the upper region and the lower region of the heat exchanger 8, and may not be installed at the branched pipes 60 connected to the refrigerant pipes 82 in a middle region of the heat exchanger 8. Alternatively, the Y branches 64 may be installed at the branched pipes 60 connected to the refrigerant pipes 82 in the whole regions of the heat exchanger 8.

Furthermore, although the Y branch 64 into two branched pipes 65 is installed in the downstream side of the branched pipe 60 of the distributor 205, it is not limited thereto. For example, a branch into three or more branched pipes 65 may be installed in the downstream side of the branched pipe 60 of the distributor 205.

As described above, in the eighteenth embodiment of the disclosure, at least one of the plurality of branched pipes 60 may have a branch into multiple branched pipes 65 installed in the downstream side of the branched pipe 60, and the multiple branched pipes 54 may be connected to the plurality of refrigerant pipes 82 one to one. Accordingly, refrigerant flow distribution to the refrigerant pipes 82 may be stably adjusted, thereby increasing heat exchange capability.

Figure 32:
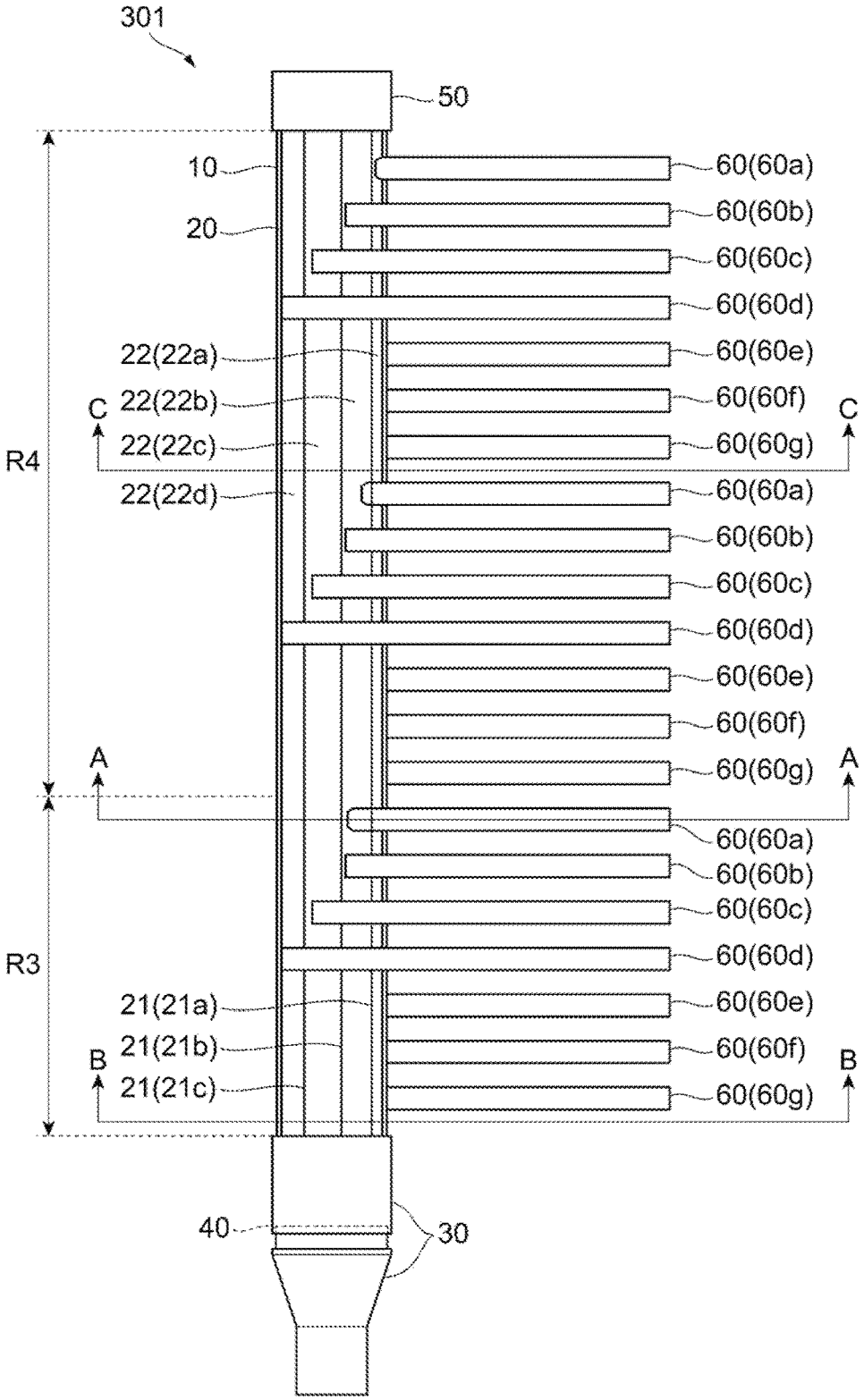
FIG. 32 illustrates an overall structure of a distributor, according to a nineteenth embodiment of the disclosure.

FIG. 32 illustrates an overall structure of a distributor 301, according to a nineteenth embodiment of the disclosure. The distributor 301 is to distribute a refrigerant as an example of a fluid that passes in the distributor 301. Furthermore, as shown in FIG. 32, the distributor 301 may include an outer pipe 10 in the form of a cylinder, an inner pipe 20 installed in the outer pipe 10, and an orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. The inner pipe 20 is also shown as having the shape of a cylinder, but it may have no hollow, in which case the inner pipe 20 is an example of an inner shaft installed in the outer pipe 10. Furthermore, the distributor 301 may include the inlet 30 e.g., welded to the refrigerant upstream end of the outer pipe 10 to guide the refrigerant, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 32. Moreover, the distributor 301 may include a plurality of branched pipes 60 fixed in the refrigerant downstream and connected to refrigerant pipes of a heat exchanger.

In FIG. 32, an internal structure of the outer pipe 10 is shown by removing the front of the outer pipe 10. As shown in FIG. 32, a plurality of partition plates 21 are installed in the inner pipe 20 or the outer pipe 10, defining a plurality of distribution paths 22 accordingly. In the nineteenth embodiment of the disclosure, the plurality of partition plates 21 are installed in parallel with the center shaft of the inner pipe 20. In FIG. 32, as viewed from the front, of the plurality of partition plates 21, partition plates 21*a* to 21*c* (ends of the partition plates 21*a* to 21*c* on the side of the outer pipe 10, in particular) are shown, and of the plurality of distribution paths 22, distribution paths 22*a* to 22*d* are shown. Although it is assumed herein that the plurality of partition plates 21 are installed in parallel with the center shaft of the inner pipe 20, they may be installed along the shaft of the inner pipe 20, i.e., the shaft of the outer pipe 10, in which case the plurality of partition plates 21 are an example of a plurality of partitions installed along the shaft of the outer pipe 10. Or, it is an example of a plurality of partitions defining a plurality of distribution paths between the outer pipe and the inner pipe.

Furthermore, in FIG. 32, the orifice plate 40 may have a plurality of orifice holes through which to allow the refrigerant to flow into the plurality of distribution paths 22.

The plurality of branched pipes 60 may be linked to the plurality of distribution paths 22. FIG. 32 shows the branched pipes 60*e* to 60*g* linked to distribution paths 22*e* to 22*g*, respectively, in addition to the branched pipes 60*a* to 60*d* linked to the distribution paths 22*a* to 22*d*, respectively.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 32, in the nineteenth embodiment of the disclosure, the branched pipe 60*a* may extend to the right directly from the distribution path 22*a*. The branched pipes 60*b* to 60*d* may extend forward from the distribution paths 22*b* to 22*d* first and then bend and extend to the right. The branched pipes 60*e* to 60*g* may extend to the opposite side from the distribution paths 22*e* to 22*g* first and then bend and extend to the right.

There may be one set of branched pipes 60*a* to 60*g*, although in the nineteenth embodiment of the disclosure, there may be a multiple sets of branched pipes 60*a* to 60*g* installed in parallel. The structure as in the nineteenth embodiment of the disclosure may be understood as an example of a structure that includes at least two branched pipes connected to one of the plurality of distribution paths.

Figure 33A:
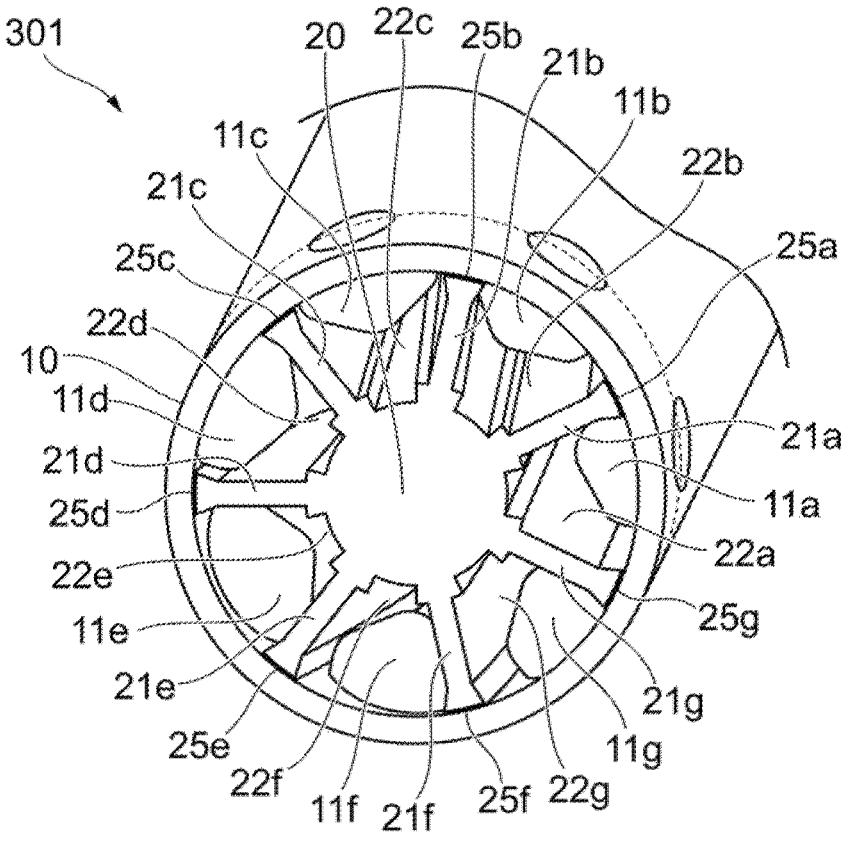
FIG. 33A illustrates a first example of the distributor of FIG. 32.
Figure 33B:
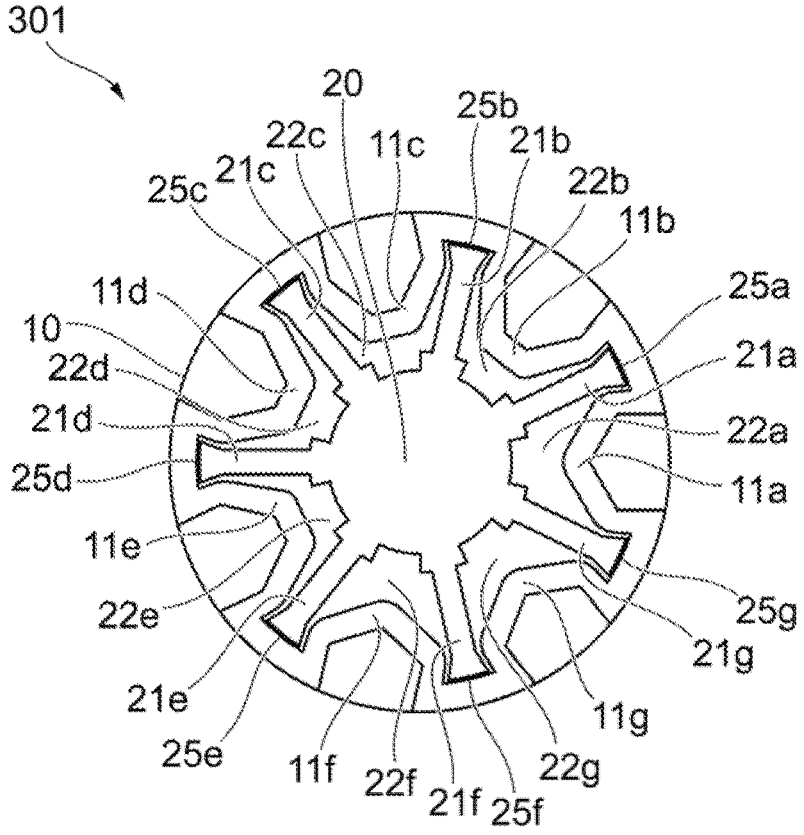
FIG. 33B illustrates a first example of the distributor of FIG. 32.

FIGS. 33A and 33B illustrate a first example of the distributor 301 of FIG. 32. FIG. 33A shows the first example of a perspective view of the refrigerant upstream end of the distributor 301 of FIG. 32, and FIG. 33B shows the first example of a B-B cross-sectional view of the distributor 301 of FIG. 32. It corresponds to a cross-sectional view resulting from cutting along the dashed line on the surface of the outer pipe 10 of FIG. 33A. The partition plates 21*a* to 21*g* may be installed integrally with the inner pipe 20, defining the plurality of distribution paths 22*a* to 22*g* accordingly. The partition plates 21 connect the outer side of the inner pipe 20 and the center portion of the inner pipe 20, so that the width of the distribution path 22 between the partition plates 21 decreases as it goes from the outer side of the inner pipe 20 to the center portion. Furthermore, the partition plates 21*a* to 21*g* may be bonded to the outer pipe 10 with a substance 25*a* to 25*g*. The substance 25*a* to 25*g* may be e.g., an adhesive without being limited thereto. The substance 25*a* to 25*g* may be any heterogeneous material different from material(s) of the outer pipe 10 and the inner pipe 20. Furthermore, in the nineteenth embodiment of the disclosure, the outer pipe 10 is subject to a recess process at locations corresponding to the distribution paths 22*a* to 22*g* on the dashed line of the refrigerant upstream end. Accordingly, recesses 11*a* to 11*g*, i.e., concave portions, may be formed from the outer surface of the outer pipe 10, and may serve as projections, i.e., convex portions into the distribution paths 22*a* to 22*g*. The location corresponding to the distribution paths 22*a* to 22*g* on the dashed line of the refrigerant upstream end of the outer pipe 10 is an example of a first location of an open end, and may include any location from the inlet of the distribution path 22 to the branched pipe 60 on the utmost refrigerant upstream side.

Figure 34A:
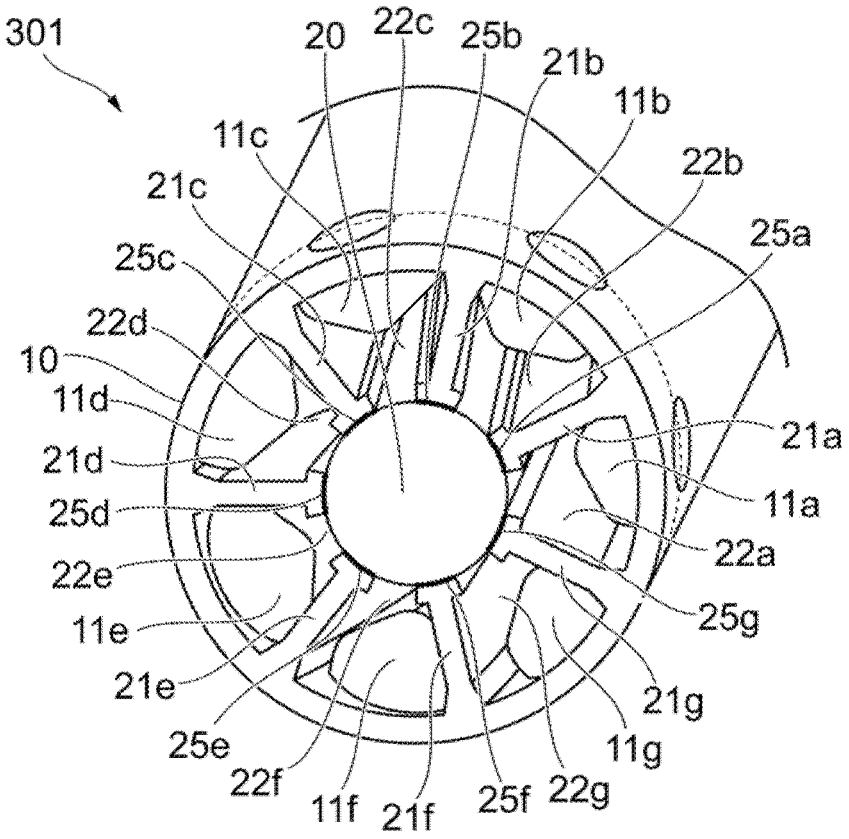
FIG. 34A illustrates a second example of the distributor of FIG. 32.
Figure 34B:
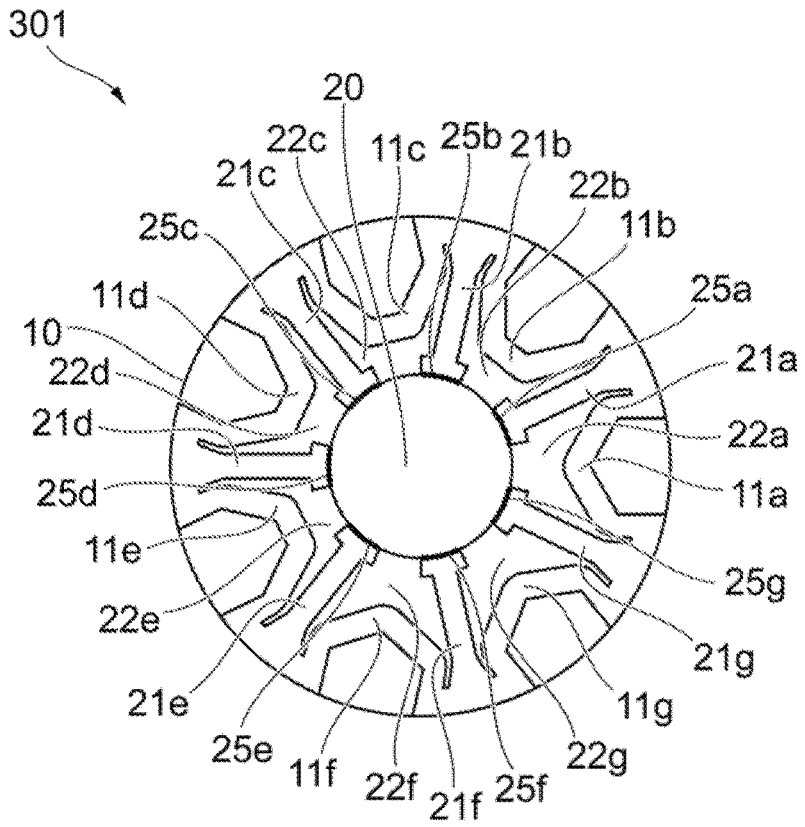
FIG. 34B illustrates a second example of the distributor of FIG. 32.

FIGS. 34A and 34B illustrate a second example of the distributor 301 of FIG. 32. FIG. 34A shows the second example of a perspective view of the refrigerant upstream end of the distributor 301 of FIG. 32, and FIG. 34B shows the second example of a B-B cross-sectional view of the distributor 301 of FIG. 32. It corresponds to a cross-sectional view resulting from cutting along the dashed line on the surface of the outer pipe 10 of FIG. 34A. The partition plates 21*a* to 21*g* may be installed integrally with the outer pipe 10, defining the plurality of distribution paths 22*a* to 22*g* accordingly. The partition plates 21 connect the outer circumferential face of the outer pipe 10 and the inner side of the outer pipe 10, so that the width of the distribution path 22 between the partition plates 21 decreases as it goes from the outer circumferential face to the inner side of the outer pipe 10. Furthermore, the partition plates 21*a* to 21*g* may be bonded to the inner pipe 20 with the substance 25*a* to 25*g*. The substance 25*a* to 25*g* may be e.g., an adhesive without being limited thereto. The substance 25*a* to 25*g* may be any heterogeneous material different from material(s) of the outer pipe 10 and the inner pipe 20. Furthermore, in the nineteenth embodiment of the disclosure, the outer pipe 10 may be subject to a recess process at locations corresponding to the distribution paths 22*a* to 22*g* on the dashed line of the refrigerant upstream end. Accordingly, recesses 11*a* to 11*g*, i.e., concave portions, may be formed from the outer surface of the outer pipe 10, and may serve as projections, i.e., convex portions into the distribution paths 22*a* to 22*g*. The location corresponding to the distribution paths 22*a* to 22*g* on the dashed line of the refrigerant upstream end of the outer pipe 10 is an example of a first location of an open end, and may include any location from the inlet of the distribution path 22 to the branched pipe 60 on the utmost refrigerant upstream side.

As described above, in the nineteenth embodiment of the disclosure, the substance 25*a* to 25*g* may be put in between the partition plates 21*a* to 21*g* installed integrally with the inner pipe 20 and the outer pipe 10 or between the partition plates 21*a* to 21*g* installed integrally with the outer pipe 10 and the inner pipe 20. Accordingly, a refrigerant leak between the outer pipe 10 and the partition plates 21*a* to 21*g* or between the inner pipe 20 and the partition plates 21*a* to 21*g* may be prevented, which enables adjustment of refrigerant flow to each distribution path 22.

Furthermore, in the nineteenth embodiment of the disclosure, the outer pipe 10 may be subject to a recess process to form a projection into the distribution path 22. Accordingly, heat exchange capability may be increased by changing a local area of the distribution path 22 and adjusting a refrigerant flow to each distribution path 22.

Figure 35:
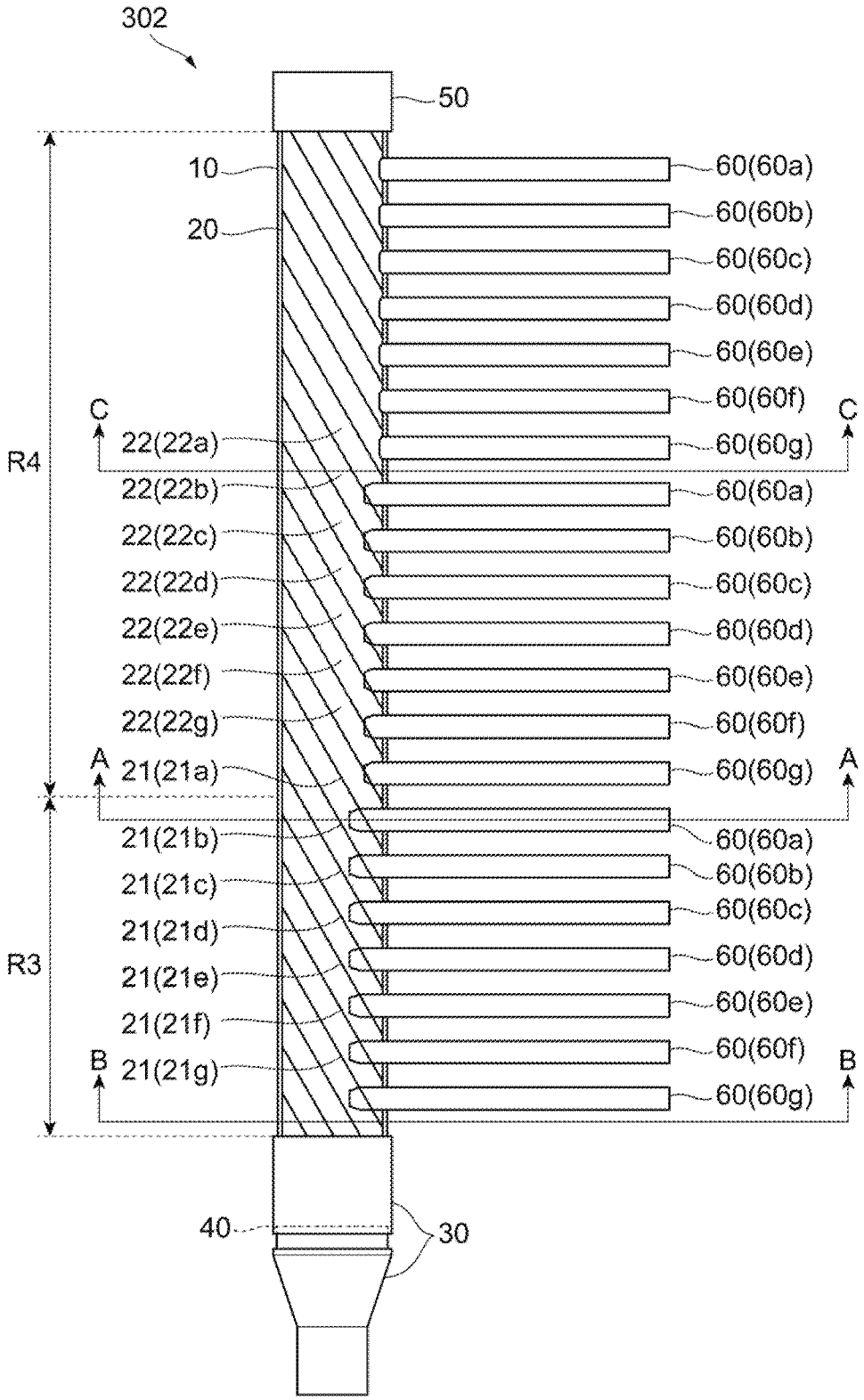
FIG. 35 illustrates an overall structure of a distributor, according to a twentieth embodiment of the disclosure.

FIG. 35 illustrates an overall structure of a distributor 302, according to a twentieth embodiment of the disclosure. The distributor 302 is also to distribute a refrigerant as an example of a fluid that passes in the distributor 302. Furthermore, as shown in FIG. 35, the distributor 302 may include an outer pipe 10 in the form of a cylinder, an inner pipe 20 installed in the outer pipe 10, and an orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. The inner pipe 20 is also shown as having the shape of a cylinder, but it may have no hollow, in which case the inner pipe 20 is an example of an inner shaft installed in the outer pipe 10. Furthermore, the distributor 302 may include the inlet 30 e.g., welded to the refrigerant upstream end of the outer pipe 10 to guide the refrigerant, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 35. Moreover, the distributor 302 may include a plurality of branched pipes 60 fixed in the refrigerant downstream and connected to refrigerant pipes of a heat exchanger.

In FIG. 35, an internal structure of the outer pipe 10 is shown by removing the front of the outer pipe 10. As shown in FIG. 35, a plurality of partition plates 21 are installed in the inner pipe 20 or the outer pipe 10, defining a plurality of distribution paths 22 accordingly. In the twentieth embodiment of the disclosure, the plurality of partition plates 21 may be installed at a twisted angle to the center shaft of the inner pipe 20. In FIG. 35, of the plurality of partition plates 21, partition plates 21*a* to 21*g* (ends of the partition plates 21*a* to 21*g* on the side of the outer pipe 10, in particular) are shown, and of the plurality of distribution paths 22, distribution paths 22*a* to 22*g* are shown. Although it is assumed herein that the plurality of partition plates 21 are installed at a twisted angle to the center shaft of the inner pipe 20, they may also be said as being installed along the shaft of the inner pipe 20, i.e., the shaft of the outer pipe 10, in which case the plurality of partition plates 21 are an example of a plurality of partitions installed along the shaft of the outer pipe. Or, it is an example of a plurality of partitions defining a plurality of distribution paths between the outer pipe and the inner pipe.

Furthermore, in FIG. 35, the orifice plate 40 may have a plurality of orifice holes through which to allow the refrigerant to flow into the plurality of distribution paths 22.

The plurality of branched pipes 60 may be linked to the plurality of distribution paths 22. In FIG. 35, the branched pipes 60*a* to 60*g* linked to the distribution paths 22*a* to 22*g* are shown as the plurality of branched pipes 60.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 35, in the twentieth embodiment of the disclosure, the distribution paths 22*a* to 22*g* are defined to have a certain twisted angle to the center shaft of the inner pipe 20, so all the distribution paths 22*a* to 22*g* may turn around the inner pipe 20 once and pass through the right side of the inner pipe 20. Accordingly, the branched pipes 60*a* to 60*g* may all extend to the right by being linked to the portions at which the distribution paths 22*a* to 22*g* pass through the right side of the inner pipe 20. This structure may be understood as an example of a structure in which a plurality of partitions are installed to form a certain twisted angle to the shaft of the outer pipe.

There may be one set of branched pipes 60*a* to 60*g*, although in the twentieth embodiment of the disclosure, there may be a multiple sets of branched pipes 60*a* to 60*g* installed in parallel. The structure as in the twentieth embodiment of the disclosure may be understood as an example of a structure that includes at least two branched pipes connected to one of the plurality of distribution paths.

The perspective view of the refrigerant upstream end of the distributor 302 in FIG. 35 is similar to that of FIG. 33A or 34A. The B-B cross-sectional view of the distributor 302 of FIG. 35 is similar to what is shown in FIG. 33B or 34B.

An overall structure of a distributor 303 according to the twenty first embodiment of the disclosure is similar to that in FIG. 32 or 35. The distributor 303 is also to distribute a refrigerant as an example of a fluid that passes in the distributor 303. Furthermore, the distributor 303 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. The inner pipe 20 is also shown as having the shape of a cylinder, but it may have no hollow, in which case the inner pipe 20 is an example of an inner shaft installed in the outer pipe 10. Moreover, the distributor 303 may include a plurality of branched pipes 60 fixed in the refrigerant downstream and connected to refrigerant pipes of a heat exchanger.

A plurality of partition plates 21 may be installed in the inner pipe 20 or the outer pipe 10, defining a plurality of distribution paths 22 accordingly.

Figure 36A:
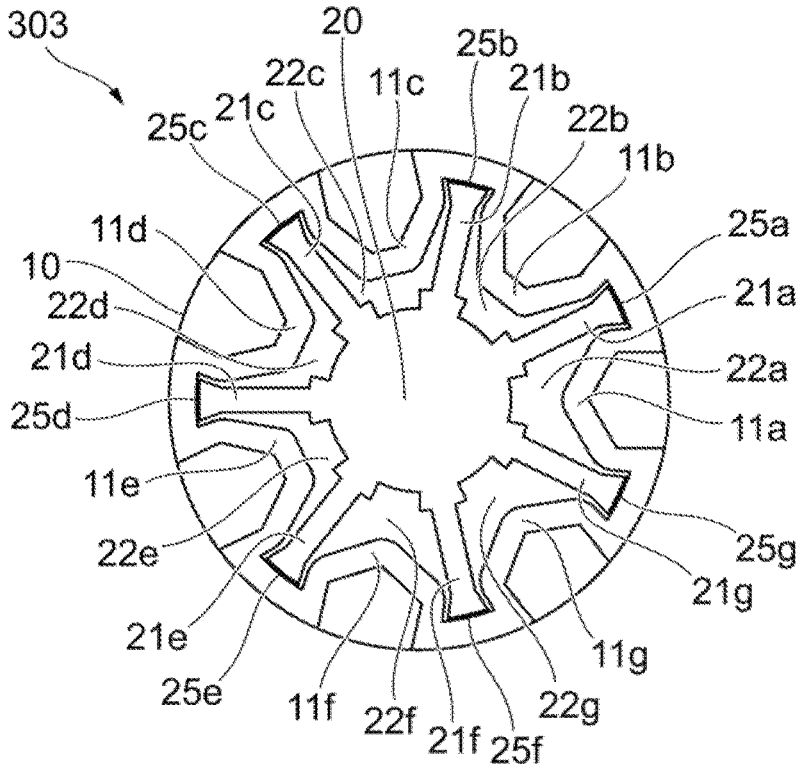
FIG. 36A illustrates a cross-sectional view of a distributor, according to a twenty first embodiment of the disclosure.
Figure 36B:
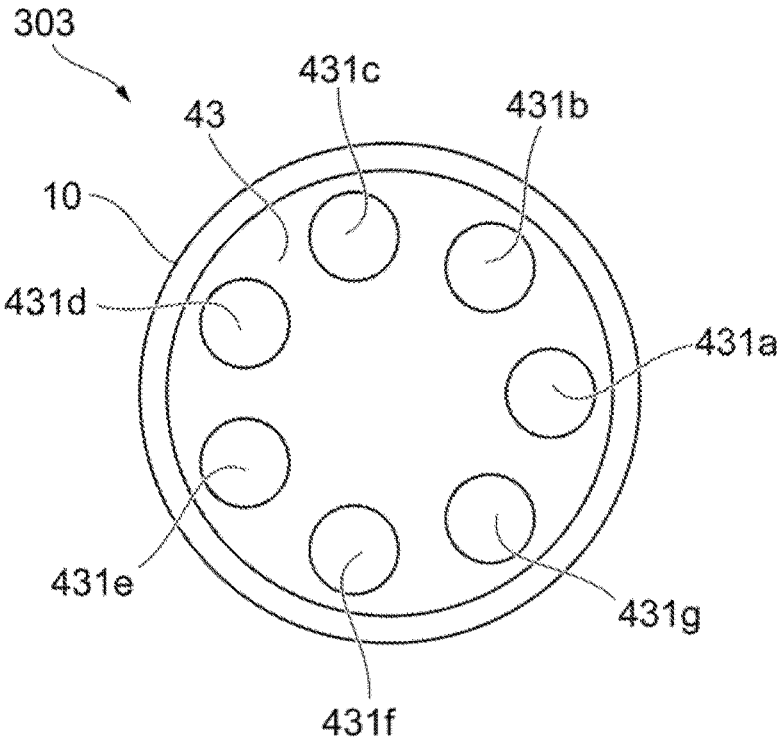
FIG. 36B illustrates a cross-sectional view of a distributor, according to a twenty first embodiment of the disclosure.

FIGS. 36A and 36B are cross-sectional views of the distributor 303, according to the twenty first embodiment of the disclosure. The cross-sectional views show a case that the plurality of partition plates 21 are installed in the inner pipe 20.

FIG. 36A illustrates a B-B cross-sectional view of the distributor 303, according to the twenty first embodiment of the disclosure. The partition plates 21*a* to 21*g* may be installed integrally with the inner pipe 20, defining the plurality of distribution paths 22*a* to 22*g* accordingly. The partition plates 21 connect the outer side of the inner pipe 20 and the center portion of the inner pipe 20, so that the width of the distribution path 22 between the partition plates 21 decreases as it goes from the outer side of the inner pipe 20 to the center portion. Furthermore, the partition plates 21*a* to 21*g* are bonded to the outer pipe 10 with a substance 25*a* to 25*g*. The substance 25*a* to 25*g* may be e.g., an adhesive without being limited thereto. The substance 25*a* to 25*g* may be any heterogeneous material different from material(s) of the outer pipe 10 and the inner pipe 20. Furthermore, in the twenty first embodiment of the disclosure, the outer pipe 10 is subject to a recess process at locations corresponding to the distribution paths 22*a* to 22*g* on the dashed line of the refrigerant upstream end. Accordingly, recesses 11*a* to 11*g*, i.e., concave portions, may be formed from the outer surface of the outer pipe 10, and may serve as projections, i.e., convex portions into the distribution paths 22*a* to 22*g*. The B-B line (or B-B location) is an example of a first location of an open end of the outer pipe, and may include any location from the inlet of the distribution path 22 to the branched pipe 60 on the utmost refrigerant upstream side.

FIG. 36B illustrates a C-C cross-sectional view of the distributor 303, according to the twenty first embodiment of the disclosure. Referring to FIG. 36B, the orifice plate 43 may be installed along the C-C line (or C-C location) of the distributor 303, which may have a plurality of orifice holes 431 through which to allow the refrigerant to flow into the plurality of distribution paths 22. In FIG. 36B, as the plurality of orifice holes 431, orifice holes 431*a* to 431*g* through which to allow the refrigerant to flow into the plurality of distribution paths 22*a* to 22*g*, respectively, are shown. The orifice holes 431*a* to 431*g* are an example of the plurality of orifice holes corresponding to the plurality of distribution paths. The C-C line is an example of a second location of a portion other than the end of the outer pipe, and the second location may include any location between the branched pipe 60 on the utmost refrigerant downstream side among the branched pipes 60 included in a set and the branched pipe 60 on the utmost refrigerant upstream side among the branched pipes 60 included in a set next to the former set on the downstream side. Alternatively, the location may be selected in the plural number, at which to install the orifice plate 43 or perform a recess process.

In the twenty first embodiment of the disclosure, the distributor 303 may have the orifice plate 43 shown in FIG. 36B installed along the B-B line and may be subject to the recess process as shown in FIG. 36A along the line C-C. The B-B line is an example of a first location of an open end of the outer pipe, and may include any location from the inlet of the distribution path 22 to the branched pipe 60 on the utmost refrigerant upstream side. Furthermore, the C-C line is an example of a second location of a portion other than the end of the outer pipe, and the second location may include any location between the branched pipe 60 on the utmost refrigerant downstream side among the branched pipes 60 included in a set and the branched pipe 60 on the utmost refrigerant upstream side among the branched pipes 60 included in a set next to the former set on the downstream side. Alternatively, the location may be selected in the plural number, at which to install the orifice plate 43 or perform a recess process.

Even in the twenty first embodiment of the disclosure, the plurality of partition plates 21 may be installed integrally with the outer pipe 10. In this case, a cross-sectional view at a location of the distributor 303 at which the recess process is performed is similar to that of FIG. 34B.

As described above, in the twenty first embodiment of the disclosure, the recess process may be performed on the refrigerant upstream end of the outer pipe 10 and the orifice plate 40 may be installed across the distribution paths 22 on the refrigerant downstream side. Alternatively, the orifice plate 40 may be installed at the refrigerant upstream end of the distribution path 22 and the recess process may be performed on the outer pipe 10 on the refrigerant downstream side. Accordingly, heat exchange capability may be increased by adjusting a refrigerant flow in the distribution path 22.

Figure 37:
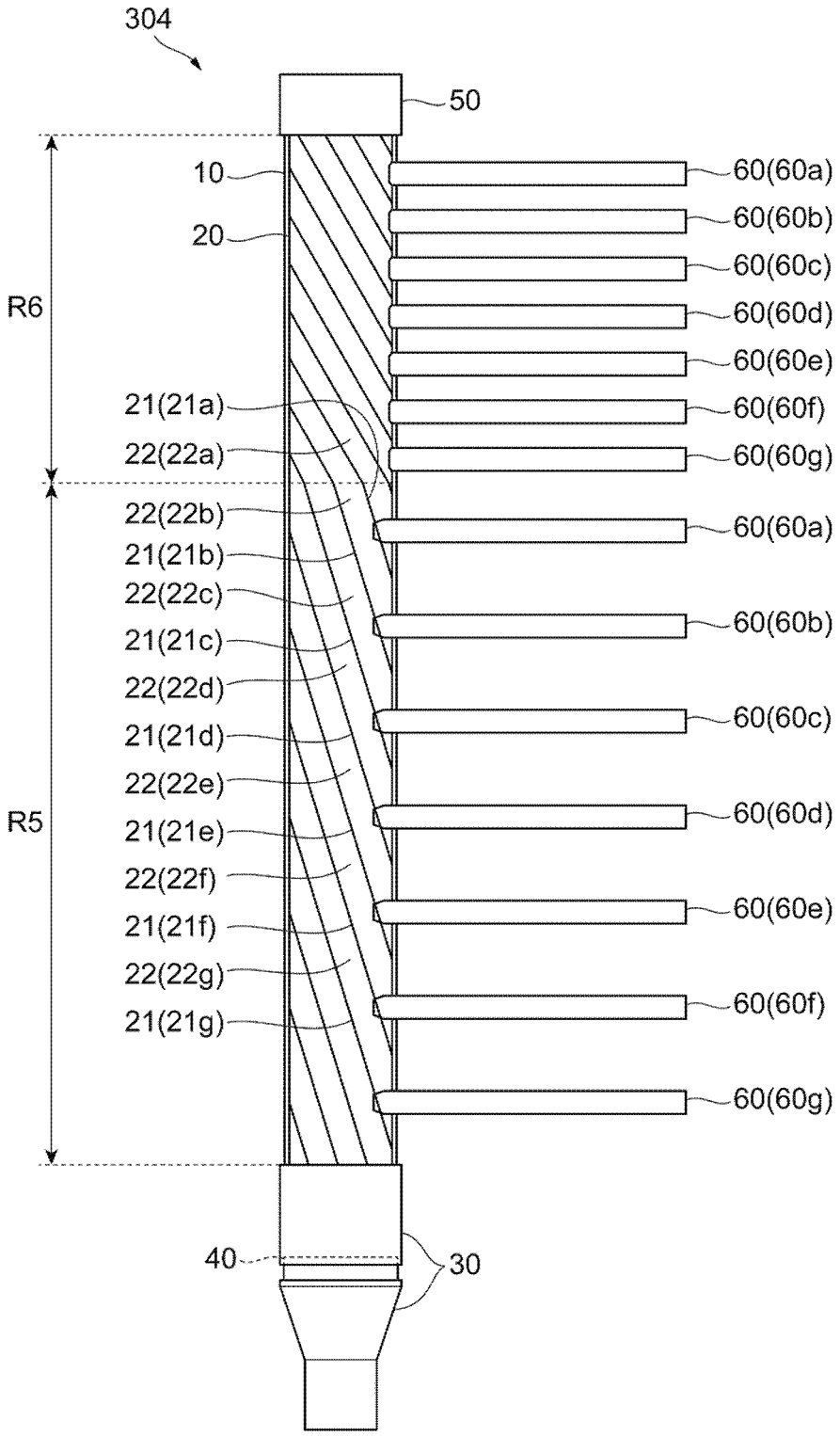
FIG. 37 illustrates an overall structure of a distributor, according to a twenty second embodiment of the disclosure.

FIG. 37 illustrates an overall structure of a distributor 304, according to a twenty second embodiment of the disclosure. The distributor 304 is also to distribute a refrigerant as an example of a fluid that passes in the distributor 304. Furthermore, as shown in FIG. 37, the distributor 304 may include an outer pipe 10 in the form of a cylinder, an inner pipe 20 installed in the outer pipe 10, and an orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. The inner pipe 20 is also shown as having the shape of a cylinder, but it may have no hollow, in which case the inner pipe 20 is an example of an inner shaft installed in the outer pipe 10. Furthermore, the distributor 304 may include the inlet 30 e.g., welded to the refrigerant upstream end of the outer pipe 10 to guide the refrigerant, and the cap 50 e.g., welded to an end opposite to the refrigerant upstream end of the outer pipe 10. The inlet 30 is installed outside the orifice plate 40, so the orifice plate 40 is not visible from outside even though the orifice plate 40 is illustrated in FIG. 37. Moreover, the distributor 304 may include a plurality of branched pipes 60 fixed in the refrigerant downstream and connected to refrigerant pipes of a heat exchanger.

In FIG. 37, an internal structure of the inner pipe 20 is shown by removing the front of the outer pipe 10. As shown in FIG. 37, the plurality of partition plates 21 are installed in the inner pipe 20 or the outer pipe 10, defining a plurality of distribution paths 22 accordingly. In the twenty second embodiment of the disclosure, the plurality of partition plates 21 may be formed at a small twisted angle to the center shaft of the inner pipe 20 in a refrigerant upstream range R5 and at a large twisted angle to the center shaft of the inner pipe 20 in a refrigerant downstream range R6. In FIG. 37, of the plurality of partition plates 21, partition plates 21*a* to 21*g* (ends of the partition plates 21*a* to 21*g* on the side of the outer pipe 10, in particular) are shown, and of the plurality of distribution paths 22, distribution paths 22*a* to 22*g* are shown. Although it is assumed herein that the plurality of partition plates 21 are installed at a twisted angle to the center shaft of the outer pipe 10, they may also be said as being installed along the shaft of the inner pipe 20, i.e., the shaft of the outer pipe 10, in which case the plurality of partition plates 21 are an example of a plurality of partitions installed along the shaft of the outer pipe. Or, it is an example of a plurality of partitions defining a plurality of distribution paths between the outer pipe and the inner pipe.

Furthermore, in FIG. 37, the orifice plate 40 may have a plurality of orifice holes through which to allow the refrigerant to flow into the plurality of distribution paths 22.

The plurality of branched pipes 60 may be linked to the plurality of distribution paths 22. In FIG. 37, the branched pipes 60*a* to 60*g* linked to the distribution paths 22*a* to 22*g* are shown as the plurality of branched pipes 60.

This structure may be understood as an example of a structure in which neighboring first and second branched pipes of the plurality of branched pipes are connected to first and second distribution paths of the plurality of distribution paths, the first and second distribution paths having one of the plurality of partitions in between them. In this case, by putting the branched pipes 60*a* and 60*b* to the first and second branched pipes as an example, the distribution paths 22*a* and 22*b* correspond to the first and second distribution paths and the partition plate 21*a* corresponds to the one of the plurality of partitions.

Furthermore, in this structure, the first and second branched pipes may not be adjacent to each other, and the first and second distribution paths may have at least one of the plurality of partitions in between them. In this case, by putting the branched pipes 60*a* and 60*c* to the first and second branched pipes as an example, the distribution paths 22*a* and 22*c* correspond to the first and second distribution paths and the partition plates 21*a* and 21*b* correspond to the at least one of the plurality of partitions.

Moreover, as shown in FIG. 35, in the twenty second embodiment of the disclosure, the distribution paths 22*a* to 22*g* are defined to have a twisted angle to the center shaft of the inner pipe 20, so all the distribution paths 22*a* to 22*g* may turn around the inner pipe 20 once and pass through the right side of the inner pipe 20. Accordingly, the branched pipes 60*a* to 60*g* may all extend to the right by being linked to the portions at which the distribution paths 22*a* to 22*g* pass through the right side of the inner pipe 20. This structure may be understood as an example of a structure in which a plurality of partitions are installed to form a twisted angle to the shaft of the outer pipe.

There may be one set of branched pipes 60*a* to 60*g*, although in the twenty second embodiment of the disclosure, there may be a multiple sets of branched pipes 60*a* to 60*g* installed in parallel. The structure as in the twenty second embodiment of the disclosure may be understood as an example of a structure that includes at least two branched pipes connected to one of the plurality of distribution paths.

Figure 38A:
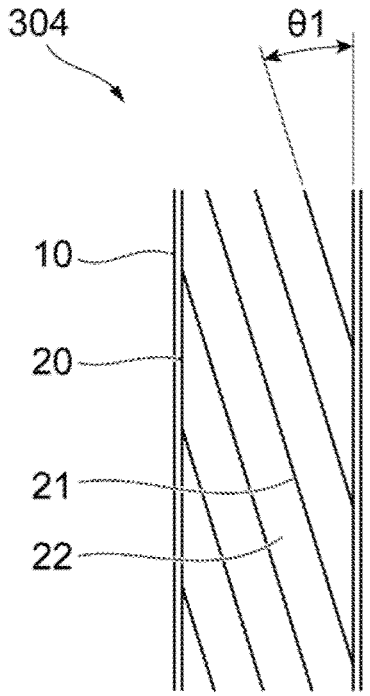
FIG. 38A illustrates a partially enlarged view of the distributor, according to the twenty second embodiment of the disclosure.
Figure 38B:
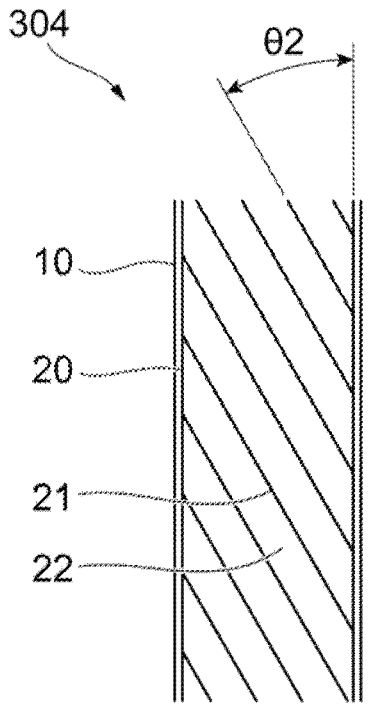
FIG. 38B illustrates a partially enlarged view of the distributor, according to the twenty second embodiment of the disclosure.

FIGS. 38A and 38B are partially enlarged views of the distributor 304, according to the twenty second embodiment of the disclosure.

In FIG. 38A, an enlarged view of a portion of the range R5 of FIG. 37 is illustrated. In this enlarged view, the partition plates 21 are formed at a twisted angle θ1 to the inner pipe 20. In FIG. 38B, an enlarged view of a portion of the range R6 of FIG. 37 is illustrated. In this enlarged view, the partition plates 21 are formed at a twisted angle θ2 (θ1<θ2) to the inner pipe 20.

Although the twisted angle in the range R5 of FIG. 37 is θ1 and twisted angle in the range R6 of FIG. 37 is θ1 (θ1<θ2), they are not limited thereto.

For example, when more refrigerant flow is required to flow into the branched pipes 60 on the refrigerant upstream side, the twisted angle θ1 in the range R5 of FIG. 37 and the twisted angle θ2 in the range R6 of FIG. 37 may satisfy a condition of θ1>θ2. That is, the twisted angles θ1 and θ2 may have different values. Assuming that the ranges R5 and R6 correspond to first and second ranges, respectively, in the axial direction of the outer pipe, the twisted angles θ1 and θ2 correspond to an example of first and second twisted angles, respectively.

Furthermore, even in the twenty second embodiment of the disclosure, when the partition plates 21*a* to 21*g* are installed integrally with the inner pipe 20, the partition plates 21*a* to 21*g* may be bonded to the outer pipe 10 with the substance 25*a* to 25*g*. Alternatively, when the partition plates 21*a* to 21*g* are installed integrally with the outer pipe 10, the partition plates 21*a* to 21*g* may be bonded to the inner pipe 20 with the substance 25*a* to 25*g*.

As described above, in the twenty second embodiment of the disclosure, the twisted angles of the partition plates 21 against the inner pipe 20 differ between the refrigerant upstream side and the refrigerant downstream side. Accordingly, heat exchange capability may be increased by changing a refrigerant pressure loss of the distribution path 22 and adjusting a refrigerant flow in the distribution path 22.

An overall structure of a distributor 305 according to the twenty third embodiment of the disclosure is similar to that in FIG. 32 or 35. The distributor 305 is also to distribute a refrigerant as an example of a fluid that passes in the distributor 305. Furthermore, the distributor 305 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. The inner pipe 20 is also shown as having the shape of a cylinder, but it may have no hollow, in which case the inner pipe 20 is an example of an inner shaft installed in the outer pipe 10. Moreover, the distributor 305 may include a plurality of branched pipes 60 fixed in the refrigerant downstream and connected to refrigerant pipes of a heat exchanger.

A plurality of partition plates 21 are installed in the inner pipe 20 or the outer pipe 10, defining a plurality of distribution paths 22 accordingly.

Figure 39A:
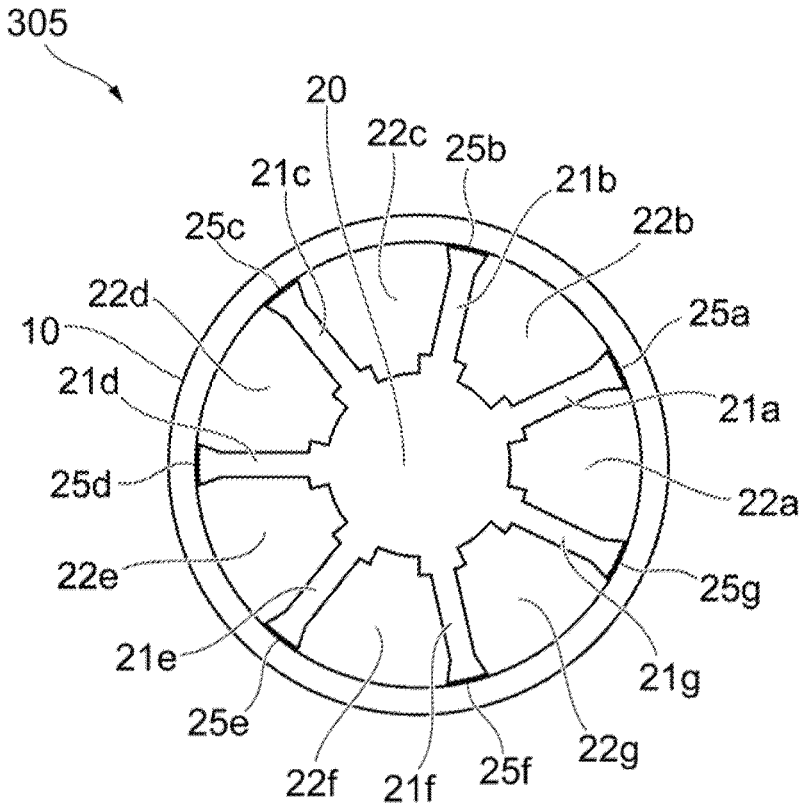
FIG. 39A illustrates a cross-sectional view of a distributor, according to a twenty third embodiment of the disclosure.
Figure 39B:
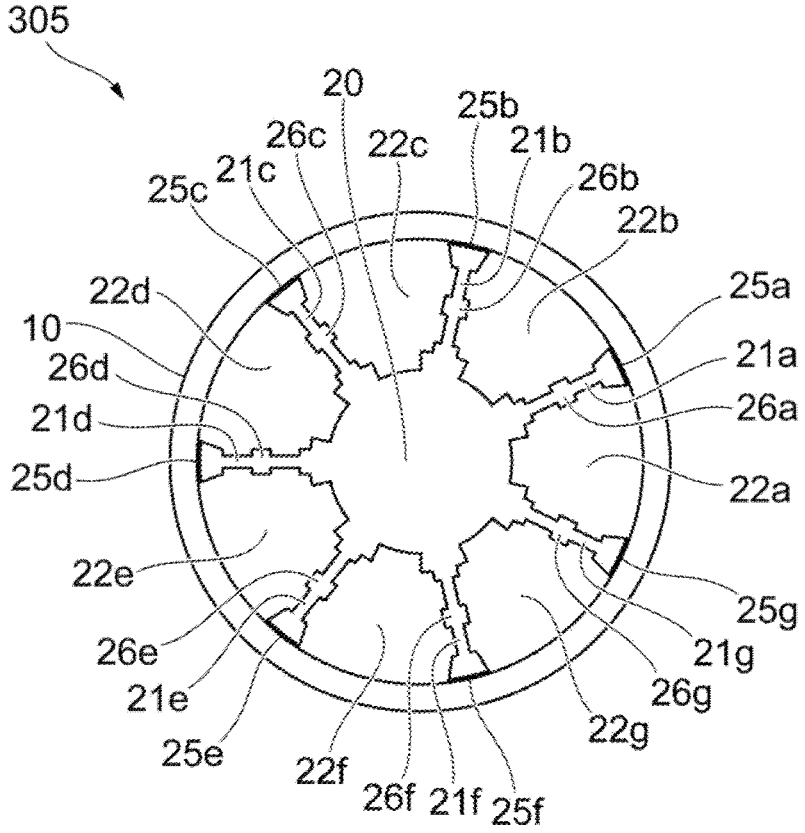
FIG. 39B illustrates a cross-sectional view of a distributor, according to a twenty third embodiment of the disclosure.

FIGS. 39A and 39B are cross-sectional views of the distributor 305, according to the twenty third embodiment of the disclosure. The cross-sectional views show a case that the plurality of partition plates 21 are installed in the inner pipe 20. FIG. 39A illustrates a B-B cross-sectional view of the distributor 305 and FIG. 39B illustrates a C-C cross-sectional view of the distributor 305, in the twenty third embodiment of the disclosure. The partition plates 21*a* to 21*g* may be installed integrally with the inner pipe 20, defining the plurality of distribution paths 22*a* to 22*g* accordingly. The partition plates 21 connect the outer side of the inner pipe 20 and the center portion of the inner pipe 20, so that the width of the distribution path 22 between the partition plates 21 decreases as it goes from the outer side of the inner pipe 20 to the center portion. Furthermore, the partition plates 21*a* to 21*g* are bonded to the outer pipe 10 with a substance 25*a* to 25*g*. The substance 25*a* to 25*g* may be e.g., an adhesive without being limited thereto. The substance 25*a* to 25*g* may be any heterogeneous material different from material(s) of the outer pipe 10 and the inner pipe 20. While the partition plates 21*a* to 21*g* are not subject to a rib process on their surfaces in FIG. 39A and thus have no ribs, the partition plates 21*a* to 21*g* is subject to the rib process on their surfaces and have ribs 26*a* to 26*g* in FIG. 39B.

In other words, no rib is formed on the partition plates 21*a* to 21*g* along the B-B line of FIG. 32 or 35 and ribs 26*a* to 26*g* are formed on the partition plates 21*a* to 21*g* along the C-C line of FIG. 32 or 35, without being limited thereto.

For example, no rib may be formed on the partition plates 21*a* to 21*g* at any location in the range R3 of FIG. 32 or 35, but ribs 26*a* to 26*g* may be formed on the partition plates 21*a* to 21*g* at any location in the range R4 of FIG. 32 or 35. The range R3 is an example of a first range, and the range R4 is an example of a second range.

In another example, when more refrigerant is required to flow into the branched pipe 60 on the refrigerant upstream side, the ribs 26*a* to 26*b* may be formed on the partition plates 21*a* to 21*g* in the range R3 of FIG. 32 or 35 while no rib may be formed on the partition plates 21*a* to 21*g* in the range R4 of FIG. 32 or 35.

Although the partition plates 21*a* to 21*g* are installed integrally with the inner pipe 20 in the above embodiment of the disclosure, it is not limited thereto. For example, the partition plates 21*a* to 21*g* may be installed integrally with the outer pipe 10. In this case, the partition plates 21*a* to 21*g* may be bonded to the inner pipe 20 with the substance 25*a* to 25*g*.

As described above, in the twenty third embodiment of the disclosure, the partition plates 21*a* to 21*g* have a portion with the ribs 26*a* to 26*g* formed therein and another portion without ribs. The ribs 26*a* to 26*g* formed in the distribution paths 22*a* to 22*g* may facilitate gas-liquid mixing. Accordingly, heat exchange capability may be increased by uniformly distributing the gas-liquid refrigerant into the plurality of branched pipes 60.

An overall structure of a distributor 306 according to the twenty fourth embodiment of the disclosure is similar to that in FIG. 32 or 35. The distributor 306 is also to distribute a refrigerant as an example of a fluid that passes in the distributor 306. Furthermore, the distributor 306 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped main pipe. The inner pipe 20 is also shown as having the shape of a cylinder, but it may have no hollow, in which case the inner pipe 20 is an example of an inner shaft installed in the outer pipe 10. Moreover, the distributor 306 may include a plurality of branched pipes 60 fixed in the refrigerant downstream and connected to refrigerant pipes of a heat exchanger.

A plurality of partition plates 21 are installed in the inner pipe 20 or the outer pipe 10, defining a plurality of distribution paths 22 accordingly.

Figure 40A:
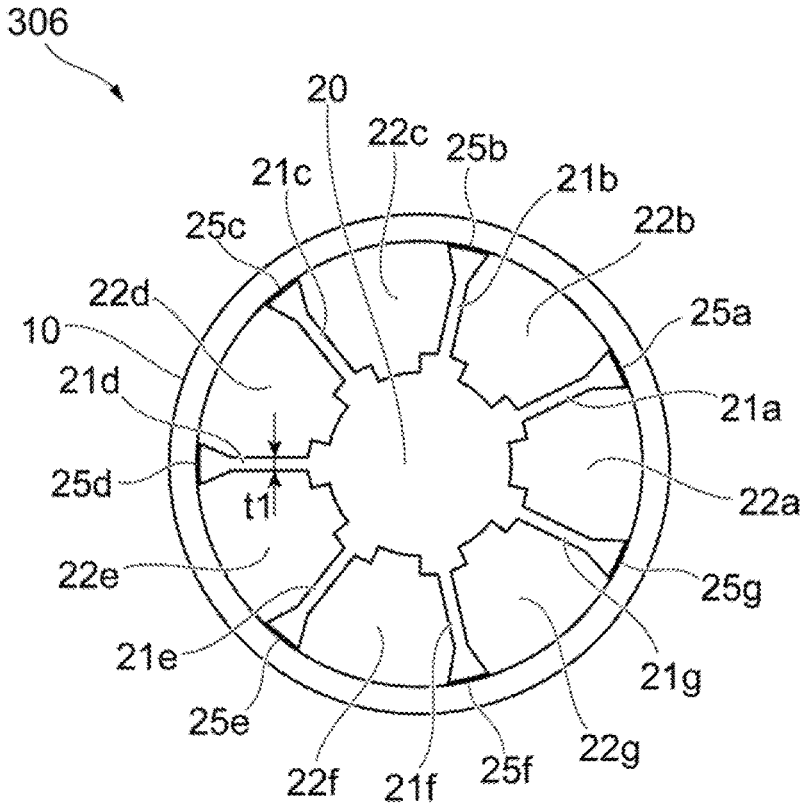
FIG. 40A illustrates a cross-sectional view of a distributor, according to a twenty fourth embodiment of the disclosure.
Figure 40B:
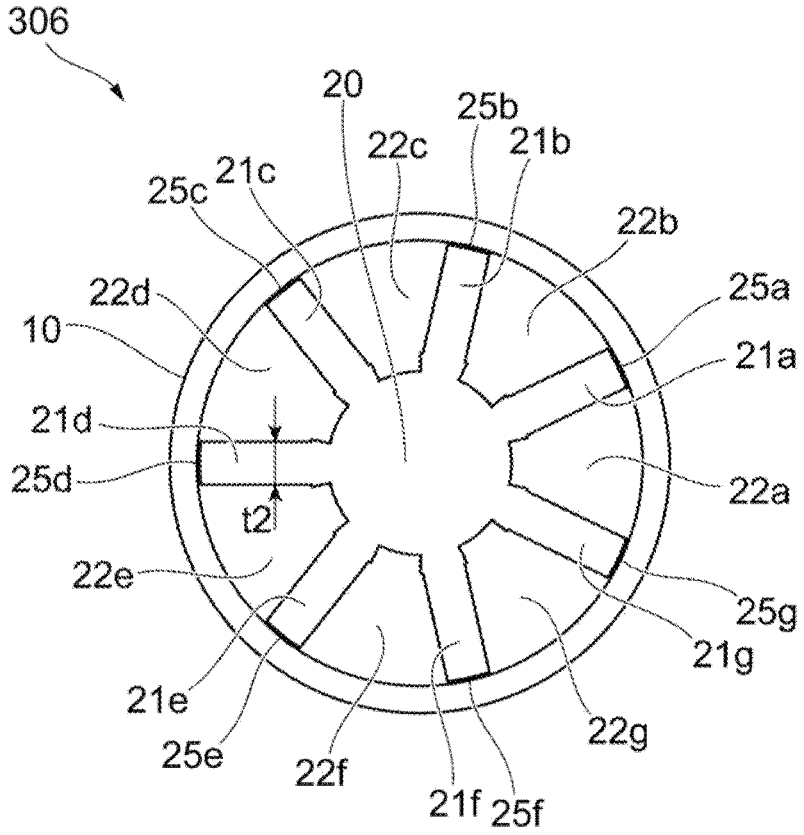
FIG. 40B illustrates a cross-sectional view of a distributor, according to a twenty fourth embodiment of the disclosure.

FIGS. 40A and 40B are cross-sectional views of the distributor 306, according to the twenty fourth embodiment of the disclosure. The cross-sectional views show a case that the plurality of partition plates 21 are installed in the inner pipe 20. FIG. 40A illustrates a B-B cross-sectional view of the distributor 306 and FIG. 40B illustrates a C-C cross-sectional view of the distributor 306, in the twenty fourth embodiment of the disclosure. The partition plates 21*a* to 21*g* may be installed integrally with the inner pipe 20, defining the plurality of distribution paths 22*a* to 22*g* accordingly. The partition plates 21 connect the outer side of the inner pipe 20 and the center portion of the inner pipe 20, so that the width of the distribution path 22 between the partition plates 21 decreases as it goes from the outer side of the inner pipe 20 to the center portion. Furthermore, the partition plates 21*a* to 21*g* are bonded to the outer pipe 10 with a substance 25*a* to 25*g*. The substance 25*a* to 25*g* may be e.g., an adhesive without being limited thereto. The substance 25*a* to 25*g* may be any heterogeneous material different from material(s) of the outer pipe 10 and the inner pipe 20. The partition plates 21*a* to 21*g* have plate thickness of t1 in FIG. 40A, but have plate thickness of t2 (t1<t2) in FIG. 40B.

In other words, the partition plates 21*a* to 21*g* have plate thickness of t1 along the B-B line of FIG. 32 or 35 and t2 (t1<t2) along the C-C line of FIG. 32 or 35, without being limited thereto.

In other words, the partition plates 21*a* to 21*g* have plate thickness of t1 at any location in the range R3 of FIG. 32 or 35 and t2 (t1<t2) at any location in the range R4 of FIG. 32 or 35, without being limited thereto. In yet another example, a plurality of ranges may be set for corresponding sets of branched pipes 60, and the partition plates 21*a* to 21*g* in each range may have plate thickness that increases stepwise from the refrigerant upstream side to the refrigerant downstream side. Furthermore, the plate thickness of the partition plates 21*a* to 21*g* may continuously increase from the refrigerant upstream side to the refrigerant downstream side.

Alternatively, when more refrigerant is required to flow into the branched pipes 60 on the refrigerant upstream side, the plate thickness t1 of the partition plate 21*a* to 21*g* along the B-B line of FIG. 32 or 35 and the plate thickness t2 of the partition plate 21*a* to 21*g* along the C-C line of FIG. 32 or 35 may satisfy a condition of t1>t2. That is, the plate thickness t1 and t2 may have different values. Assuming that the B-B and C-C lines are an example of first and second locations in the axial direction of the outer pipe, the plate thickness t1 corresponds to first thickness and the plate thickness t2 corresponds to second thickness. Even in this case, the plate thickness of the partition plates 21*a* to 21*g* may be changed stepwise or continuously.

Although the partition plates 21*a* to 21*g* are installed integrally with the inner pipe 20 in the above embodiment of the disclosure, it is not limited thereto. For example, the partition plates 21*a* to 21*g* may be installed integrally with the outer pipe 10. In this case, the partition plates 21*a* to 21*g* may be bonded to the inner pipe 20 with the substance 25*a* to 25*g*.

As described above, in the twenty fourth embodiment of the disclosure, the plate thickness of the partition plates 21 differs between the refrigerant upstream side and the refrigerant downstream side. For example, the plate thickness of the partition plate 21 may be thin on the refrigerant upstream side and thick on the refrigerant upstream side. The refrigerant flow slows down in the refrigerant downstream in the distribution path 22, but the heat exchange capability may be increased because of uniform distribution of the gas-liquid refrigerant to the branched pipes 60 on the refrigerant downstream side without reducing the fluid velocity.

An overall structure of a distributor 307 according to the twenty fifth embodiment of the disclosure is similar to that in FIG. 32 or 35. The distributor 307 is also to distribute a refrigerant as an example of a fluid that passes in the distributor 307. Furthermore, the distributor 307 may include the outer pipe 10 in the form of a cylinder, the inner pipe 20 installed in the outer pipe 10, and the orifice plate 40 installed at a refrigerant upstream end of the inner pipe 20. The outer pipe 10 is shown as having the shape of a cylinder as an example, but it may have the form of a barrel, in which case the outer pipe 10 is an example of a barrel-shaped outer pipe. The inner pipe 20 is also shown as having the shape of a cylinder, but it may have no hollow, in which case the inner pipe 20 is an example of an inner shaft installed in the outer pipe 10. Moreover, the distributor 307 may include a plurality of branched pipes 60 fixed in the refrigerant downstream and connected to refrigerant pipes of a heat exchanger.

A plurality of partition plates 21 are installed in the inner pipe 20 or the outer pipe 10, defining a plurality of distribution paths 22 accordingly.

Figure 41:
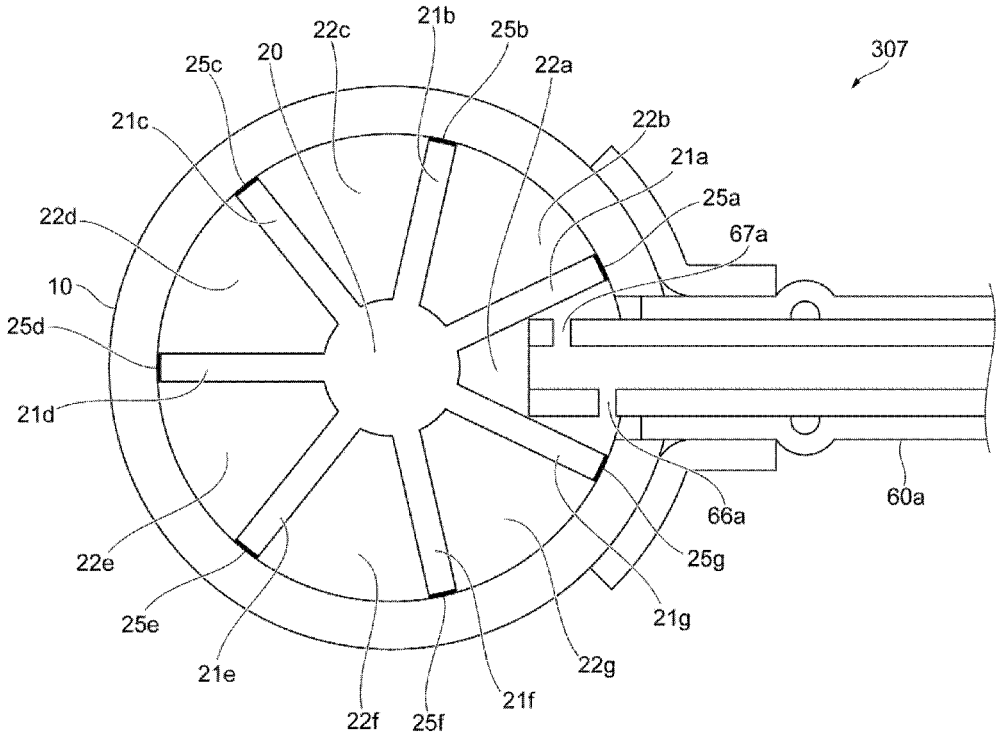
FIG. 41 illustrates an A-A cross-sectional view of a distributor, according to a twenty fifth embodiment of the disclosure.

FIG. 41 illustrates a cross-sectional view along line A-A of the distributor 307, according to the twenty fifth embodiment of the disclosure. The cross-sectional view shows a case that the plurality of partition plates 21 are installed in the inner pipe 20. The partition plates 21*a* to 21*g* may be installed integrally with the inner pipe 20, defining the plurality of distribution paths 22*a* to 22*g* accordingly. The partition plates 21 connect the outer side of the inner pipe 20 and the center portion of the inner pipe 20, so that the width of the distribution path 22 between the partition plates 21 decreases as it goes from the outer side of the inner pipe 20 to the center portion. Furthermore, the partition plates 21*a* to 21*g* are bonded to the outer pipe 10 with a substance 25*a* to 25*g*. The substance 25*a* to 25*g* may be e.g., an adhesive without being limited thereto. The substance 25*a* to 25*g* may be any heterogeneous material different from material(s) of the outer pipe 10 and the inner pipe 20. In FIG. 41, the branched pipe 60*a* linked and fixed to the distribution path 22*a* is inserted between the partition plates 21*a* and 21*g* that define the distribution path 22*a*. In this embodiment of the disclosure, side holes 66*a* and 67*a* through which to allow the refrigerant to flow in may be formed at the branched pipe 60*a*. Furthermore, in the twenty fifth embodiment of the disclosure, the diameter of the side holes 66*a* and 67*a* may differ among the multiple branched pipes 60*a* (three branched pipes 60*a* in FIG. 32 or 35). Although the branched pipe 60*a* linked to the distribution path 22*a* is shown because FIG. 41 is an A-A cross-sectional view of FIG. 32 or 35, what are described above in connection with the branched pipe 60*a* may be equally applied to the other branched pipes 60*b* to 60*g* linked to the distribution paths 22*a* to 22*g*.

The branched pipe 60*a* has the side holes 66*a* and 67*a* formed thereat, without being limited thereto. For example, a front hole through which to allow the refrigerant to flow in may be formed at the branched pipe 60*a* on the front in the direction of insertion to the distribution path 22*a*. The front hole is different from a hole at the axial part 62*a* in the first or second embodiment of the disclosure in that the front hole is formed without shrinking the branched pipe 60*a*. The side holes 66*a* and 67*a* and the front hole are an example of holes formed on any side of a portion inserted to one distribution path.

Although the partition plates 21*a* to 21*g* are installed integrally with the inner pipe 20 in the above embodiment of the disclosure, it is not limited thereto. For example, the partition plates 21*a* to 21*g* may be installed integrally with the outer pipe 10. In this case, the partition plates 21*a* to 21*g* may be bonded to the inner pipe 20 with the substance 25*a* to 25*g*.

As described above, in the twenty fifth embodiment of the disclosure, a hole (or holes) through which to allow the refrigerant to flow in may be formed on a side of a portion of the distributor 307 inserted to the distribution path 22, and the diameter of the hole differs between the refrigerant upstream side and the refrigerant downstream side. Accordingly, refrigerant flow distribution may be adjusted, thereby increasing heat exchange capability.

Figure 42:
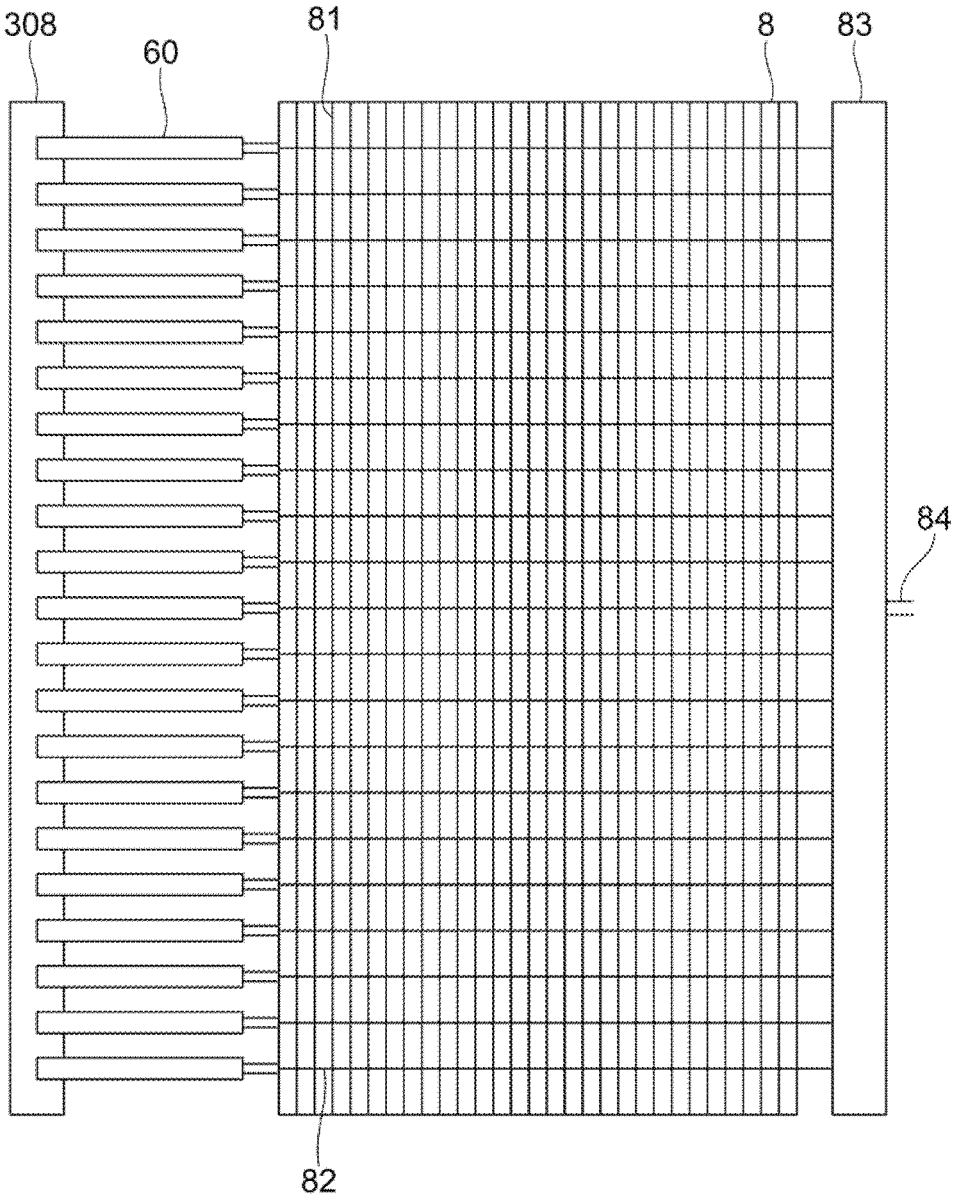
FIG. 42 illustrates an overall structure of a heat exchange unit including a distributor and a heat exchanger, according to a twenty sixth embodiment of the disclosure.

FIG. 42 illustrates an overall structure of a heat exchange unit including a distributor 308 and the heat exchanger 8, according to a twenty sixth embodiment of the disclosure.

An overall structure of the distributor 308 included in the heat exchange unit according to the thirteenth embodiment of the disclosure is similar to that in FIG. 32 or 35. The distributor 308 is also to distribute a refrigerant as an example of a fluid that passes in the distributor 308. Furthermore, the distributor 308 may include an outer pipe 10 in the form of a cylinder, and an inner pipe 20 installed in the outer pipe 10. The outer pipe 10 is shown as having the shape of a cylinder as an example, but it may have the form of a barrel, in which case the outer pipe 10 is an example of a barrel-shaped outer pipe. The inner pipe 20 is also shown as having the shape of a cylinder, but it may have no hollow, in which case the inner pipe 20 is an example of an inner shaft installed in the outer pipe 10.

A plurality of partition plates 21 are installed in the inner pipe 20 or the outer pipe 10, defining a plurality of distribution paths 22 accordingly.

The heat exchanger 8 included in the heat exchange unit in the twenty sixth embodiment of the disclosure performs heat exchange between the refrigerant as an example of a fluid distributed by the distributor 308 and air. The heat exchanger 8 may include a plurality of fins 81 vertically arranged in parallel at preset intervals, a plurality of refrigerant pipes 82 as an example of a plurality of fluid pipes installed in parallel to pass through holes of the fins 81, a header 83 at which the refrigerant flowing from each of the plurality of refrigerant pipes 82 joins, and an external connection pipe 84 through which to exhaust the refrigerant from the header 83.

The plurality of branched pipes 60 of the distributor 308 may connect to the plurality of refrigerant pipes 82 of the heat exchanger 8 one to one.

As described above, in the twenty sixth embodiment of the disclosure, the refrigerant flow resistance may be changed in the single distribution path 22 while the plurality of partition plates 21 are integrated with the inner pipe 20 or the outer pipe 10. Accordingly, refrigerant flow distribution may be adjusted while preventing a refrigerant leak, thereby increasing heat exchange capability.

According to the disclosure, a distributor may be kept compact even when the number of branched pipes connected to a main pipe is increased.

According to the disclosure, the possibility of worsening fluid distribution characteristics due to unequal distribution of a fluid into the plurality of distribution paths may be reduced.

Furthermore, according to the disclosure, the possibility of worsening fluid distribution characteristics due to occurrence of a fluid leak between the outer pipe and the plurality of partitions or between the inner shaft and the plurality of partitions may be reduced.

Although the present disclosure has been described with various embodiments, various changes and modifications may be suggested to one skilled in the art. It is intended that the present disclosure encompass such changes and modifications as fall within the scope of the appended claim.

What is claimed is:

1. An air conditioner comprising:

a distributor configured to distribute a fluid passing inside of the distributor; and a heat exchanger including a plurality of refrigerant pipes in which the fluid distributed by the distributor flows, the heat exchanger configured to exchange heat with air, wherein the distributor comprises:

a main pipe;

a partition defining a plurality of distribution paths separated from each other in the main pipe, the plurality of distribution paths including a first distribution path and a second distribution path being different from the first distribution path;

a first branched pipe inserted into the first distribution path as much as a first insertion length, the first branched pipe connected to a first refrigerant pipe in a first portion of the heat exchanger;

a second branched pipe inserted into the first distribution path as much as a second insertion length longer than the first insertion length, the second branched pipe connected to a second refrigerant pipe in a second portion of the heat exchanger; and a third branched pipe inserted into the second distribution path as much as the second insertion length of the second branched pipe inserted into the first distribution path, and wherein a flow velocity of air exchanging heat at the first portion of the heat exchanger is faster than a flow velocity of air exchanging heat at the second portion of the heat exchanger.

2. The air conditioner of claim 1, wherein an opening of an axial part of the first branched pipe linked to the first distribution path is different in size from an opening of an axial part of the second branched pipe linked to the first distribution path.

3. The air conditioner of claim 1, wherein the partition is arranged to extend along an inclined direction with a certain angle against an axial direction of the main pipe.

4. The air conditioner of claim 3, wherein the partition comprises a modified rib arranged to be in close contact with the main pipe while being modified when the partition is coupled to the main pipe.

5. The air conditioner of claim 3, wherein:

the partition extends along an inclined direction with a first angle against the axial direction of the main pipe in upstream of a direction in which a refrigerant flows, and the partition extends along an inclined direction with a second angle greater than the first angle against the axial direction of the main pipe in downstream of the direction in which the refrigerant flows.

6. The air conditioner of claim 1, further comprising an orifice plate arranged at an upstream end of a direction in which a refrigerant flows in the main pipe, wherein the orifice plate comprises a plurality of orifice holes to guide the refrigerant into the plurality of distribution paths, and wherein the plurality of orifice holes comprises a first orifice hole and a second orifice hole, the second orifice hole different in size from the first orifice hole.

7. The air conditioner of claim 1, wherein the distributor is shorter in length than the heat exchanger.

8. The air conditioner of claim 1, further comprising an orifice plate arranged at an upstream end of a direction in which a refrigerant flows in the main pipe, wherein the orifice plate comprises a convex portion, and wherein the partition comprises a concave portion formed at a location corresponding to the convex portion to allow the convex portion to be inserted to the concave portion.

9. The air conditioner of claim 1, further comprising:

an orifice plate arranged at an upstream end of a direction in which a refrigerant flows in the main pipe, the orifice plate comprising a plurality of projections inserted into the plurality of distribution paths, and a brazing sheet arranged between the main pipe and the orifice plate.

10. The air conditioner of claim 1, further comprising:

a cap coupled to an opposite end to upstream of a direction in which a refrigerant flows in the main pipe, the cap comprising a plurality of projections inserted into the plurality of distribution paths, and a brazing sheet arranged between the main pipe and the cap.

11. The air conditioner of claim 1, further comprising an exterior cover coupled to a circumferential surface of the main pipe, wherein the exterior cover comprises a plurality of burring holes, the plurality of burring holes formed for at least one of the first branched pipe or the second branched pipe to be inserted into.

12. The air conditioner of claim 1, wherein the partition comprises a step part formed to support at least one of the first branched pipe or the second branched pipe.

13. The air conditioner of claim 1, further comprising a substance different from the main pipe and the partition provided between the main pipe and the partition.

14. The air conditioner of claim 1, wherein the partition has a size or shape of a cross-section of an upstream portion of a direction in which a refrigerant flows in the main pipe different from a size or shape of a cross-section of a downstream portion of the direction in which the refrigerant flows in the main pipe.

15. The air conditioner of claim 1, further comprising a branch arranged for the first branched pipe or the second branched pipe to be connected to at least two of the plurality of refrigerant pipes.

* * * * *